US010635045B2

(12) United States Patent
Kawakami et al.

(10) Patent No.: US 10,635,045 B2
(45) Date of Patent: Apr. 28, 2020

(54) CARTRIDGE DETACHABLY MOUNTABLE TO MAIN ASSEMBLY OF ELECTROPHOTOGRAPHIC IMAGE FORMING APPARATUS, ASSEMBLING METHOD FOR DRIVE TRANSMITTING DEVICE FOR PHOTOSENSITIVE DRUM, AND ELECTROPHOTOGRAPHIC IMAGE FORMING APPARATUS

(71) Applicant: CANON KABUSHIKI KAISHA, Tokyo (JP)

(72) Inventors: Takuya Kawakami, Mishima (JP); Noriyuki Komatsu, Numazu (JP); Sho Shirakata, Kawasaki (JP); Isao Koishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/791,635

(22) Filed: Oct. 24, 2017

(65) Prior Publication Data

US 2018/0046133 A1 Feb. 15, 2018

Related U.S. Application Data

(60) Division of application No. 15/189,169, filed on Jun. 22, 2016, now Pat. No. 9,823,619, which is a division (Continued)

(30) Foreign Application Priority Data

Dec. 6, 2011 (JP) ..... 2011-266989
Oct. 15, 2012 (JP) ..... 2012-228108
Nov. 2, 2012 (JP) ..... 2012-242778

(51) Int. Cl.
*G03G 15/16* (2006.01)
*G03G 21/16* (2006.01)
*G03G 21/18* (2006.01)

(52) U.S. Cl.
CPC ..... *G03G 21/1671* (2013.01); *G03G 21/1647* (2013.01); *G03G 21/186* (2013.01); *Y10T 29/49826* (2015.01)

(58) Field of Classification Search
CPC ..... G03G 21/186; G03G 21/1853; G03G 21/1647; G03G 2221/1657
See application file for complete search history.

(56) References Cited

U.S. PATENT DOCUMENTS 4,065,941 A 1/1978 Aoki
6,671,477 B2 12/2003 Komatsu et al.
(Continued)

FOREIGN PATENT DOCUMENTS

JP 2002-048148 A 2/2002
JP 2004-045603 A 2/2004
(Continued)

OTHER PUBLICATIONS

Notice of Allowance in Korean Patent Application No. 10-2017-7025662, dated Mar. 20, 2018.
(Continued)

*Primary Examiner* — Walter L Lindsay, Jr.
*Assistant Examiner* — Jessica L Eley
(74) *Attorney, Agent, or Firm* — Venable LLP

(57) ABSTRACT

With a structure in which a coupling member includes a sphere providing a center of inclination (pivoting), a rotational force transmitted member has an opening have a diameter smaller than that of the sphere, and the coupling member is prevented from disengaging from rotational force transmitted member by contact of inner edge of the opening to the sphere, the inner edge of the opening may limit an inclinable (pivotable) angle range of the coupling member. In a state that a pin 88 which is a shaft portion is inserted in a hole 86*b* which is a through-hole provided in a coupling
(Continued)

member 86, opposite end portions of the pin 88 are supported by a driving side flange 87 which is a rotational force transmitted member.

The coupling member 86 and the driving side flange 87 and the pin 88 are connected in this manner, and the pin 88 contact the inside of the hole 86*b* without limiting the inclinable (pivotable) angle range, by which the coupling member 86 is prevented from disengaging from the driving side flange 87.

26 Claims, 56 Drawing Sheets

Related U.S. Application Data of application No. 14/291,918, filed on May 30, 2014, now Pat. No. 9,395,679, which is a continuation of application No. PCT/JP2012/082271, filed on Dec. 6, 2012.

(56) References Cited

U.S. PATENT DOCUMENTS

| | | | | |
|---|---|---|---|---|
| 7,003,247 | B2 | 2/2006 | Koishi et al. | |
| 7,024,131 | B2 | 4/2006 | Komatsu et al. | |
| 7,072,601 | B2 | 7/2006 | Kakitani et al. | |
| 7,110,703 | B2 | 9/2006 | Uratani et al. | |
| 7,139,502 | B2 | 11/2006 | Koishi et al. | |
| 7,156,797 | B2 | 1/2007 | Komatsu et al. | |
| 7,158,749 | B2 | 1/2007 | Ueno et al. | |
| 7,184,690 | B2 | 2/2007 | Ueno et al. | |
| 7,266,326 | B2 | 9/2007 | Karakama et al. | |
| 7,283,765 | B2 | 10/2007 | Uratani et al. | |
| 7,315,710 | B2 | 1/2008 | Ueno et al. | |
| 7,457,566 | B2 | 11/2008 | Koishi et al. | |
| 7,813,671 | B2 | 10/2010 | Nittani et al. | |
| 7,856,192 | B2 | 12/2010 | Koishi et al. | |
| 7,890,012 | B2 | 2/2011 | Koishi et al. | |
| 8,139,979 | B2 | 3/2012 | Koishi et al. | |
| 8,526,841 | B2 | 9/2013 | Koishi et al. | |
| 8,571,445 | B2 | 10/2013 | Komatsu et al. | |
| 8,787,794 | B2 | 7/2014 | Miyazaki et al. | |
| 2002/0025191 | A1 | 2/2002 | Kitayama | |
| 2006/0240896 | A1 | 10/2006 | Ohashi et al. | |
| 2007/0110478 | A1 | 5/2007 | Numagami et al. | |
| 2008/0095549 | A1 | 4/2008 | Yoshizawa | |
| 2008/0152388 | A1 | 6/2008 | Ueno et al. | |
| 2008/0260428 | A1 | 10/2008 | Ueno et al. | |
| 2009/0317129 | A1 | 12/2009 | Abe et al. | |
| 2009/0317132 | A1 | 12/2009 | Asanuma et al. | |
| 2010/0034561 | A1 | 2/2010 | Batori et al. | |
| 2010/0054823 | A1 | 3/2010 | Takasaka et al. | |
| 2010/0170368 | A1 | 7/2010 | Hu | |
| 2010/0221036 | A1* | 9/2010 | Hara | G03G 21/1853 399/110 |
| 2011/0038649 | A1 | 2/2011 | Miyabe et al. | |
| 2011/0182654 | A1* | 7/2011 | Hu | F16D 3/16 403/123 |
| 2012/0243905 | A1 | 9/2012 | Uratani et al. | |
| 2013/0064659 | A1 | 3/2013 | Geisner | |
| 2014/0056614 | A1 | 2/2014 | Koishi et al. | |
| 2014/0064784 | A1 | 3/2014 | Hayashi et al. | |
| 2014/0112685 | A1 | 4/2014 | Komatsu et al. | |
| 2015/0010320 | A1 | 1/2015 | Komatsu et al. | |

FOREIGN PATENT DOCUMENTS

| | | | |
|---|---|---|---|
| JP | 2006-072160 | A | 3/2006 |
| JP | 2008-233868 | A | 10/2008 |
| JP | 4498407 | A | 10/2008 |
| JP | 4948382 | B2 | 10/2008 |
| JP | 2008-268297 | A | 11/2008 |
| JP | 2009-300516 | A | 12/2009 |
| JP | 2010-002688 | A | 1/2010 |
| JP | 2010-2689 | A | 1/2010 |
| JP | 3157067 | U | 1/2010 |
| JP | 2010-026473 | A | 2/2010 |
| JP | 2010-079283 | A | 4/2010 |
| JP | 2010-079284 | A1 | 4/2010 |
| JP | 2010-140051 | A | 6/2010 |
| JP | 2010-152387 | A | 7/2010 |
| JP | 2011-095604 | A | 5/2011 |
| JP | 2011-145670 | A | 7/2011 |
| KR | 10-2009-0105941 | A | 10/2009 |
| KR | 10-1653333 | | 9/2016 |
| RU | 2 367 016 | C2 | 4/2009 |
| WO | 2008/072431 | A2 | 6/2008 |
| WO | 2008/078836 | A1 | 7/2008 |
| WO | 2008/081966 | A1 | 7/2008 |
| WO | 2009/151132 | A | 12/2009 |

OTHER PUBLICATIONS

Dec. 6, 2017 Office Action in Korean Patent Application No. 10-2017-7025662.

Office Action in Taiwanese Patent Application No. 101145980, dated Aug. 13, 2014.

Communication in European Patent Application No. 12854694.2, dated Jun. 25, 2015.

Office Action in Korean Patent Application No. 10-2014-7017797, dated Sep. 2, 2015.

English translation of Sep. 2, 2015 Office Action in Korean Patent Application No. 10-2014-7017797.

Notice of Allowance in Korean Patent Application No. 10-2014-7017797, dated May 25, 2016.

Office Action in Taiwanese Patent Application No. 104110971, dated Oct. 24, 2016.

Notice of Allowance in Korean Patent Application No. 10-2016-7023505, dated Nov. 17, 2016.

Notice of Allowance in Korean Patent Application No. 10-2017-7004597, dated Mar. 3, 2017.

Mar. 9, 2017 Office Action in Chinese Patent Application No. 201280068776.6 (with English translation).

Notice of Allowance in Korean Patent Application No. 10-2017-7015343, dated Jun. 12, 2017.

Jun. 29, 2017 Decision on Grant in Russian Patent Application No. 2014127499 (with English translation).

Office Action in Taiwanese Patent Application No. 106121120, dated Apr. 23, 2018.

Office Action in Japanese Patent Application No. 2017-217747, dated Sep. 25, 2018.

Office Action in European Patent Application No. 12 854 694.2, dated Nov. 16, 2018.

Office Action in Indian Patent Application No. 4840/CHENP/2014, dated Jun. 25, 2018.

Notice of Allowance in Korean Patent Application No. 10-2018-7017639, dated Sep. 27, 2018.

Decision to Grant in Russian Patent Application No. 2017138243, dated Sep. 5, 2018.

Office Action in Korean Patent Application No. 10-2018-7038007, dated Apr. 29, 2019.

Decision to Grant in Russian Patent Application No. 2018137479, dated Apr. 8, 2019 (with English translation).

Office Action in Japanese Patent Application No. 2017-217747, dated Dec. 18, 2018.

Notice of Allowance in Korea Patent Application No. 10-2019-7022314, dated Sep. 5, 2019.

Sep. 20, 2019 Office Action in Taiwanese Patent Application No. 107129611.

Office Action in Brazilian Patent Application No. 122015030276-5, dated Nov. 5, 2019 (with partial English translation).

Office Action in Brazilian Patent Application No. 112014013431-6, dated Nov. 4, 2019 (with partial English translation).

Decision to Grant in Russian Patent Application No. 2019118292, dated Nov. 20, 2019 (with English translation).

(56) References Cited

OTHER PUBLICATIONS

Office Action dated Dec. 27, 2019, issued in Taiwanese Patent Application No. 107129611.
Mar. 2, 2020 Notice of Allowance in Korean Patent Application No. 10-2019-7035854.

* cited by examiner (a)

(b)

(c)

(a)

(b)

(a)

(b)

(c)

(a)

(b)

(c)

(a)

(b)

(c)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(c)

CARTRIDGE DETACHABLY MOUNTABLE TO MAIN ASSEMBLY OF ELECTROPHOTOGRAPHIC IMAGE FORMING APPARATUS, ASSEMBLING METHOD FOR DRIVE TRANSMITTING DEVICE FOR PHOTOSENSITIVE DRUM, AND ELECTROPHOTOGRAPHIC IMAGE FORMING APPARATUS

FIELD OF THE INVENTION

The present invention relates to a cartridge detachably mountable to a main assembly of an electrophotographic image forming apparatus, an assembling method for a drive transmission device for a photosensitive drum, and a electrophotographic image forming apparatus.

Here, the cartridge is a device including an electrophotographic photosensitive member and at least one process means and is detachably mountable to a main assembly of the electrophotographic image forming apparatus.

A representative example of the cartridge is a process cartridge. The process cartridge is a unit unified into a cartridge including the electrophotographic photosensitive drum, and process means actable on the electrophotographic photosensitive drum such as a developing device, the process cartridge being dismountably mountable to the main assembly of the electrophotographic image forming apparatus.

The electrophotographic image forming apparatus is an apparatus for forming an image on a recording material using an electrophotographic image formation type process.

Examples of the electrophotographic image forming apparatus include an electrophotographic copying machine, an electrophotographic printer (LED printer, laser beam printer or the like), a facsimile machine and a word processor and so on.

BACKGROUND ART

An apparatus main assembly not provided with a mechanism for moving a main assembly side engaging portion provided in the main assembly of the electrophotographic image forming apparatus to transmit a rotational force to a rotatable member such as an electrophotographic photosensitive drum, in response to an opening and closing operation of a main assembly cover of the apparatus main assembly, in a rotational axis direction of the main assembly side engaging portion, is known.

In addition, a structure of a process cartridge demountable, from the apparatus main assembly, in a predetermined direction substantially perpendicular to a rotational axis of the rotatable member is known.

Further, a structure for engaging a coupling member provided on the process cartridge with the main assembly side engaging portion is known.

As to the coupling type as such a rotational force transmission means, a structure is known in which the coupling member provided on an electrophotographic photosensitive drum unit is made pivotable relative to the rotational axis of the electrophotographic photosensitive drum unit so that an engaging operation and a disengaging operation of the coupling member with the mounting and demounting operation of the process cartridge relative to the apparatus main assembly (Japanese Patent No. 4498407).

SUMMARY OF THE INVENTION

Problems to be Solved

With the conventional structure disclosed in FIG. 103 of Japanese Patent 4498407, the coupling member is provided with a spherical portion for providing a pivoting center, and a flange has an opening having a diameter smaller than that of the spherical portion. The coupling member is prevented from disengaging from the flange by the contact of an inner edge of the opening to the spherical portion.

However, the inner edge of the opening may restrict a pivotability angle of the coupling member.

Accordingly, it is an object of the present invention to provide a development of the above-described prior-art structure.

It is an object of the present invention to provide a drive transmission structure for a cartridge which is demountable to an outside from an apparatus main assembly not provided with a mechanism for moving a main assembly side engaging portion in the rotational axis direction thereof, after movement in a predetermined direction substantially perpendicular to a rotational axis of a rotatable member such as an electrophotographic photosensitive drum, in which the coupling member is prevented from disengaging without limiting the inclinability (pivotability) amount of the coupling member by the inner edge of the opening provided in the flange.

It is an object of the present invention to provide a cartridge employing the drive transmission structure.

Means for Solving the Problems

The present invention achieving the object provides,

A cartridge detachably mountable to a main assembly of an electrophotographic image forming apparatus including a main assembly side rotatable engaging portion, wherein said cartridge is demountable to an outside of said apparatus main assembly after movement in a predetermined direction substantially perpendicular to a rotational axis of the main assembly side engaging portion, said cartridge comprising:

(i) a rotatable member which is rotatable carrying a developer;

(ii) a rotatable rotational force transmitted member which includes an accommodating portion at inside thereof and to which a rotational force to be transmitted to the rotatable member is transmitted;

(iii) a rotatable coupling member including, (iii-i) a free end portion having a rotational force receiving portion configured to receive the rotational force from the main assembly side engaging portion, (iii-ii) a connecting portion which is connected with said rotational force transmitted member and at least a part which is accommodated in said accommodating portion so that a rotational axis of said coupling member is pivotable relative to a rotational axis of said rotational force transmitted member to permit said rotational force receiving portion to disengage from the main assembly side engaging portion with a movement of said cartridge in the predetermined direction, (iii-iii) a through-hole penetrating said connecting portion;

(iv) a shaft portion capable of receiving the rotational force from said coupling member and penetrating said through-hole and supported by said rotational force transmitted member at opposite end portions thereof so that said coupling member is prevented from disengaging from said rotational force transmitted member while permitting the pivoting of said coupling member.

Effects of the Invention

According to the present invention, a drive transmission structure for a cartridge which is demountable to an outside from an apparatus main assembly not provided with a mechanism for moving a main assembly side engaging portion in the rotational axis direction thereof, after movement in a predetermined direction substantially perpendicular to a rotational axis of a rotatable member such as an electrophotographic photosensitive drum, in which the coupling member is prevented from disengaging without limiting the inclinability (pivotability) amount of the coupling member by the inner edge of the opening provided in the flange In addition, a cartridge employing the drive transmission device is provided.

DESCRIPTION OF THE EMBODIMENTS

Figure 1:
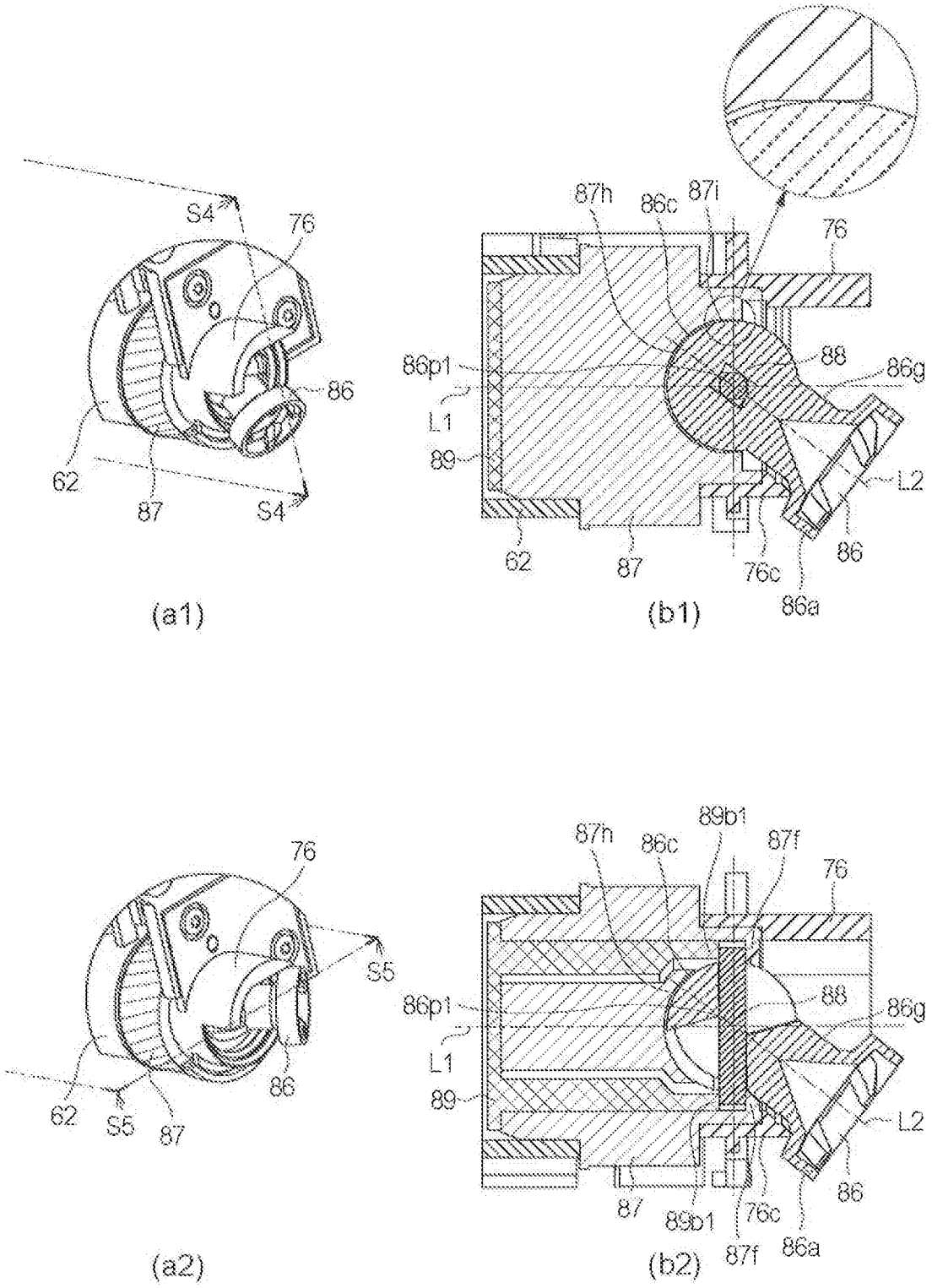
FIG. 1 is an illustration of inclination (pivoting) of the coupling member relative to a rotational axis the electrophotographic photosensitive drum rotates, according to a first embodiment of the present invention.

A cartridge and an electrophotographic image forming apparatus according to the present invention will be described in conjunction with the accompanying drawings. A laser beam printer which is in the example of the electrophotographic image forming apparatus, and a process cartridge usable with the laser beam printer as an example of the cartridge will be described.

Following description, a longitudinal direction of the process cartridge is a direction substantially perpendicular to a direction in which process cartridge is mounted and dismounted relative to the main assembly of the electrophotographic image forming apparatus, and the longitudinal direction is parallel with a rotational axis of the electrophotographic photosensitive drum and crosses with a feeding direction of the recording material. In the longitudinal direction, the side where the electrophotographic photosensitive drum receives the rotational force from the main assembly of the image forming apparatus is a driving side (coupling member 86 side in FIG. 4), and a non-driving side is the opposite side.

The reference numerals in the following description are for reference to the drawing and does not limit the structures.

Embodiment 1

Figure 2:
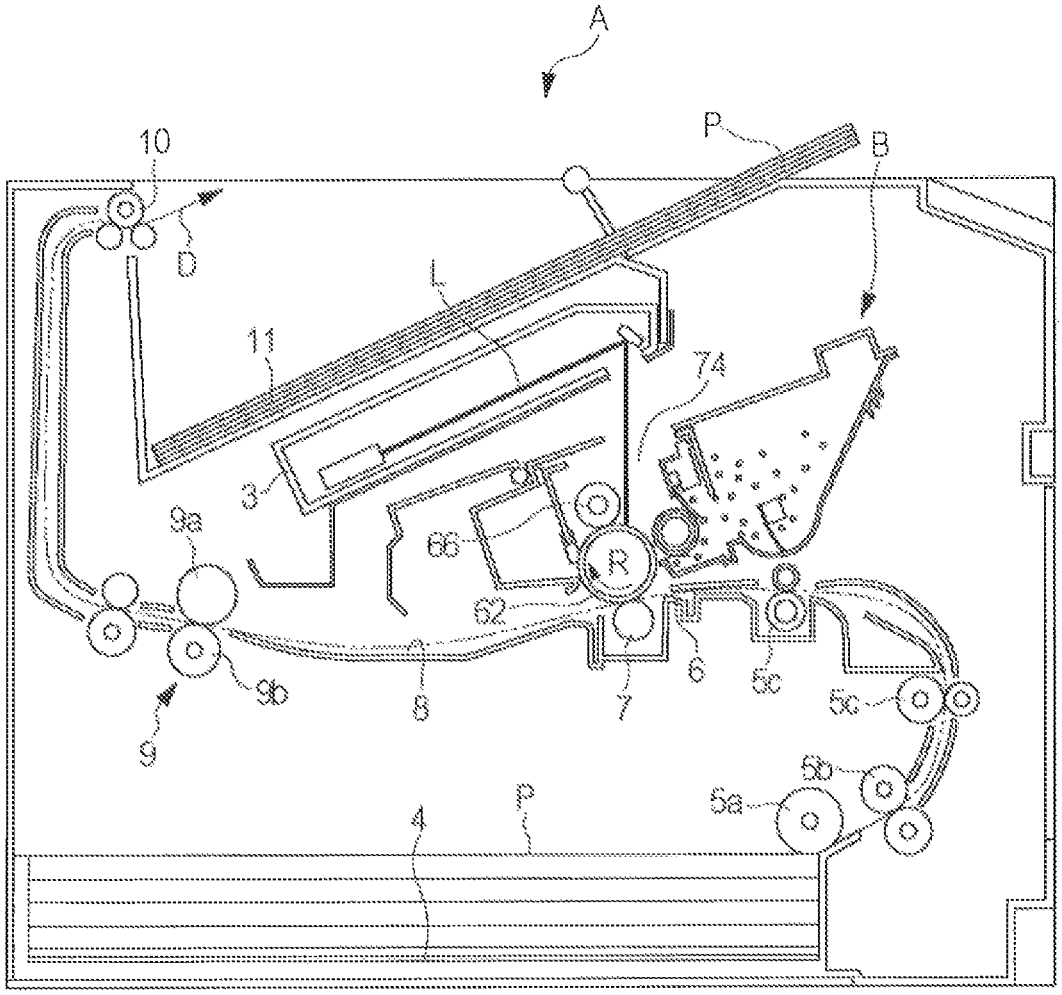
FIG. 2 is a sectional view of an electrophotographic image forming apparatus according to the first embodiment of the present invention.

(1) Description of Structure of the Electrophotographic Image Forming Apparatus and Image Forming Process:

FIG. 2 is a sectional view of the main assembly A (apparatus main assembly A) of the electrophotographic image forming apparatus and a process cartridge (cartridge B).

Figure 3:
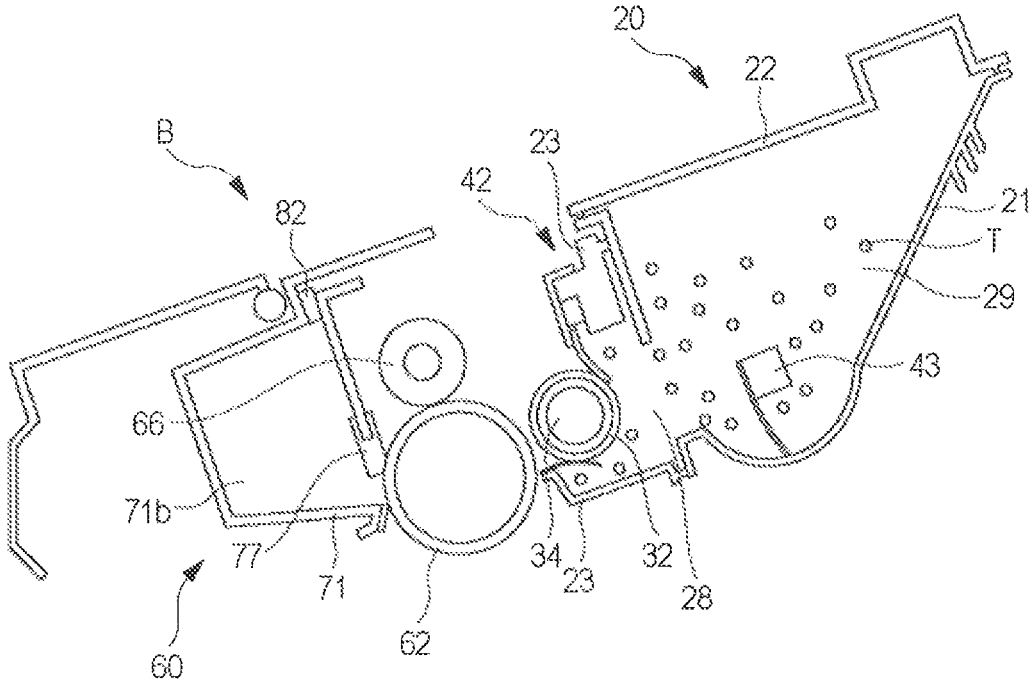
FIG. 3 is a sectional view of a process cartridge according to the first embodiment of the present invention.

FIG. 3 is a sectional view of the cartridge B.

Here, the main assembly A is a part of the electrophotographic image forming apparatus except for the cartridge B.

Referring to FIG. 2, the structure of the electrophotographic image forming apparatus will be described.

The electrophotographic image forming apparatus shown in FIG. 2 is a laser beam printer using an electrophotographic technique, to which the cartridge B is detachably mountable to the apparatus main assembly A. When the cartridge B is mounted to the apparatus main assembly A, the cartridge B is below an exposure device 3 (laser scanner unit).

In addition, below the cartridge B, there is provided a sheet tray 4 accommodating recording materials (sheet materials P) which is the image formation object.

Further, in the main assembly A, there are provided, along a feeding direction D of the sheet material P, a pick-up roller 5*a*, a feeding roller pair 5*b*, a feeding roller pair 5*c*, a transfer guide 6, a transfer roller 7, a feeding guide 8, a fixing device 9, a discharging roller, a discharging tray 11 and so on in the order named. The fixing device 9 comprises a heating roller 9*a* and a pressing roller 9*b*.

Referring to FIGS. 2, 3, the image forming process will be described briefly.

In response to a print starting signal, an electrophotographic photosensitive drum 62 (drum 62) which is a rotatable member is rotated in the direction indicated by an arrow R at a predetermined peripheral speed (process speed).

A charging roller 66 supplied with a bias voltage contacts an outer peripheral surface of the drum 62 to uniformly charge the outer peripheral surface of the drum 62.

An exposure device 3 outputs a laser beam corresponding to image information. The laser beam is projected onto the outer peripheral surface of the drum 62 through an exposure window 74 in an upper surface of the cartridge B to scanningly expose the outer peripheral surface.

By this, an electrostatic latent image formed on the outer peripheral surface of the drum 62 correspondingly to the image information.

On the other hand, as shown in FIG. 3, in a developing unit 20 as the developing device, a developer (toner T) in a toner chamber 29 is stirred and fed by rotation of the feeding member 43 into a toner supply chamber 28.

The toner T is carried on a surface of a developing roller 32 by magnetic force of a magnet roller 34 (fixed magnet).

The toner T is applied on a peripheral surface of a developing roller 3 with a regulated layer thickness, while being triboelectrically charged by a developing blade 42.

The toner T is transferred onto the drum 62 in accordance with the electrostatic latent image to be visualized into a toner image. Thus, the drum rotates carrying the toner (toner image).

As shown in FIG. 2, in timed relation with the output timing of the laser beam, the sheet material P accommodated in the lower portion of the apparatus main assembly A by the pick-up roller 5*a*, the feeding roller pair 5*b* and the feeding roller pair 5*c* from the sheet tray 4.

The sheet material P it supplied through a transfer guide 6 to a transfer position which is between the drum 62 and a transfer roller 7. In the transfer position, the toner image is sequentially transferred from the drum 62 onto the sheet material P.

The sheet material P having the transferred toner image is separated from the drum 62 and fed along the feeding guide 8 to the fixing device 9. The sheet material P passes through a nip formed between a heating roller 9*a* and a pressing roller 9*b* constituting the fixing device 9.

The toner image is subjected to a pressing and heat-fixing process by the nip to be fixed on the sheet material P. The sheet material P having been subjected to the toner image fixing process is fed to the discharging roller pair 10 and then is fed to the discharging tray 11.

On the other hand, as shown in FIG. 3, the drum 62 after transfer is cleaned by a cleaning blade 77 so that residual toner is removed from the outer peripheral surface to be prepared for a next image forming process. The toner removed from the drum 62 is stored in a residual toner chamber 71*b* of the cleaning unit 60.

In the foregoing, the charging roller 66, the developing roller 32 and the cleaning blade 77 are process means acting on the drum 62.

Figure 4:
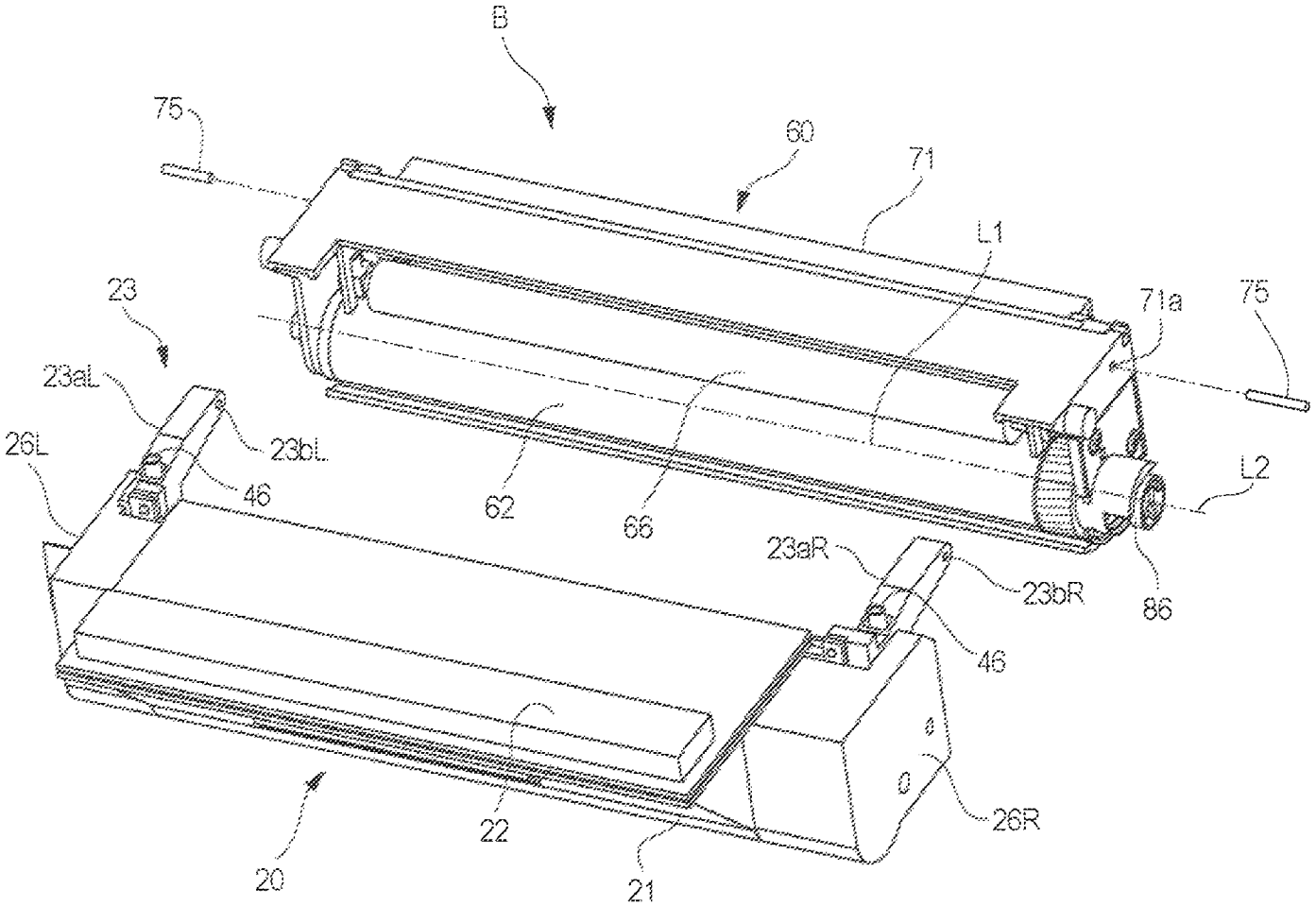
FIG. 4 is an exploded perspective view of the process cartridge according to the first embodiment of the present invention.

(2) Description of Structures of Cartridge B:

Referring to FIGS. 3 and 4, a general arrangement of the cartridge B will be described.

FIG. 4 is an exploded perspective view of the cartridge B.

The cartridge B comprises a cleaning unit 60 and a developing unit 20 connected with each other.

The cleaning unit 60 comprises a cleaning frame 71, the drum 62, the charging roller 66 and the cleaning blade 77 and so on.

A driving side end portion of the drum 62 is provided with a coupling member 86. Here, the drum 62 is rotatable about a rotational axis L1 (axis L1) as a drum axis. In addition, the coupling member 86 is rotatable about a rotational axis L2 (axis L2) as a coupling axis. The coupling member 86 is capable of inclining (pivoting) relative to the drum 62. In other words, the axis L2 is inclinable relative to the axis L1 (this will be described in detail hereinafter).

On the other hand, the developing unit 20 comprises a toner accommodating container 21, a closing member 22, a developing container 23, a first side member 26L, a second side member 26R, a developing blade 42, a developing roller 32, a magnet roller 34, a feeding member 43, the toner T, an urging member 46 and so on.

The cleaning unit 60 and the developing unit 20 are connected by a coupling member 75 so as to be rotatable relative to each other, by which the cartridge B is constituted.

More specifically, the developing container 23 is provided with arm portions 23*a*L, 23*a*R at the opposite end portions with respect to the longitudinal direction (axial direction of the developing roller 32) of the developing unit 20, and the free ends of the arm portions 23*a*L, 23*a*R are provided with rotation holes 23*b*L, 23*b*R extending parallel with the developing roller 32.

Longitudinal opposite end portions of the cleaning frame 71 are provided with respective fitting holes 71*a* for receiving the coupling member 75.

The arm portions 23*a*L and 23*a*R are aligned with a predetermined position of the cleaning frame 71, and the coupling member 75 is inserted into the rotation holes 23*b*L, 23*b*R and the fitting hole 71*a*, by which the cleaning unit 60 and the developing unit 20 are connected rotatably about the coupling member 75.

At this time, the urging members 46 mounted to the base portions of the arm portions 23*a*L and 23*a*R abut to the cleaning frame 71 by which the developing unit 20 is urged to the cleaning unit 60 about the coupling member 75.

By this, the developing roller 32 is assuredly pressed toward the drum 62.

By ring configuration spacers (unshown) mounted at each of the opposite end portions of the developing roller 32, a predetermined clearance it kept between the developing roller 32 and the drum 62.

Figure 5:
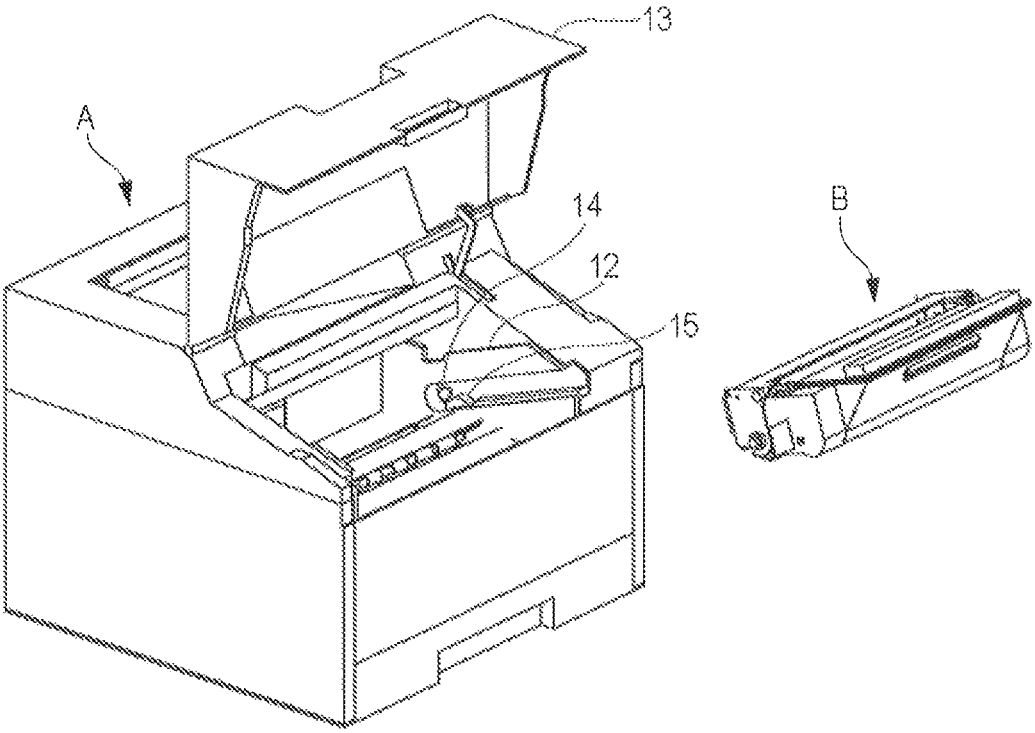
FIG. 5 is a perspective view illustrating mounting and demounting of the process cartridge relative to a main assembly of the electrophotographic image forming apparatus according to the first embodiment of the present invention.
Figure 6:
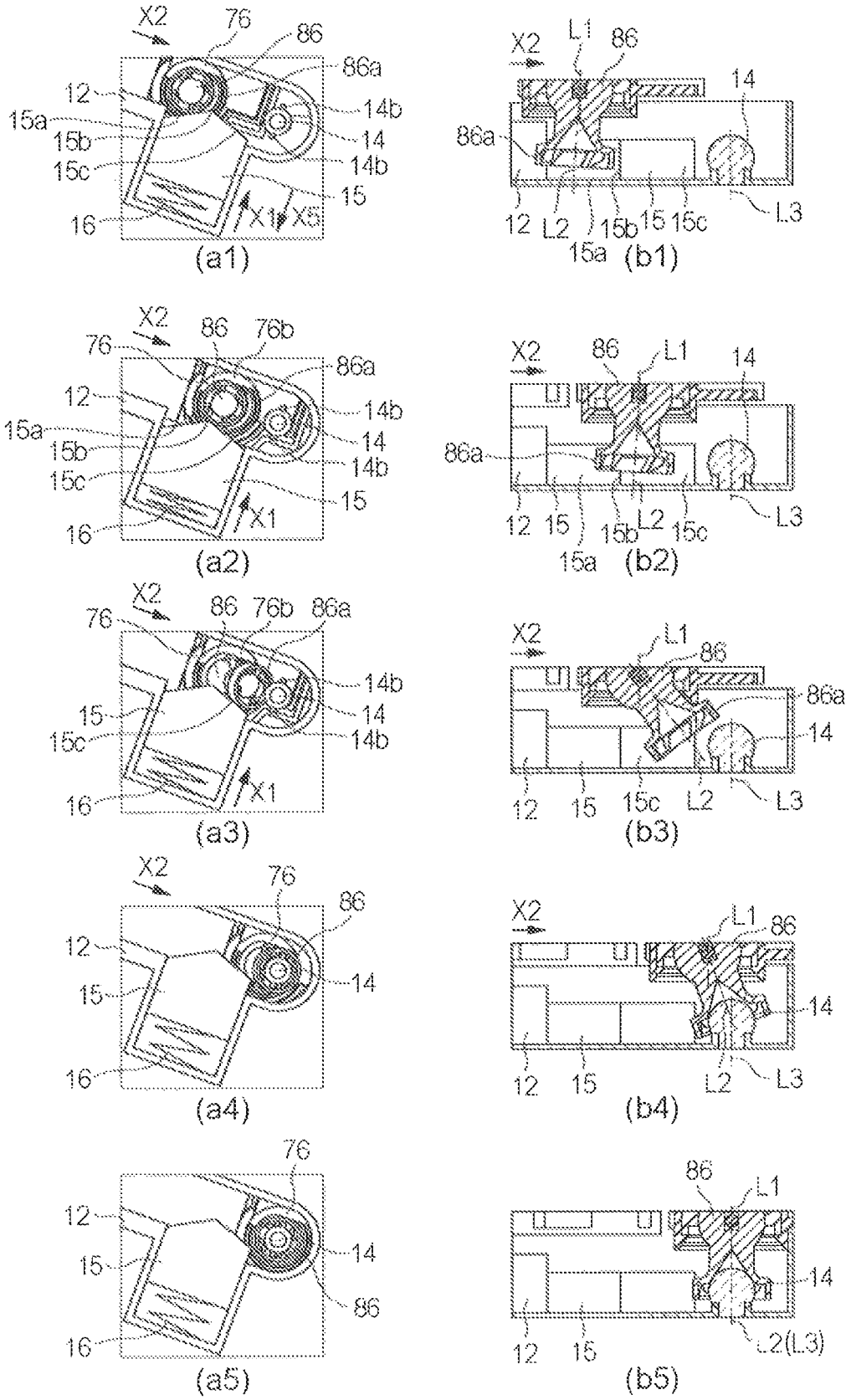
FIG. 6 is an illustration of the mounting and demounting of the process cartridge relative to the main assembly of the electrophotographic image forming apparatus with an inclining (pivoting) motion of the coupling member according to the first embodiment of the present invention.

(3) Description of Mounting and Demounting of Cartridge B:

Referring to FIGS. 5 and 6, mounting and demounting of the cartridge B relative to the main assembly A will be described.

FIG. 5 is a perspective view illustrating the mounting and demounting of the cartridge B to the main assembly A.

FIG. 6 is an illustration of the mounting and demounting of the cartridge B relative to the main assembly A with the inclining (pivoting) motion of the coupling member 86.

An opening and closing door 13 is rotatably mounted to the main assembly A.

FIG. 5 shows a state in which the opening and closing door 13 is open. The inside of the main assembly A is provided with a main assembly side engaging portion 14 as a main assembly side coupling member, a guiding rail 12 and a slider 15.

The guiding rail 12 is a main assembly side guiding member for guiding the cartridge B into the main assembly A.

The main assembly side engaging portion 14 includes a rotational force applying portion 14*b* (FIG. 6). The main assembly side engaging portion 14 is engaged with the coupling 86 to transmit the rotational force to the coupling 86. The main assembly side engaging portion 14 is rotatably supported by the main assembly A. The main assembly side engaging portion 14 it supported by the main assembly A so as not to move in the direction of the rotational axis thereof or in the direction perpendicular to the rotational axis. By this, the structure of the main assembly A can be simplified.

As shown in FIG. 6, the slider 15 is provided with an inclined surface 15*a*, an apex 15*b* and an inclined surface 15*c* and is urged in the direction of X1 by the urging member 16 as a spring.

Referring to FIG. 6, the description will be made as to the mounting and demounting of the cartridge B relative to the main assembly A while the coupling member 86 is inclining (pivoting).

Along the guiding rail 12, the cartridge B is inserted into the main assembly A in the direction of X2 (the direction of X2 is a predetermined direction substantially perpendicular to the rotational axis L3 of the main assembly side engaging portion 14. Then, as shown in (a1) and (b1) of FIG. 6, the slider 15 is retracted in the direction of X5 by the contact between the free end portion 86*a* of the coupling member 86 and the inclined surface 15*a*.

At this time, the position of the coupling member 86 is limited by the contact between the free end portion 86*a* thereof and the bearing member 76 and the slider 15.

With further insertion of the cartridge B in the X2 direction, as shown in (a2) and (b2) of FIG. 6, the free end portion 86*a* of the coupling member 86 Passes by the apex 15*b* and contacts the inclined surface 15*c*.

Then, as shown in (a3) and (b3) of FIG. 6, the slider 15 moves in the direction of X1, and the coupling member 86 inclines (pivots) toward the downstream with respect to the X2, along the guide portion 76*b* of the bearing member 76.

When the cartridge B is further inserted in the direction of X2, the coupling member 86 is brought into contact to the main assembly side engaging portion 14 as shown in (a4) and (b4) of FIG. 6. By this contact, the position of the coupling member 86 is regulated so that the inclination (pivoting) amount of the coupling member 86 gradually decreases.

When the cartridge B it inserted to the mounting completion position, the axis L1 of the drum 62, the axis L2 of the coupling member 86 and the axis of the main assembly side engaging portion 14 are substantially coaxial, as shown in (a5) and (b5) of FIG. 6.

By the engagement between the coupling member 86 and the main assembly side engaging portion 14 in this manner, the transmission of the rotational force is possible.

When the cartridge B is dismounted from the main assembly A, the coupling member 86 inclines (pivots) relative to the axis L1 similarly to the case of the mounting operation, by which the coupling member 86 disengaged from the main assembly side engaging portion 14. More particularly, the cartridge B moves in the direction opposite to the X2 direction (the opposite direction is a predetermined direction substantially perpendicular to the rotational axis L3 of the main assembly side engaging portion 14), so that the coupling member 86 disengages from the main assembly side engaging portion 14.

In this embodiment, the slider 15 is set such that when the cartridge B is in the mounting completion position, there is a space between the slider 15 and the coupling member 86. By doing so, the increase of the rotational load of the coupling member 86 due to the contact to the slider 15 is prevented.

If will suffice if the movement of the cartridge B in the X2 direction or in the direction opposite the X2 direction occurs only adjacent to the mounting completion position, and in the other positions, the cartridge B may move in any direction. That is, what is necessary is that the coupling member 86 moves in the predetermined direction substantially perpendicular to the rotational axis L3 of the main assembly side engaging portion 14 at the time of engagement and disengagement relative to the main assembly side engaging portion 14.

Figure 7:
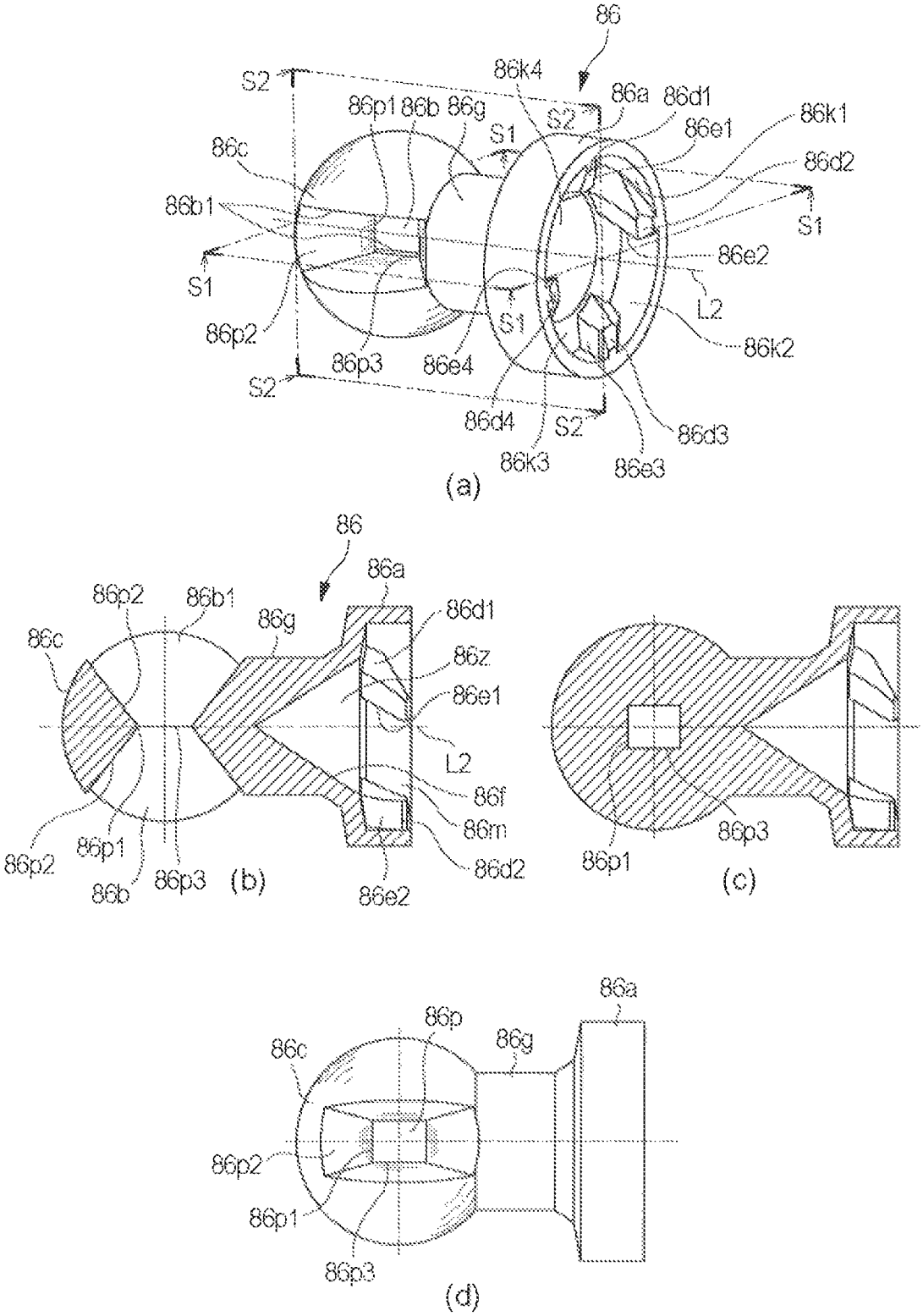
FIG. 7 is a perspective view and a sectional view of the coupling member according to the first embodiment of the present invention.

(4) Description of Coupling Member 86:

Referring to FIG. 7, the coupling member 86 will be described.

Part (a) of FIG. 7 is a perspective view of the coupling member, and part (b) of FIG. 7 is a sectional view taken along a plane S1 of part (a) of the. Part (c) of FIG. 7 is a sectional view taken along a plane S2 of part (a) of FIG. 7. Part (d) of FIG. 7 is a view of the coupling member as seen in the direction perpendicular to the plane S1 of part (a) of FIG. 7.

As shown in FIG. 7, the coupling member 86 mainly comprises three portions.

The first portion is the free end portion 86*a* for engaging with the main assembly side engaging portion 14 to receive the rotational force from the main assembly side engaging portion 14.

The second portion is the substantially spherical connecting portion 86*c*. The connecting portion 86*c* is connected with the driving side flange 87 which is a rotational force transmitted member.

The third portion is a connecting portion 86 *g* between the free end portion 86*a* and the connecting portion 86*c*.

As shown in part (b) of FIG. 7, the free end portion 86*a* includes an opening 86*m* expanding relative to the rotational axis L2 of the coupling member 86. A maximum rotation radius of the free end portion 86*a* is larger than a maximum rotation radius of the connecting portion 86*g*.

The opening 86*m* is provided with a conical shape receiving surface 86*f* as an expanding portion which extends toward the main assembly side engaging portion 14 side in the state that the coupling member 86 is mounted to the main assembly A. The receiving surface 86*f* constitutes a recess 86*z*. The recess 86*z* is provided with the opening 86*m* (opening) at the side opposite from the side having the drum 62 with respect to the direction of the axis L2.

As shown in part (a) of FIG. 7, a plurality of projections 86*d*1-*d*4 are provided at regular intervals on the circumference about the axis L2, at the free end side Of the free end portion 86*a*. Between, adjacent ones of the projections 86*d*1-86*d*4, there are provided standing-by portions 86*k*1-86*k*4. With respect to the radial direction of the coupling member 86, the recess 86*z* is inside the projections 86*d*1-*d*4. With respect to the axial direction of the coupling member 86, the recess 86*z* is inside the projections 86*d*1-*d*4.

The interval between the adjacent ones of the projections 86*d*1-*d*4 is larger than an outer diameter of the rotational force applying portion 14*b* so that the intervals can receive the rotational force applying portions 14*b*.

When the coupling member 86 is waiting for the transmission of the rotational force from the main assembly side engaging portion 14, the rotational force applying portion 14*b* is in one of the standing-by portions 86*k*1-*k*4. Furthermore, rotational force receiving portions 86*e*1-86*e*4 crossing with the rotational moving direction of the coupling member 86 is provided downstream of projections 86*d*1-*d*4 with respect to the X3 direction in part (a) of FIG. 7.

In the state that the coupling member 86 is in engagement with the main assembly side engaging portion 14, and the main assembly side engaging portion 14 rotates, the rotational force applying portions 14*b* are in contact with the pair of the rotational force receiving portions 86*e*1/86*e*3 or the pair of the rotational force receiving portions 86*e*2/86*e*4.

By this, the rotational force is transmitted from the main assembly side engaging portion 14 to the coupling member 86.

In other to stabilize the rotational torque transmitted to the coupling member 86 as much as possible, the rotational force receiving portions 86*e*1-86*e*4 of preferably disposed on the same circumference having the center on the axis L2. By doing so, the rotational force transmission radius is constant, and therefore, the rotational torque transmitted to the coupling member 86 is stabilized.

In order to stabilize the position of the coupling member 86 as much as possible when it receives the rotational force, it is desirable to position the rotational force receiving portions 86*e*1 and 86*e*3 at diametrically opposite positions and to position the rotational force receiving portions 86*e*2 and 86*e*4 at diametrically opposite positions (180° opposing).

The number of the projections 86*d*1-*d*4 is four in this embodiment, but the number may be changed properly provided that the rotational force applying portion 14*b* can enter the standing-by portions 86*k*1-86*k*4 as described hereinbefore. This, the cases of two projections 86*d* and six projections are within this embodiment.

In addition, the rotational force receiving portions 86*e*1-86*e*4 may be provided inside the driving shaft receiving surface 86*f*. Or, the rotational force receiving portions 86*e*1-86*e*4 provided at the positions outside the driving shaft receiving surface 86*f* with respect to the direction of the axis L2. The rotational force receiving portions 86*e*1-86*e*4 are disclosed at positions remoter from the maximum rotation radius of the connecting portion 86 *g* than the axis L2.

As shown in FIG. 7, the connecting portion 86*c* has a spherical having a center substantially on the axis L2. The maximum rotation radius of the connecting portion 86*c* is larger than that maximum rotation radius of the connecting portion 86*g*.

The connecting portion 86*c* is provided with a hole portion 86*b* which is are through hole penetrating in the direction perpendicular to the axis L2. The hole portion 86*b* is open in the direction substantially perpendicular to the axis L2. A pin 88 penetrates the hole portion 86*b*. There is provided a play between the hole portion 86*b* and the pin 88 to such an extent that the pivoting of the coupling member 86 is permitted. A cross-sectional area of the hole portion 86*b* is minimum adjacent the center of the connecting portion 86*c* (neighborhood of the axis L2). It expands as the distance from the rotation axis of the connecting portion 86*c* increases. With such a structure, the coupling member 86 is capable of inclining (pivoting) relative to the driving side flange 87 in any direction. Inside the hole portion 86*b* (inner wall), there are provided a rotational force transmitting portion 86*b*1 extending in the direction crossing with the rotational moving direction of the coupling member 86, the first disengagement preventing portion 86*p*1, a second disengagement preventing portion 86*p*2 and a third disengagement preventing portion 86*p*3 which are a disengagement preventing portion. Here, the first disengagement preventing portion 86*p*1 and the third disengagement preventing portion 86*p*3 are closest to the rotation axis of the hole portion 86*b*. The first disengagement preventing portion 86*p*1 (the portion adjacent the axis L2) contacts the pin 88 in the state that the axis L2 and the axis L1 are aligned with each other. The second disengagement preventing portion 86*p*2 is a substantially flat surface extending outwardly of the connecting portion 86*c* from the first disengagement preventing portion 86*p*1. By the pin 88 contacting the first disengagement preventing portion 86*p*1, the disengagement of the coupling member 86 is prevented. However, when the coupling member 86 inclines (pivots), the second disengagement preventing portion 86*p*2 and/or the third disengagement preventing portion 86*p*3 prevents the disengagement by being contacted by the pin 88. Alternatively, the structure may be such that the second disengagement preventing portion 86*p*2 and/or the third disengagement preventing portion 86*p*3 does not contact the pin 88, and the disengagement of the coupling member 86 is prevented only by the first disengagement preventing portion 86*p*1. As shown in FIG. 7, the connecting portion 86 *g* has a cylindrical (or circular column) shape connecting the free end portion 86*a* and the connecting portion 86*c* and extending substantially along the axis L2.

In order to suppress twisting of the coupling member 86 by the rotational load, thus improving the rotation transmission accuracy, it is desirable that the connecting portion 86 *g* is made short and thick.

The material of the coupling member 86 in this embodiment is resin material such as polyacetal, polycarbonate, PPS or the like. However, in order to increase the stiffness of the coupling member 86, glass fibers, carbon fibers or the like may be added into the resin material, depending on the load torque. In such a case, the stiffness of the coupling member 86 can be enhanced. In addition, a metal material may be inserted into the resin material, or the entirety of the coupling 86 may be made by metal or the like.

The free end portion 86*a*, the connecting portion 86*c* and the connecting portion 86 *g* may be integrally molded or may be manufactured by connecting separate parts. In this embodiment, it is integrally molded by a resin material. By doing so, the easiness in the manufacturing of the coupling member 86 and the accuracy as the part are enhanced.

Figure 8:
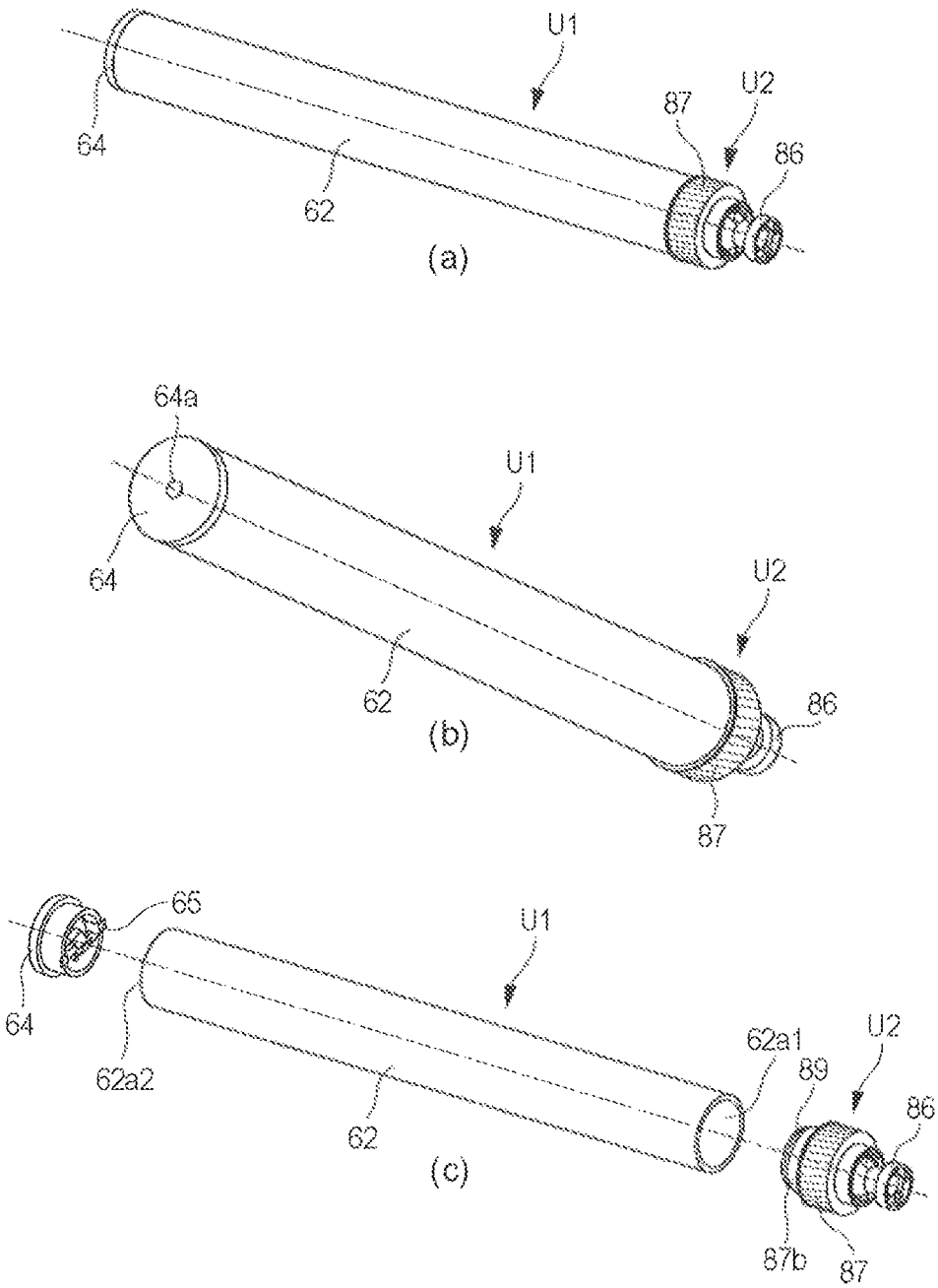
FIG. 8 is an illustration of an electrophotographic photosensitive drum unit according to the first embodiment of the present invention.
Figure 9:
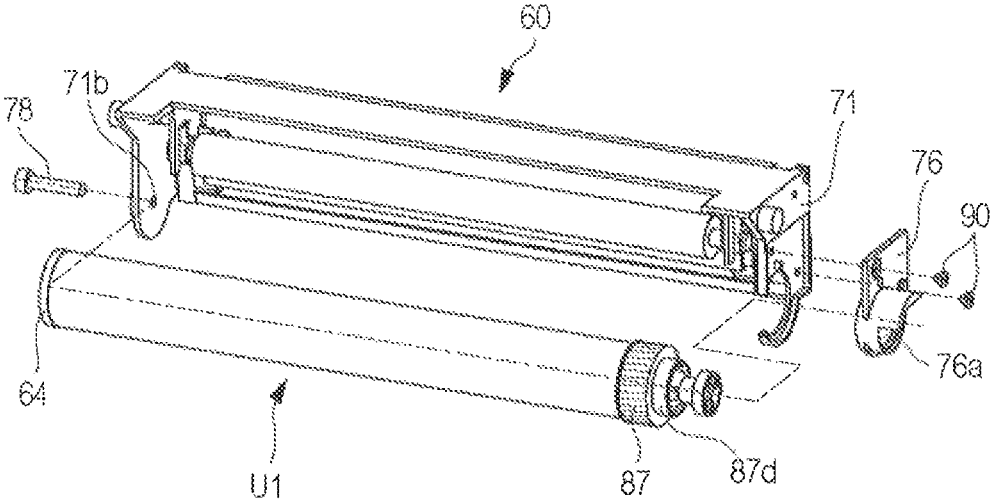
FIG. 9 is an illustration of assembling of the electrophotographic photosensitive drum unit into a cleaning unit, according to the first embodiment of the present invention.

(5) Description of the Structure of Electrophotographic Photosensitive Drum Unit U1:

Referring to FIGS. 8 and 9, the description will be made as to the structure of the electrophotographic photosensitive drum unit U1 (drum unit U1).

FIG. 8 is an illustration of the structure of the drum unit U1, in which part (a) is a perspective view as seen from the driving side, part (b) is a perspective view as seen from the non-driving side, and part (c) is an exploded perspective view.

FIG. 9 is an illustration of assembling of the drum unit U1 into a cleaning unit 60.

As shown in FIG. 8, the drum unit U1 comprises the drum 62, a driving side flange unit U2, a non-driving side flange 64 and a grounding plate 65.

The drum 62 includes an electroconductive member of aluminum or the like coated with a surface photosensitive layer. The drum 62 may be hollow or solid.

The driving side flange unit U2 is at the driving side end portion of the drum 62. More specifically, as shown in part (c) of FIG. 8, in the driving side flange unit U2, a fixed portion 87*b* of the driving side flange 87 which is the rotational force transmitted member is engaged with the opening 62*a*1 at the end portion of the drum 62 and is fixed to the drum 62 by bonding and/or clamping or the like. Wherein the driving side flange 87 rotates, the drum 62 integrally rotates, too. The driving side flange 87 is fixed to the drum 62 so that a rotational axis as a flange axis of the driving side flange 87 is substantially coaxial with the axis L1 of the drum 62.

Here, the "substantially co-axial" covers the case in which they are completely aligned and the case in which they are slightly deviated due to the manufacturing tolerances of the parts. This applies to the following description, too.

Similarly, the non-driving side flange 64 is substantially coaxial with the drum 62 and is provided at the non-driving side end portion of the drum 62. The non-driving side flange 64 is made of resin material, and as shown in part (c) of FIG. 8, it is fixed to the opening 62*a*2 of the end portion of the drum 62 by bonding and/or clamping. The non-driving side flange 64 is provided with an electroconductive (mainly metal) grounding plate 65 to electrically ground the drum 62. The grounding plate 65 contacts the inner surface of the drum 62 to the electrically connect with the main assembly A.

As shown in FIG. 9, the drum unit U1 is supported by the cleaning unit 60.

In the driving side of the drum unit U1, the portion-to-be-supported 87*d* of the driving side flange 87 is rotatably supported by the supporting portion 76*a* of the bearing member 76 as a supporting member.

The bearing member 76 is fixed to the cleaning frame 71 by a screw 90. On the other hand, in the non-driving side of the drum unit U1, the bearing 64*a* (part (b) of FIG. 8) of the non-driving side flange 64 is rotatably supported by the drum shaft 78. The drum shaft 78 is fixed to the supporting portion 71*b* provided in the non-driving side of the cleaning frame 71 by press-fitting.

In this embodiment, the bearing member 76 is fixed the cleaning frame 71 by the screw 90, but bonding or welding using melted resin material is usable.

The cleaning frame 71 and the bearing member 76 may be made integral with each other. In such a case, the number of parts can be reduced by one.

Figure 10:
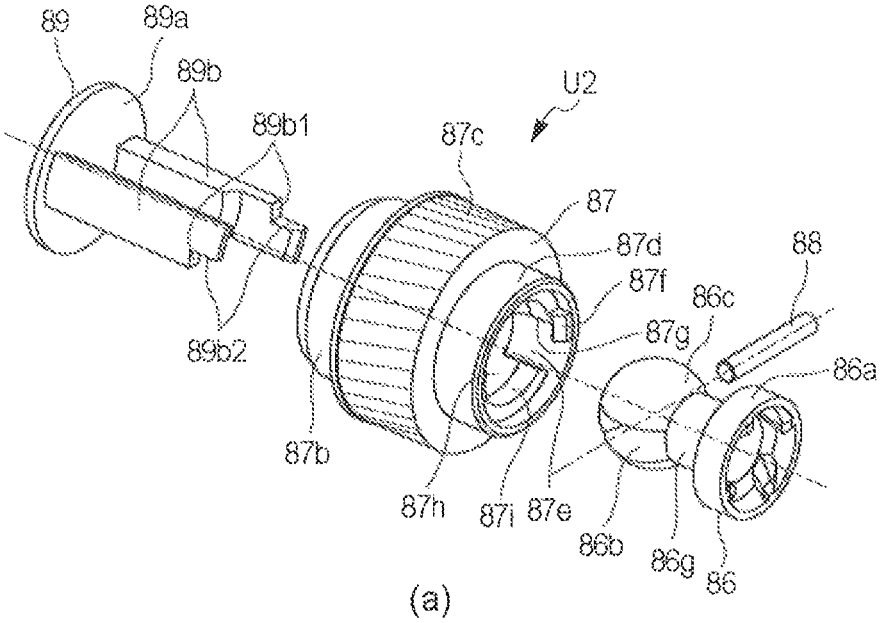
FIG. 10 is an exploded perspective view of a driving side flange unit according to a first embodiment of the present invention.
Figure 10:
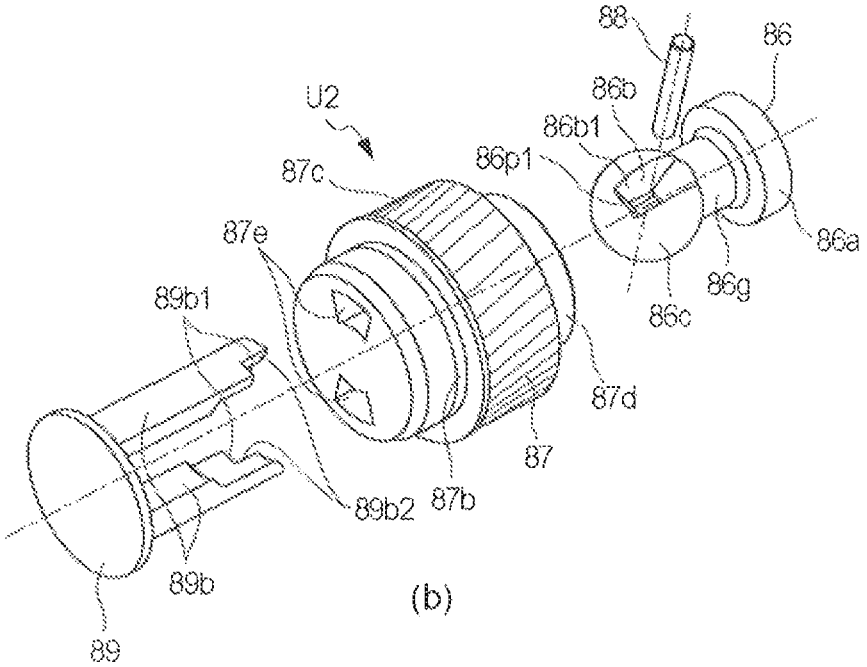
Figure 11:
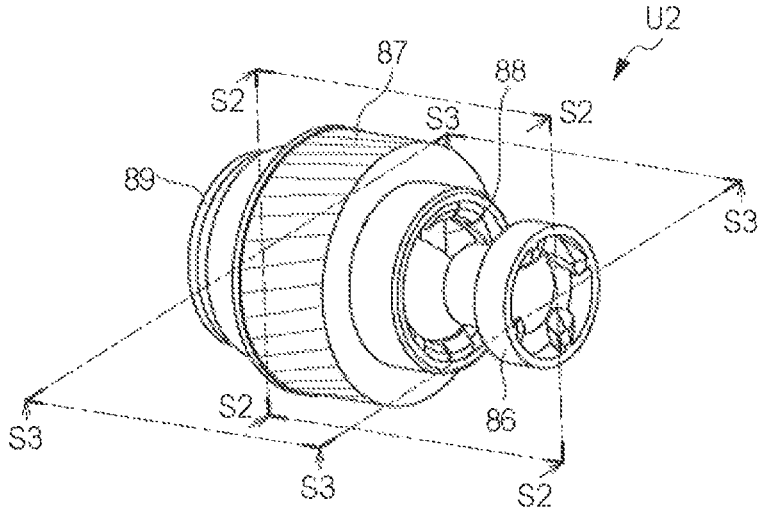
FIG. 11 is an illustration of a structure of the driving side flange unit according to the first embodiment of the present invention.
Figure 11:
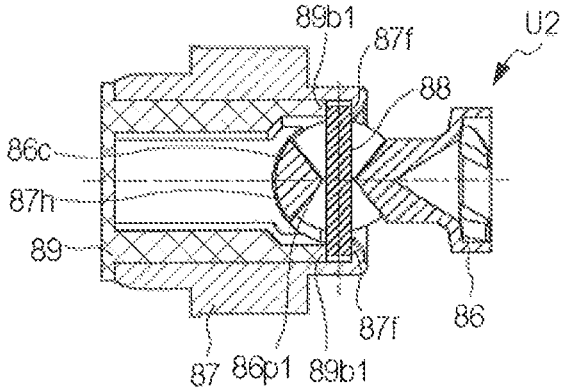
Figure 11:
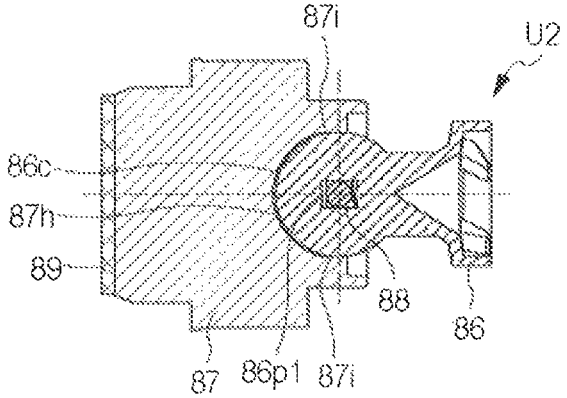

(6) Description of Driving Side Flange Unit U2:

Referring to FIGS. 10, 11, the structure of the driving side flange unit U2 will be described.

FIG. 10 is an exported perspective view of the driving side flange unit U2, in which part (a) is a view as seen from the driving side, and part (b) is a view as seen from the non-driving side.

FIG. 11 illustrates the structure of the driving side flange unit U2, in which part (a) is a perspective view of the driving side flange unit U2, part (b) is a sectional view taken along a plane S2 of part (a), and part (c) is a sectional view taken along a plane S3 of part (a).

Figure 12:
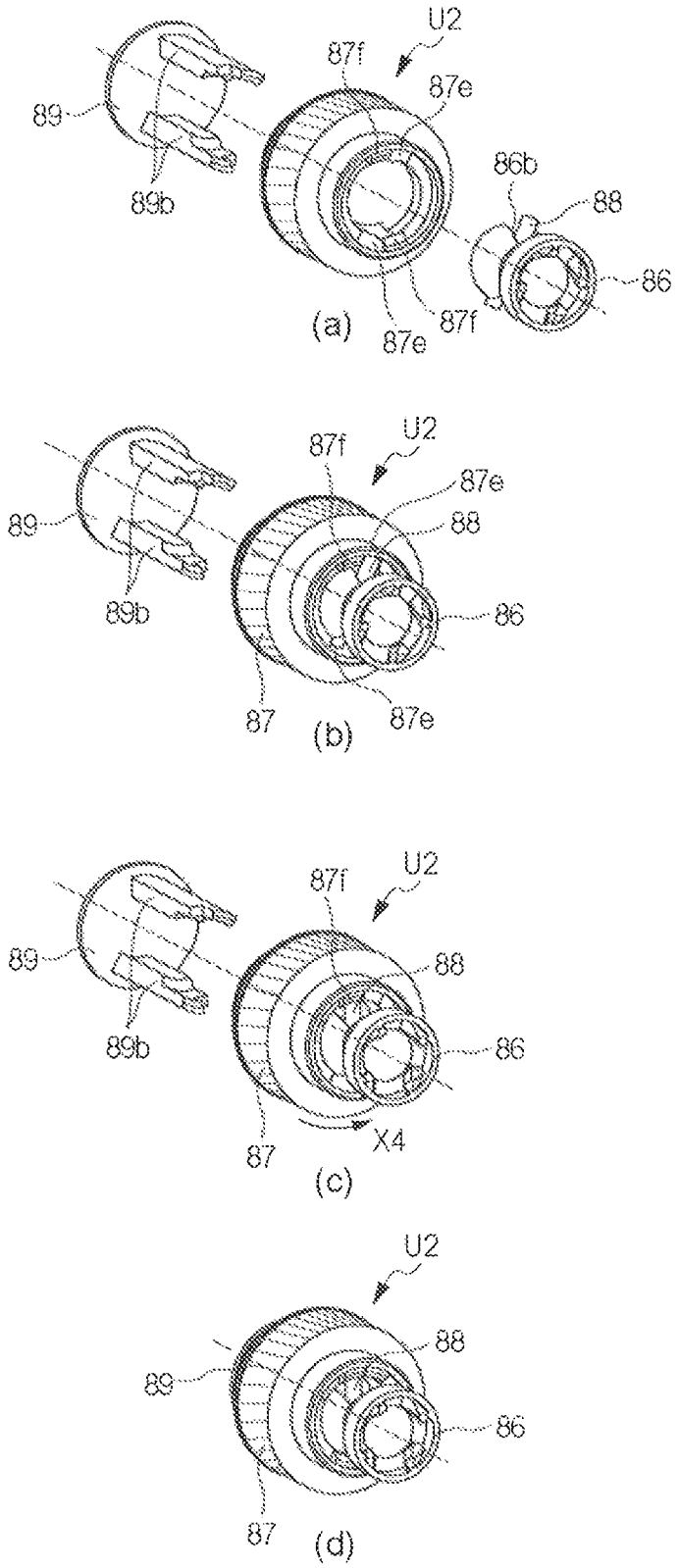
FIG. 12 is an illustration of an assembling method of the driving side flange unit according to the first embodiment of the present invention.

FIG. 12 is an illustration of an assembling method of the driving side flange unit U2.

As shown in FIGS. 10, 11, the driving side flange unit U2 comprises the coupling member 86, the pin 88, the driving side flange 87 and the regulating member 89. The coupling member 86 is engaged with the main assembly side engaging portion 14 to receive the rotational force. The pin 88 is a circular column or cylindrical shaft portion and extends in the direction substantially perpendicular to the axis L1. The pin 88 receives the rotational force from the coupling member 86 to transmit the rotational force to the driving side flange 87. In addition, the driving side flange 87 receives the rotational force from the pin 88 to transmit the rotational force to the drum 62. The regulating member 89 regulates so as to prevent disengagement of the pin 88 from the driving side flange 87.

Referring to FIG. 10, each constituent element will be described.

The coupling member 86 includes the free end portion 86*a* and the connecting portion 86*c* as described hereinbefore. The connecting portion 86*c* is provided with a hole portion 86*b* as a through-hole, and the (inside or inner wall) of the hole portion 86*b* defines the rotational force transmitting portion 86*b*1 for transmitting the rotational force to the pin 88, and the first disengagement preventing portion 86*p*1 contactable to the pin 88 to prevent the disengagement of the coupling member 86 from the driving side flange 87.

The driving side flange 87 comprises a fixed portion 87*b*, an accommodating portion 87*i*, a gear portion (helical gear or spur gear) 87*c* and a portion-to-be-supported 87*d*. The fixed portion 87*b* is a portion fixed to the drum 62. The accommodating portion 87*i* is provided inside the driving side flange 87. The accommodating portion 87*i* accommodates at least a part of the connecting portion 86*c* of the coupling member 87. In this embodiment, the pin 88 is disposed inside the accommodating portion 87*i*. The gear portion 87*c* functions to transmit the rotational force to the developing roller 32. The portion-to-be-supported 87*d* it supported by the supporting portion 76*a* of the bearing member 76. These members are disposed coaxially with the rotational axis L1 of the drum 62.

The driving side flange 87 is provided with couple hole portions 87*e* extending in the direction of the axis L1 at approx. 180° phase offset positions about the axis L as seen along the rotational axis L1. In other words, the hole portions 87*e* extend in parallel with axis L1 at the opposite sides with respect to the axis L1. In addition, the driving side flange 87 is provided with a pair of retaining portions 87*f* projecting in the direction crossing with the axis L1 and covering at least a part of the hole portions 87*e* as seen from the accommodating portion 87*i* side along the axis L1. The driving side flange 87 is provided with a pair of rotational force transmitted portions 87 *g* for receiving the rotational force from the pin 88 which will be described hereinafter, the rotational force transmitted portions 87 *g* being disposed behind the retaining portion 87*f* as seen from the accommodating portion 87*i* side along the axis L1.

Further, the driving side flange 87 is provided with a longitudinal direction regulating portion 87*h* for preventing movement of the coupling member 86 toward the non-driving side (longitudinally inward of the drum 62).

In this embodiment, the driving side flange 87 is of resin material molded by injection molding, and the material is polyacetal, polycarbonate or the like. However, the driving side flange 87 may be made of metal in consideration of the load torque required to rotate the drum 62.

In this embodiment, the driving side flange 87 is provided with a gear portion 87*c* for transmitting the rotational force to the developing roller 32. However, the rotation of the developing roller 32 is not necessary made through the driving side flange 87. In such a case, the gear portion 87*c* may be omitted. However, when the driving side flange 87 is provided with the gear portion 87*c*, as with this embodiment, the gear portion 87*c* can be integrally molded with the driving side flange 87.

The regulating member 89 includes a disk configuration base portion 89*a*, and a pair of projected portions 89*b* which are disposed at 180° phase offset position about the axis of the base portion and projecting substantially in parallel with the axis L1 from the base portion 89*a*. The regulating member 89 (a pair of the projected portions 89*b*) is inserted into the driving side flange in the direction along the axis L1 from the driven side toward the driving side.

Each of the projected portions 89*b* is provided with a longitudinal direction regulating portion 89*b*1 and a rotation regulating portion 89*b*2.

Referring to FIG. 11, the supporting method and the connecting method of the constituent elements will be described.

The pin 88 is limited in the position in the longitudinal direction (axis L1) of the drum 62 by the retaining portion 87*f* and the longitudinal direction regulating portion 89*b*1 in this limited in the position with respect to the rotational moving direction of the drum 62 by the rotational force transmitted portion 87 *g* and the rotation regulating portion 89*b*2. By doing so, the pin 88 is supported (held) by the driving side flange 87 and the regulating member 89. In other words, the opposite ends of the pin 88 are held by the free ends of the projected portions 89*b*, the retaining portions 87*f* and the rotational force transmitted portions 87*g*.

The coupling member 86 is limited in the movement in the direction perpendicular to the axis L1 of the driving side flange 87 by the connecting portion 86*c* contacting the accommodating portion 87*i*. By the contact of the connecting portion 86*c* to the longitudinal direction regulating portion 87*h*, the movement from the driving side toward the non-driving side is limited. By the contact between the first disengagement preventing portion 86*p*1 and the pin 88, the movement of the coupling member 86 from the non-driving side toward the driving side is limited. In this manner, the coupling member 86 is connected with the driving side flange 87 and the pin 88.

Referring to FIG. 12, the assembling method for the driving side flange unit U2 will be described.

As shown in part (a) of FIG. 12, the pin 88 is inserted into the hole portion 86*b* which is a through-hole of coupling member 86.

Next, as shown in part (b) of FIG. 12, the opposite end portions of the pin 88 are inserted into the hole portions 87*e* of the driving side flange 87 (along the axis L1).

Thereafter, as shown in part (c) of FIG. 12, the coupling member 86 and the pin 88 are rotated about the axis L of the driving side flange 87 (X4 direction), by which the opposite end portions of the pin 88 are moved to behind the retaining portions 87*f*.

As shown in part (d) of FIG. 12, the projected portions 89*b* of the regulating member 89 an inserted into the respective hole portion 87*e*, and in the state, the regulating member 89 is welded or bonded to the driving side flange 87.

(7) Description of Inclining (Pivoting) Motion of the Coupling Member 86:

Referring to FIG. 1, the inclining (pivoting) motion of the coupling member 86 will be described.

FIG. 1 is an illustration of the inclination (pivoting) of the coupling member 86 (including the axis L2) relative to the axis L1. In FIG. 1, (a1) and (a2) is a perspective view of the coupling member 86 in the inclined (pivoted) state, (b1) is a sectional view taken along a plane S4 of (a1), and (b2) is a sectional view taken along a plane S5 of (a2).

Referring to FIG. 1, the inclination (pivoting) of the coupling member 86 about the center of the connecting portion 86*c* will be described.

As shown in (a1) and (b1) of FIG. 1, the coupling member 86 is inclinable (pivotable) about the center of the spherical shape of the connecting portion 86*c* and the axis of the pin 88 relative to the axis L1 until the free end portion 86*a* contacts to the rotation regulating portion 76*c* of the bearing member 76.

In addition, as shown in (a2) (b2) of FIG. 1, the coupling member 86 is inclinable (pivotable) about the center of the spherical shape of the connecting portion 86*c* and an axis perpendicular to the axis of the pin 88 until the free end portion 86*a* contacts to the rotation regulating portion 76*c* of the bearing member 76.

Furthermore, by combining the inclination (pivoting) about the axis of the pin 88 and the inclination (pivoting) about the shaft perpendicular to the axis of pin 88, the coupling member 86 is inclinable (pivotable) in a direction different from the above-described directions.

In this manner, the coupling member 86 is capable of inclining (pivoting) substantially in all directions relative to the axis L1. In this manner, the coupling member 86 is capable of inclining (pivoting) in any direction relative to the axis L1. Furthermore, the coupling member 86 is swingable in any direction relative to the axis L1. Moreover, the coupling member 86 is capable of whirling relative to the axis L1 substantially in all directions. Here, the whirling of the coupling member 86 is in the rotation of the inclined (pivoted) axis L2 about the axis L1.

Figure 13:
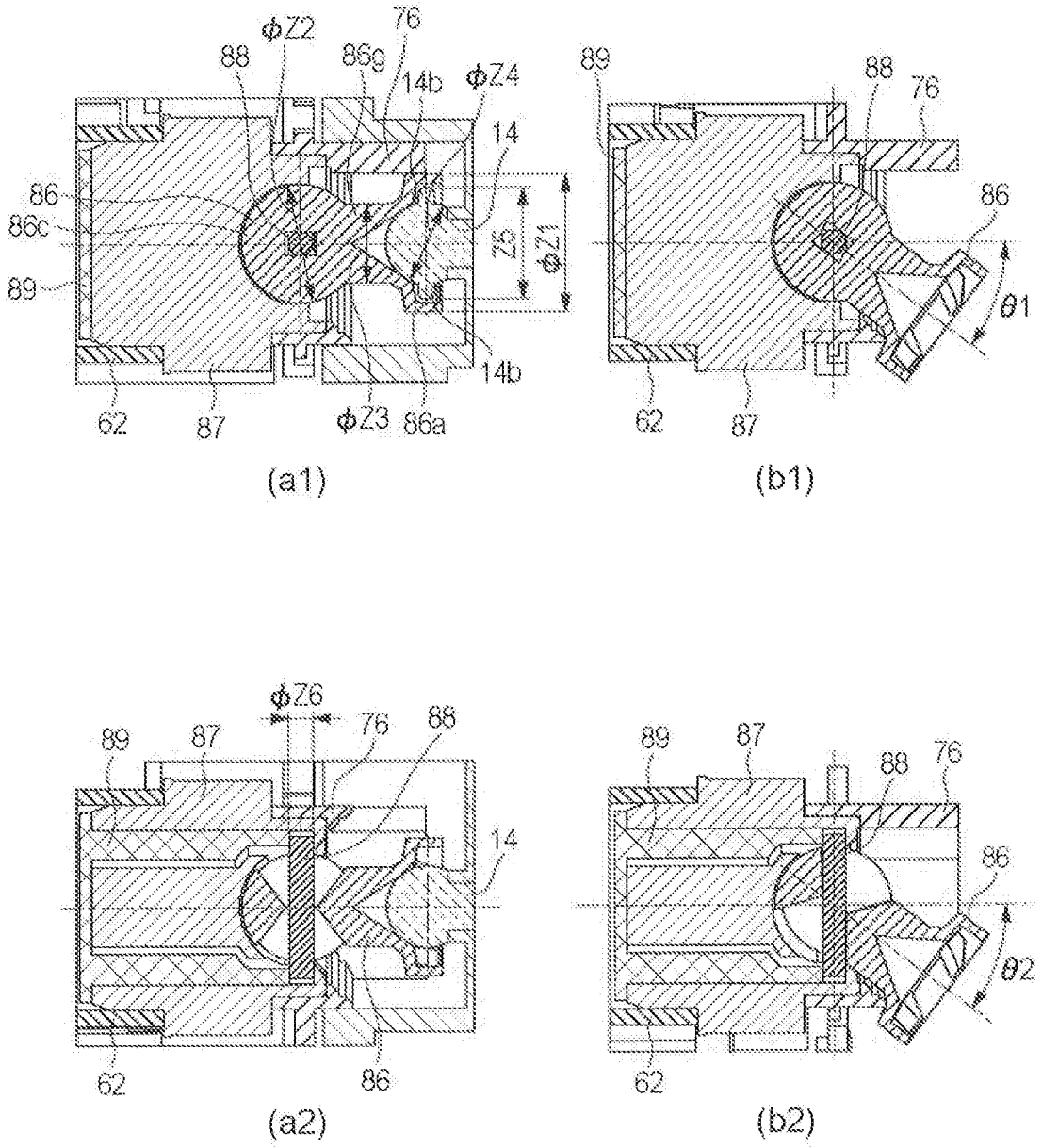
FIG. 13 is an illustration of an example of dimensions in the first embodiment of the present invention.

Referring to FIG. 13, examples of the dimensions of the parts in this embodiment As shown in (a1) of FIG. 13, the diameter of the free end portion 86*a* is φZ1, the sphere diameter of the connecting portion 86*c* is φZ2, the diameter of connecting portion 86 *g* is φZ3.

In addition, the diameter of the spherical of the free end of the main assembly side engaging portion 14 is φZ4, the length of the rotational force applying portion 14*b* is Z5.

As shown in (a2) of FIG. 13, the diameter of the pin 88 is φZ6.

As shown in (b1) and (b2) of FIG. 13, an inclinable (pivotable) angle of the coupling member 86 about the axis of the pin 88 is θ1, an inclinable (pivotable) angle about the shaft perpendicular to the axis of the pin 88 is θ2.

Then, φZ1=φ17.4 mm, φZ2=φ15 mm, φZ3=φ10 mm, φZ4=φ10.35 mm, Z5=14.1 mm, φZ6=φ3 mm, θ1=θ2=36.8°, for example.

It has been confirmed with these dimensions that the coupling member 86 can engaged with the main assembly side engaging portion 14. It has also been confirmed that the coupling member 86 can disengaged from the main assembly side engaging portion 14.

These dimensions are examples, and have the dimensions are usable to effect the same motions, and therefore, the present invention is not limited to these dimensions.

As has been described in the foregoing and as shown in FIG. 1, in this embodiment, The pin 88 is limited in the position in the longitudinal direction by the retaining portion 87*f* and the longitudinal direction regulating portion 89*b*1, in this limited in the position in the rotational moving direction by the rotational force transmitted portion 87 *g* and the rotation regulating portion 89*b*2 (FIG. 10), and it supported by the driving side flange 87 and the regulating member 89.

In addition, the movement of the coupling member 86 is limited in the direction perpendicular to the axis of the driving side flange 87 by the contact between the connecting portion 86*c* and the accommodating portion 87*i*. In addition, the movement of the coupling member 86 is limited in the direction from the driving side toward the non-driving side by the contact between the connecting portion 86*c* and the longitudinal direction regulating portion 87*h*. Furthermore, by the contact between the first disengagement preventing portion 86*p*1 and the pin 88, the movement of the coupling member 86 is limited in the direction from the non-driving side toward the driving side.

In this manner, the coupling member 86 is connected with the driving side flange 87 and the pin 88.

By doing so, the coupling member 86 is prevented from disengaging from the driving side flange 87 without limiting the inclinable (pivotable) angle range of the coupling member 86 by the inner edge of the opening of the rotational force transmitted member 86.

With the structure of this embodiment, the configuration of the driving side flange 87 provides a relief for the connecting portion 86 *g* of the coupling member 86 in the inclined (pivoted) state. Therefore, the inclinable (pivotable) angle range of the coupling 86 can be increased as compared with a conventional structure, and the design latitude is enhanced.

In addition, because the inclinable (pivotable) angular range of the coupling member 86 can be increased, the length of the connecting portion 86 *g* measured in the direction of the axis L2 can be reduced. By this, the rigidity or stiffness of the coupling member 86 is enhanced, and therefore, the twisting thereof is suppressed so that the rotation transmission accuracy is enhanced.

In place of increasing the inclinable (pivotable) angle range of the coupling member 86, the connecting portion 86 *g* can be made thicker by the corresponding amount. Also in such a case, the rigid of the coupling member 86 is high, and therefore, the twisting can be suppressed, and the rotation transmission accuracy is enhanced.

In the foregoing description, the function, the material, the configuration, the relative positions of the constituent elements of this embodiment are not restrictive to the present invention.

Embodiment 2

Embodiment 2 of the present invention will be described in conjunction with the drawings.

With respect to this embodiment, the portions different from the foregoing embodiment will be described in detail. The material, the configuration and so on in this embodiment are the same as in the foregoing embodiment, unless otherwise described. With respect to the common structures, the same reference numerals and characters are assigned, and the detailed description thereof are omitted.

In this embodiment, the structure for connecting the coupling member 86 with the driving side flange 287 and the pin 88 is similar to that in Embodiment 1.

On the other hand, in this embodiment, the regulating member 89 is not employed, but the pin 88 is supported only by the driving side flange 287.

Figure 14:
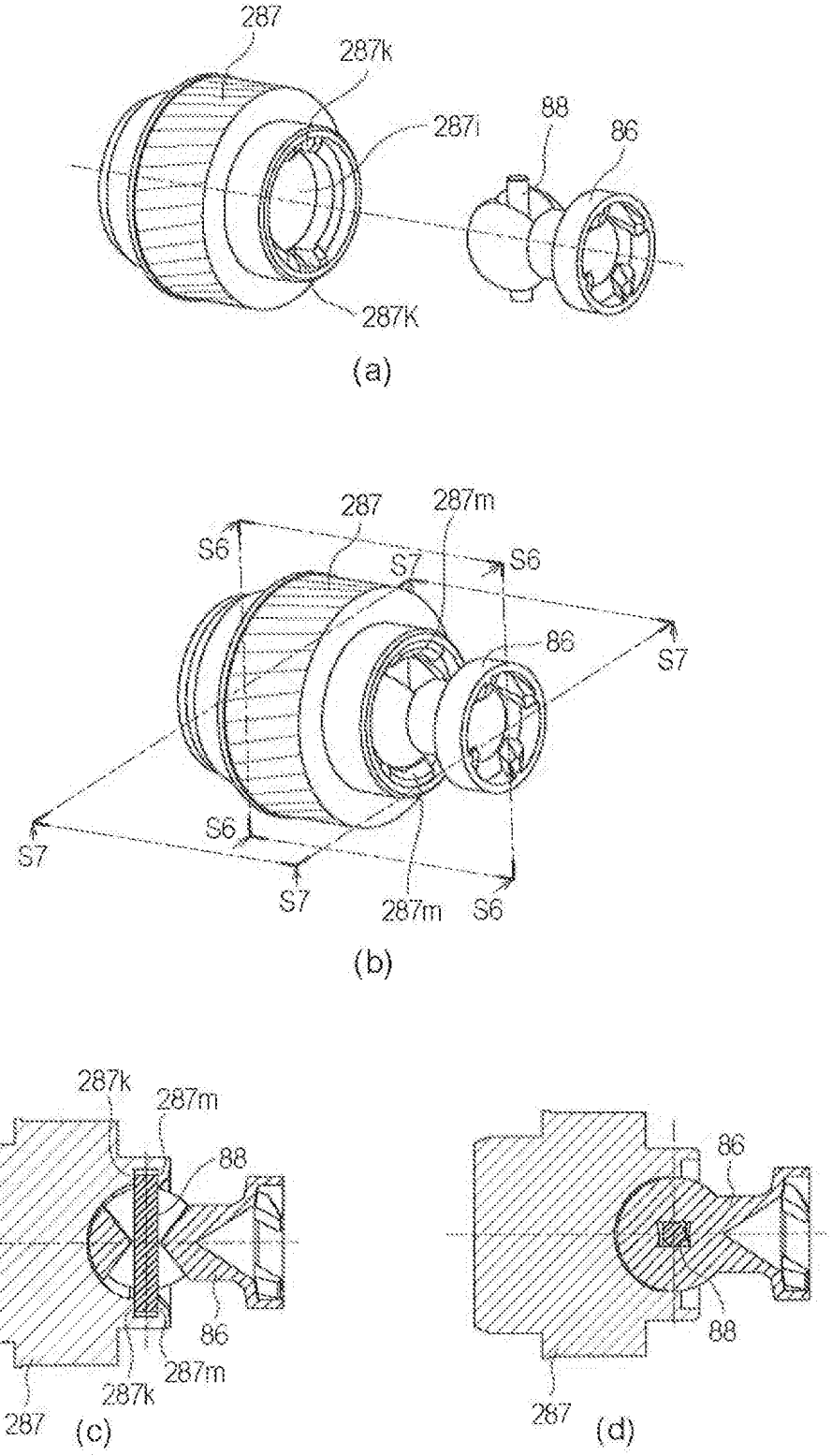
FIG. 14 is an illustration of a structure of a driving side flange unit according to a second embodiment of the present invention.

Referring to FIG. 14, the structure of supporting of the pin 88 by the driving side flange 287 will be described.

Part (a) of FIG. 14 is a perspective view in the state before the coupling 86 and the pin 88 are assembled to the driving side flange 287.

Part (b) of FIG. 14 is a perspective view of the driving side flange unit after the assembling, part (c) of FIG. 14 is a sectional view taken along a plane S6 of part (b) of FIG. 14, and part (d) of FIG. 14 is a sectional view taken along a plane S7 of part (b) of FIG. 14.

As shown in part (a) of FIG. 14, the driving side flange 287 is provided with a pair of recesses 287*k* which are disposed with 180° phase difference about the rotational axis thereof. In other words, the recesses 287*k* are recessed at the position across the axis L1 from each other in the direction toward the drum 62 from the accommodating portion 287*i* side.

In the state that the pin 88 is in the hole portion 86*b* of the coupling member 86, the opposite end portions of the pin 88 are inserted into the recesses 287*k*, and are fixed to the entrance of the recess 287*k* by heat clamping and/or injection of resin material or the like to establish a retaining portion 287*m* (part (b) of FIG. 14).

By this, as shown in parts (b), (c) and (d) of FIG. 14, the pin 88 is limited in the position thereof by the recess 287*k* and the retaining portion 287*m*, and is thus supported by the driving side flange 287.

As described above, in this embodiment, the pin 88 it supported only by the driving side flange 287 without using the regulating member 89. This embodiment is effective to reduce the number of parts and therefore to reduce the cost.

Embodiment 3

Embodiment 3 of the present invention will be described in conjunction with the drawings.

With respect to this embodiment, the portions different from the foregoing embodiment will be described in detail. The material, the configuration and so on in this embodiment are the same as in the foregoing embodiment, unless otherwise described. With respect to the common structures, the same reference numerals and characters are assigned, and the detailed description thereof are omitted.

In this embodiment, similarly to the foregoing embodiments, the coupling member is inclinable (pivotable) substantially in all directions relative to the rotational axis L1 Of the drum 62.

This embodiment is different from the foregoing embodiments in that the configuration of the coupling member and the sphere center of the connecting portion of the coupling member are movable in the direction of the rotational axis L1 of the drum 62, and the maximum outside diameter circumference of the connecting portion is movable from the inside toward the outside of the accommodating portion 87*i* of the driving side flange.

Figure 15:
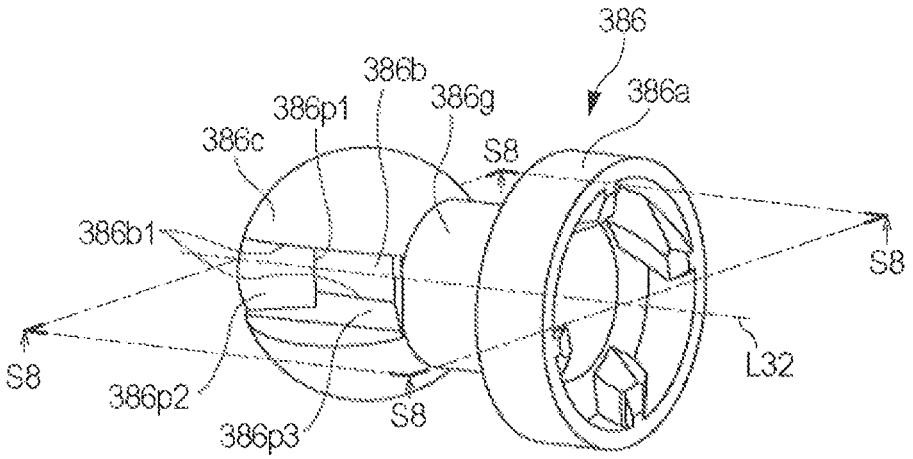
FIG. 15 is a perspective view and a sectional view of a coupling member according to a third embodiment of the present invention.
Figure 15:
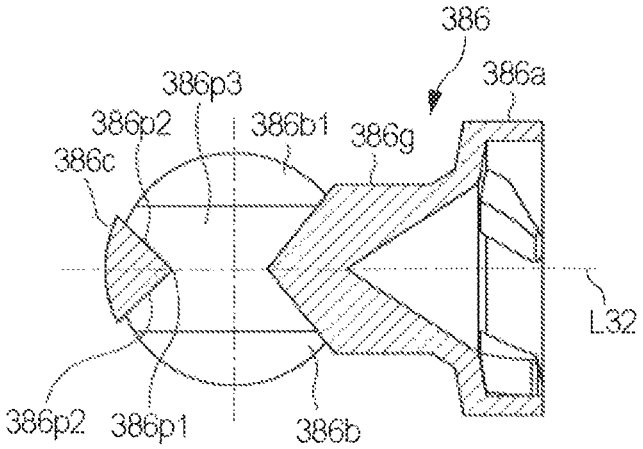

Referring to FIG. 15, the configuration of the coupling member 386 of this embodiment will be described.

Part (a) of FIG. 15 is a perspective view of the coupling member, and part (b) of FIG. 15 is a sectional view taken along a plane S1 of part (a) of the.

As shown in part (b) of FIG. 15, the coupling member 386 of this embodiment is provided with a first disengagement preventing portion 386*p*1 and a second disengagement preventing portion 386*p*2 at positions remoter from the free end portion 386*a* than in the foregoing embodiments.

In addition, as shown in part (a) of FIG. 15, a third disengagement preventing portion 386*p*3 is substantially a flat surface, and is positioned more distant from the center of the connecting portion 386*c* than in the foregoing embodiments.

Figure 16:
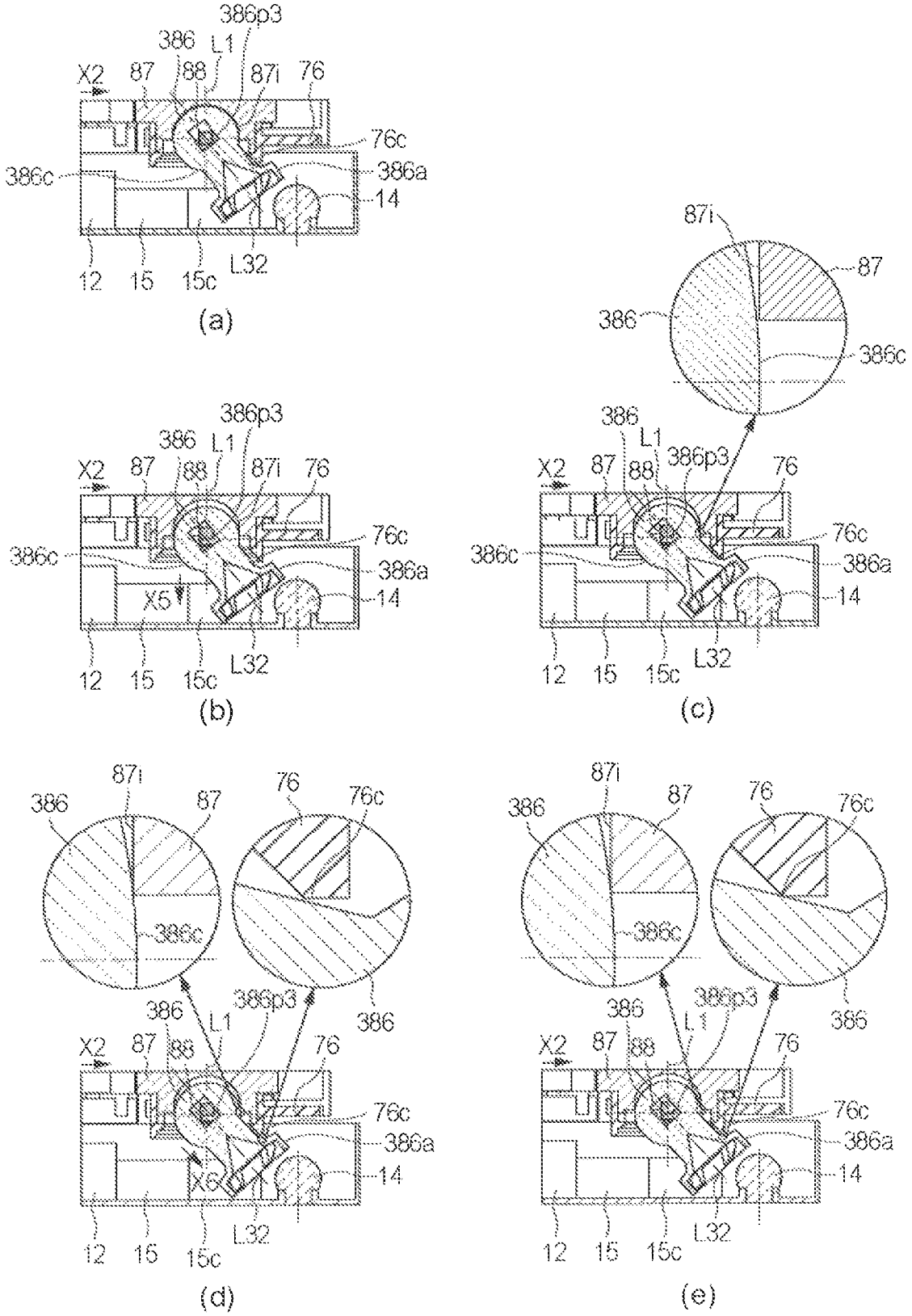
FIG. 16 illustrates a state in which the coupling member is inclined (pivoted) about an axis of the pin in the third embodiment of the present invention.
Figure 17:
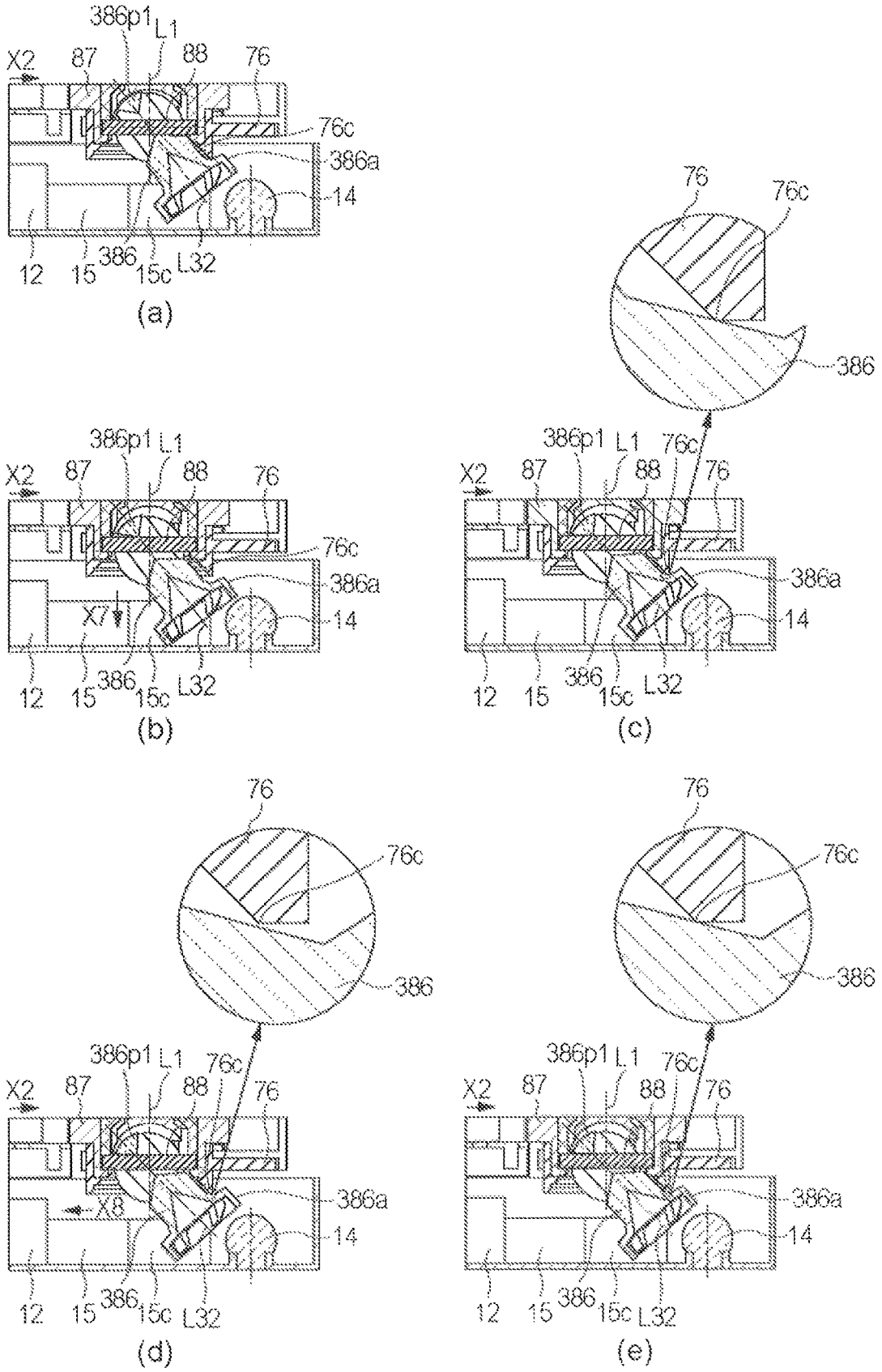
FIG. 17 illustrates a state in which the coupling member is inclined (pivoted) about an axis perpendicular to the axis of pin, in the third embodiment.

Referring to FIGS. 16 and 17, the description will be made as to the motion in which the coupling member 386 inclines (pivots) relative to the axis L1 while the maximum outside circumference of the connecting portion 386*c* is projecting (disengaging) from the accommodating portion 87*i*, and the coupling member 386 is moving in the direction of the axis L1.

FIG. 16 shows a state in which the coupling member 386 is inclined (pivoted) about the axis of the pin 88 relative to the axis L1, and FIG. 17 shows a state in which it is inclined (pivoted) about an axis perpendicular to the axis of the pin 88.

Referring first to FIG. 16, the behavior of the inclination (pivoting) of the coupling member 386 about the axis of the pin 88 relative to the axis L1 will be described.

As shown in part (a) of FIG. 16, similarly to the foregoing embodiments, when the coupling member 386 is pushed by the slider 15, it is inclined (pivoted) about the axis of the pin 88 until the free end portion 386*a* contacts to the rotation regulating portion 76*c* of the bearing member 76.

At this time, the maximum outside circumference of the connecting portion 386*c* is inside the accommodating portion 87*i*, and therefore, the coupling member 386 is unable to move in the direction perpendicular to the axis L1 due to the contact between the connecting portion 386*c* and the accommodating portion 87*i*.

With the configuration of the coupling member 386 of this embodiment, there exists a gap between the pin 88 and the third disengagement preventing portion 386*p*3 of the coupling member 386.

Then, as shown in part (b) of FIG. 16, the coupling member 386 moves in the direction of the axis L1 (X5 direction) until the third disengagement preventing portion 386*p*3 contacts to the pin 88.

Then, a gap is produced between the free end portion 386*a* and the rotation regulating portion 76*c* of the bearing member 76.

As shown in part (c) of FIG. 16, the coupling member 386 further inclines (pivots) about the axis of the pin 88 until the free end portion 386*a* contacts to the rotation regulating portion 76*c* of the bearing member 76.

In addition, by the movement in the X5 direction, the position of the sphere center of the connecting portion 386*c* moves beyond the end portion of the accommodating portion 87*i* of the driving side flange 87 toward the driving side. That is, the maximum outside circumference of the connecting portion 386*c* projects (depart) to the outside of accommodating portion 87*i*.

Then, the gap (play) between the connecting portion 386*c* and the accommodating portion 87*i* increases.

As shown in part (d) of FIG. 16, the coupling member 386 moves in the direction X6 until the connecting portion 386*c* contact to the accommodating portion 87*i*.

Then, a gap is produced between the free end portion 386*a* and the rotation regulating portion 76*c* of the bearing member 76, again. By this, as shown in part (e) of the FIG. 16, the coupling member 386 further inclines (pivots) about the axis of the pin 88 relative to the axis L1 until the free end portion 386*a* contacts to the rotation regulating portion 76*c* of the bearing member 76.

Referring to FIG. 17, the description will be made as to the behavior of the inclination (pivoting) of the coupling member 386 about the shaft perpendicular to the axis of the pin 88 relative to the axis L1.

As shown in part (a) of FIG. 17, similarly to the foregoing embodiments, when the coupling member 386 is pushed by the slider 15, it is inclined (pivoted) about the shaft perpendicular to the axis of the pin 88 until the free end portion 386*a* contacts to the rotation regulating portion 76*c* of the bearing member 76.

At this time, the maximum outside circumference of the connecting portion 386*c* is inside the accommodating portion 87*i*, and therefore, the coupling member 386 is unable to move in the direction perpendicular to the axis L1 due to the contact between the connecting portion 386*c* and the accommodating portion 87*i*.

With the configuration of the coupling member 386 of this embodiment, there exists a gap between the pin 88 and the first disengagement preventing portion 386*p*1 of the coupling member 386.

As shown in part (b) of FIG. 17, the coupling member 386 moves in the direction of the axis L1 (X7 direction) until the first regulating portion 386*p*1 contacts to the pin 88.

Then, a gap is produced between the free end portion 386*a* and the rotation regulating portion 76*c* of the bearing member 76.

As shown in part (c) of FIG. 17, the coupling member 386 inclines (pivots) about the shaft perpendicular to the axis of the pin 88 relative to the axis L1 until the free end portion 386*a* contacts to the rotation regulating portion 76*c* of the bearing member 76.

Similarly to the movement in the X5 direction shown in FIG. 16, by the movement in the X7 direction, the position of the sphere center of the connecting portion 386*c* moves beyond the end portion of the accommodating portion 87*i* of the driving side flange 87 toward the driving side. That is, the maximum outside circumference of the connecting portion 386*c* projects (depart) to the outside of accommodating portion 87*i*.

Then, the gap (play) between the connecting portion 386*c* and the accommodating portion 87*i* increases, similarly to part (c) of FIG. 16. This is not shown in FIG. 17 because it is behind the pin 88.

As shown in part (d) of FIG. 17, the coupling member 386 moves in the direction X8 until the connecting portion 386*c* contact to the accommodating portion 87*i*.

Then, a gap is produced between the free end portion 386*a* and the rotation regulating portion 76*c* of the bearing member 76, again.

By this, as shown in part (e) of FIG. 17, the coupling member 386 further inclines (pivots) about the shaft perpendicular to the axis of the pin 88 relative to the axis L1 until the free end portion 386*a* contacts to the rotation regulating portion 76*c* of the bearing member 76.

In summary, it will suffice if the connecting portion 386*c* is accommodated in the accommodating portion 87*i* with a gap (play) at least a part, so that the coupling member 386 is movable in the direction of the axis L1.

By doing so, with the structure of this embodiment, the inclinable (pivotable) range of the coupling member 386 can be made larger than in the foregoing embodiments, and therefore, the design latitude is further enhanced.

And, because the inclinable (pivotable) angle range of the coupling member 386 is larger than in the foregoing embodiments, the length of the connecting portion 386 *g* measured in the direction of the axis L32 can be reduced further. By this, the rigidity of the coupling member 386 is further enhanced, and therefore, the twisting can be further suppressed, and the rotation transmission accuracy is further improved.

In place of increasing the inclinable (pivotable) angular range of the coupling member 386, the connecting portion 386 *g* can be made thicker by the corresponding amount. Also in such a case, the rigidity of the coupling member 386 it further enhanced, and the twisting it is further suppressed, and the rotation transmission accuracy is further improved.

Embodiment 4

Embodiment 4 of the present invention will be described in conjunction with the drawings.

With respect to this embodiment, the portions different from the foregoing embodiment will be described in detail. The material, the configuration and so on in this embodiment are the same as in the foregoing embodiment, unless otherwise described. With respect to the common structures, the same reference numerals and characters are assigned, and the detailed description thereof are omitted.

In this embodiment, similarly to the foregoing embodiments, the coupling member is inclinable (pivotable) substantially in all directions relative to the rotational axis L1 Of the drum 62.

This embodiment is different from the foregoing embodiments in the configurations of the coupling member, the driving side flange and the regulating member.

Figure 18:
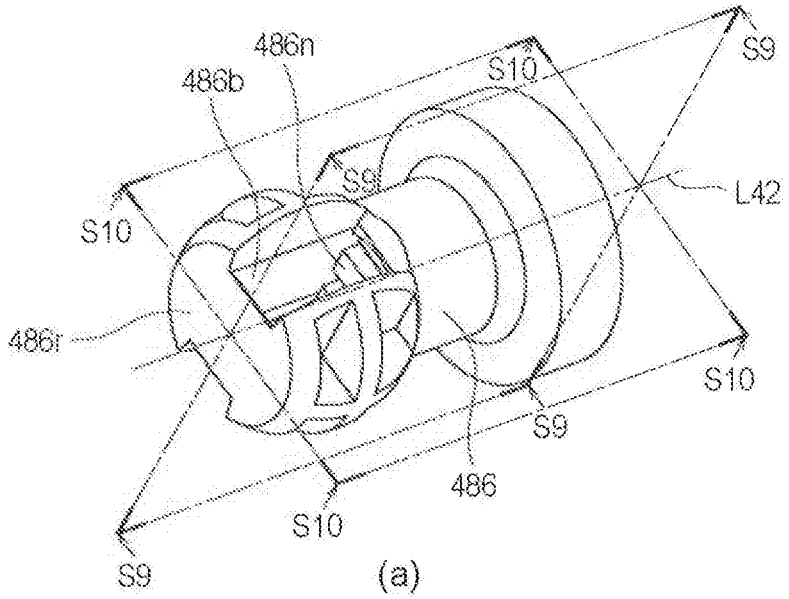
FIG. 18 is a perspective view and a sectional view of a coupling member according to a fourth embodiment of the present invention.
Figure 18:
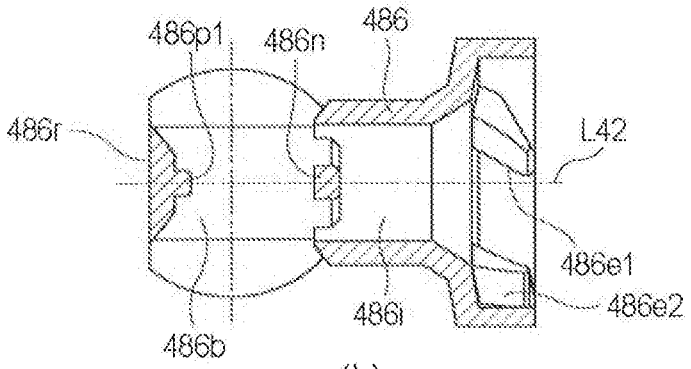
Figure 18:
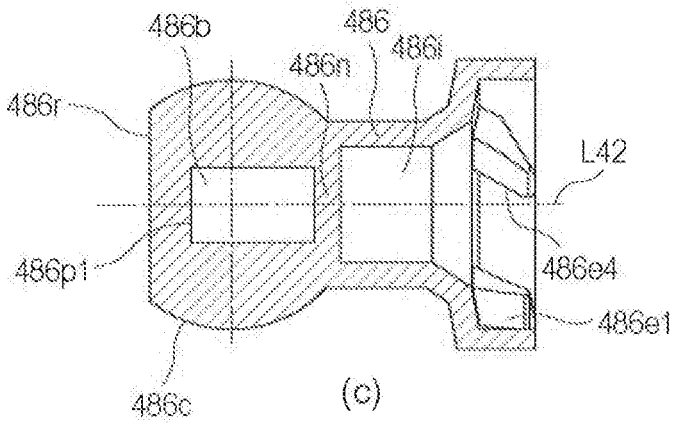

Referring to FIG. 18, the configuration of the coupling member 486 of this embodiment will be described.

Part (a) of FIG. 18 is a perspective view of the coupling member 486, part (b) of FIG. 18 is a sectional view taken along a flat surface S9 of part (a) of FIG. 18, part (c) of FIG. 18 is a sectional view taken along a flat surface S10 of part (a) of FIG. 18.

As shown in FIG. 18, the coupling member 486 of this embodiment is provided with a hole portion 486*i* which is a through-hole (first hole portion) penetrating to the hole portion 486*b* (through-hole) from the rotational force receiving portion 486*e*1-*e*4 side in the direction of the axis L42.

The coupling member 486 is provided inside the hole portion 486*i* with a rib 486*n* expanding in the direction crossing with the axis L42.

Further, the coupling member 486 is provided with a pivoting regulated portion 486*r* at an end portion opposite the rotational force receiving portions 486*e*1-*e*4 with respect to the direction of the axis L42, the pivoting regulated portion 486*r* being a recess of a substantially spherical shape formed in the connecting portion 486*c*.

The pivoting regulated portion 486*r* is a flat surface.

Figure 19:
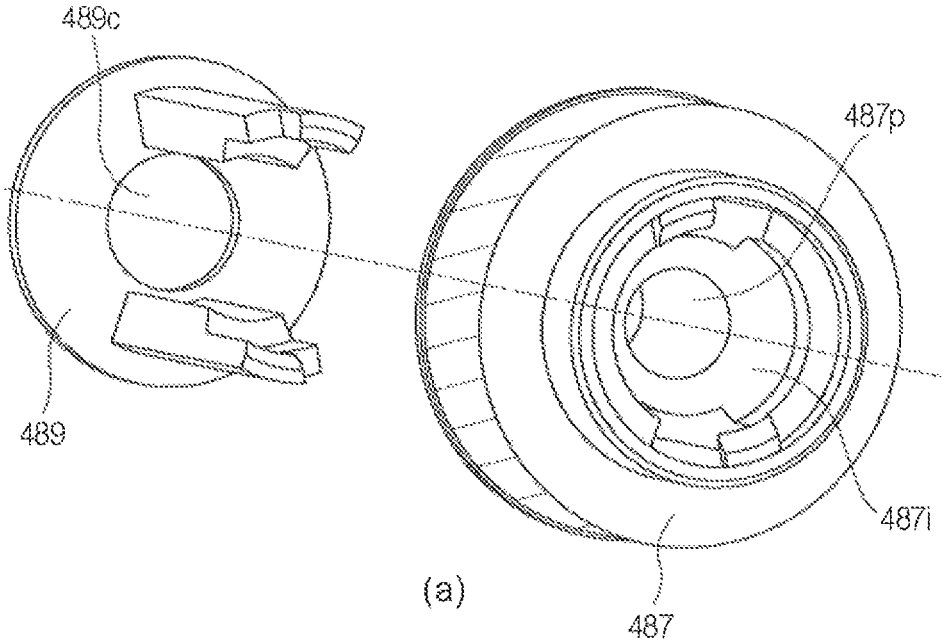
FIG. 19 is a perspective view of a flange and a regulating member according to the fourth embodiment of the present invention.
Figure 19:
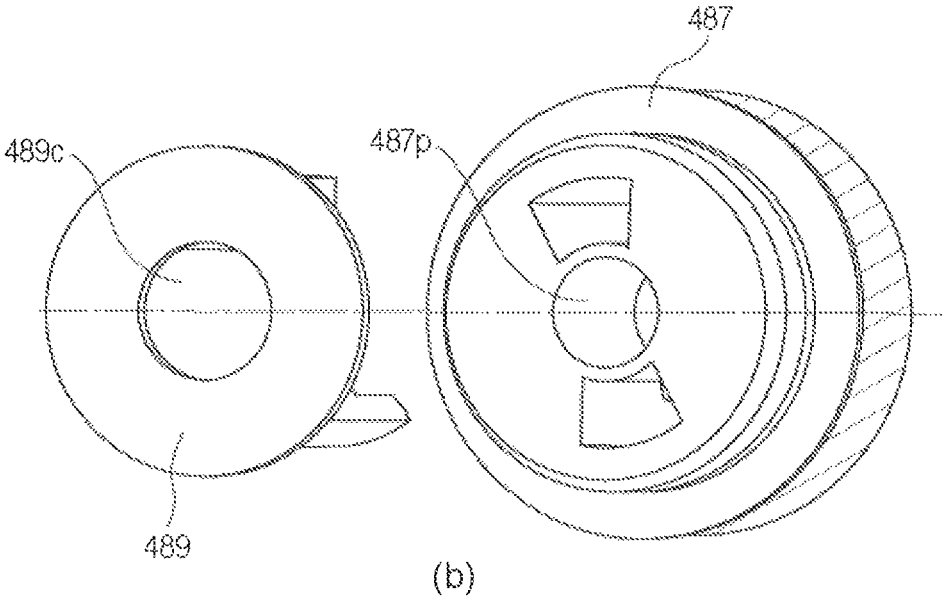

Referring to FIG. 19, the configurations of the driving side flange 487 and the regulating member 489 of this embodiment will be described.

Parts (a) and (b) of FIG. 19 are perspective views of the driving side flange 487 and the regulating member 489.

As shown in FIG. 19, the driving side flange 487 is provided with a hole portion 487*p* which is a flange through-hole (second hole portion the penetrating to the side opposite to the accommodating portion 487*i* along the axial direction. The regulating member 489 is provided with a hole portion 489*c* penetrating in axial direction thereof.

Figure 20:
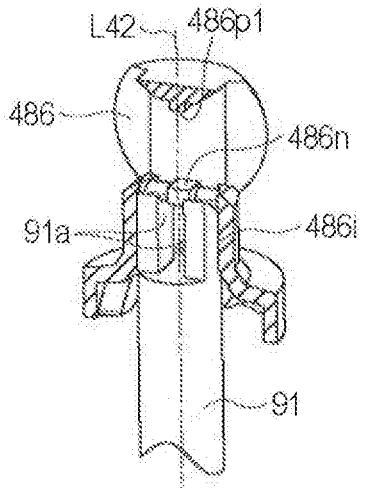
FIG. 20 illustrates an assembling method for a driving side flange unit according to the fourth embodiment of the present invention.
Figure 20:
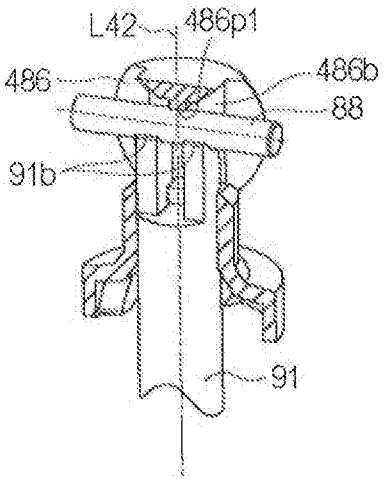
Figure 20:
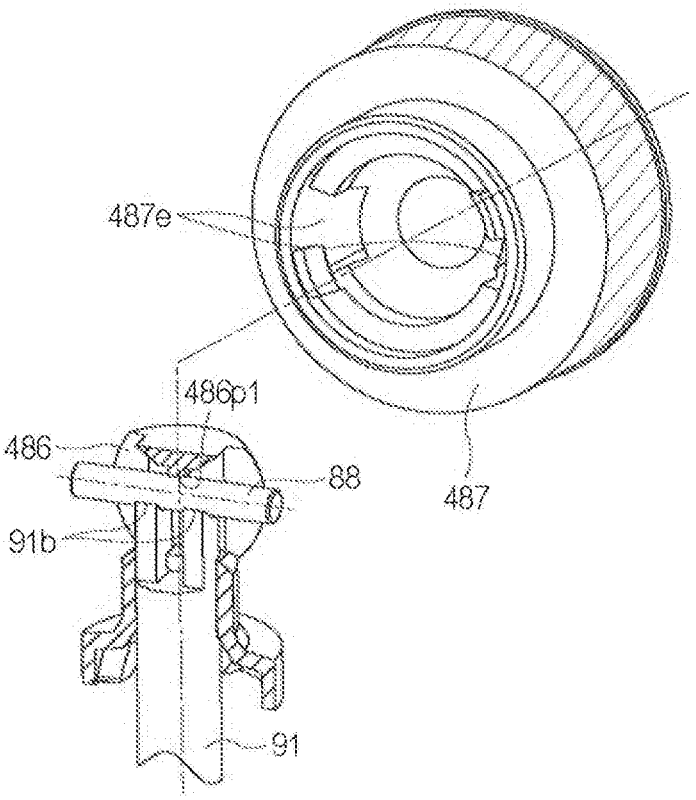

Referring to FIG. 20, the assembling method for the driving side flange unit U2 will be described.

Parts (a)-(c) of FIG. 20 are illustrations of an assembling method for the driving side flange unit U42.

As shown in part (a) of FIG. 20, with indexing rotation of the coupling member 486 relative to a first assembling jig about the axis L42, the hole portion 486*i* of the coupling member 486 is inserted into the first assembling jig 91. Then, a phase regulating portion 91*a* of first assembling jig and the rib 486*n* are engaged with each other, so that the phase of coupling member 486 relative to the first assembling jig can be regulated.

Then, as shown in part (b) of FIG. 20, the pin 88 is penetrated through the hole portion 486*b* of the coupling member 486 (shaft portion inserting step). And, the pin 88 is held by sandwiching between the first disengagement preventing portion 486*p*1 of the coupling member 486 and the holding portion 91*b* of the first assembling jig (shaft portion supporting process).

Thereafter, as shown in part (c) of FIG. 20, similarly to Embodiment 1, both of the end portion of the coupling member 486 and the pin 88 are inserted into the accommodating portion of the driving side flange 487. At this time, opposite end portions of the pin 88 are inserted into the hole portions 487*e* of the driving side flange 487.

With the structure of the present invention, in the step of penetrating the pin 88 through the hole portion 486*b* of the coupling member 486 shown in part (b) of FIG. 20, the phase of the coupling member 486 is determined, and therefore, the pin 88 can be passed through the hole portion 486*b* in the same direction assuredly.

In the state (coupling member inserting step) shown in part (c) of FIG. 20 in which with the pin 88 being held together with together with coupling member 486, the opposite end portions of the pin 88 are inserted into the hole portions 487*e* of the driving side flange 487, the pin 88 is held by the first disengagement preventing portion 486*p*1 and the holding portion 91*b*. Therefore, the positional deviation and/or disengagement of the pin 88 can be prevented.

The assembling property of the driving side flange unit U42 is better than in the foregoing embodiments.

Figure 21:
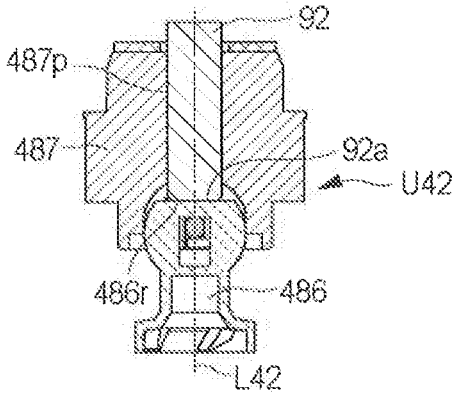
FIG. 21 illustrates a regulating method for the pivoting motion of a coupling member 486 in a state of the driving side flange unit, according to the fourth embodiment of the present invention.
Figure 21:
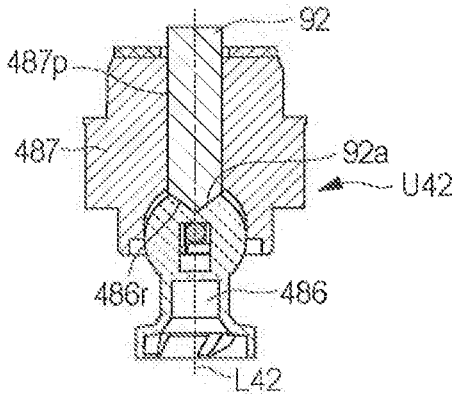
Figure 21:
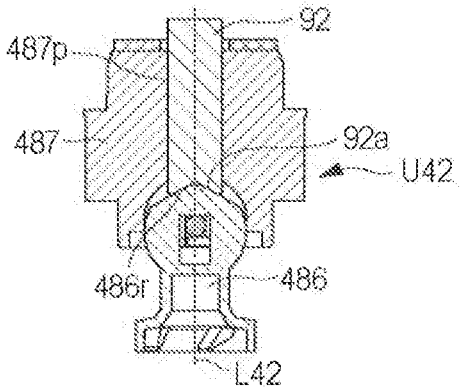

Referring to FIG. 21, a limiting method for the pivoting motion of the coupling member 486 of the driving side flange unit U42.

Part (a) of FIG. 21 is a sectional view of the driving side flange unit U42, parts (b) and (c) of FIG. 21 are sectional views of a modified example of the driving side flange unit U42.

In the state of the driving side flange unit U42, the second assembling jig 92 is inserted into the hole portion 487*p*, and the flat surface configuration urging portion 92*a* is urged against the pivoting regulated portion 486*r*, then the axis L42 of the coupling member 486 and the axis of the driving side flange 487 can be kept aligned with each other. In other words, the pivoting motion of the coupling member 486 can be regulated.

Thus, with the driving side flange unit U42, the coupling member 486 is prevented from being damaged by the interference with the assembling device as a result of position change caused by the inclination (pivoting) of the coupling member 486 during transportation, The assembling property of the driving side flange unit U42 is better than in the foregoing embodiments.

The configurations of the pivoting regulated portion 486*r* and the urging portion 92*a* may be such that the pivoting regulated portion 486*r* has a recessed conical surface, and the urging portion 92*a* has a conical shape, as shown in part (b) of FIG. 21.

The configurations of the pivoting regulated portion 486*r* and the urging portion 92*a* may be such that the pivoting regulated portion 486*r* has a conical surface, and the urging portion 92*a* is recessed conical surface, as shown in part (c) of FIG. 21.

The configuration of the pivoting regulated portion 486*r* can be freely selected as long as it is recessed than the portion other than the substantially spherical connecting portion 486*c*, and the pivoting motion of the coupling member 486 can be regulated by being urged by the second assembling jig 92.

Embodiment 5

In Embodiments 1-4, with the mounting operation of the process cartridge to the apparatus main assembly, the coupling member is sandwiched by the upper guide fixed to the process cartridge and a movable type lower guide provided in the apparatus main assembly, so that the coupling member is inclined toward the downstream with respect to the mounting direction. This is the same as with the patent specification 1 disclosed in FIG. 80.

With such a structure, the position of the upper guide fixed to the process cartridge may change depending on the attitude of the cartridge during the mounting and demounting. If this occurs, the inclining direction of the coupling member may be slightly deviated.

Therefore, it is required to enhance the dimensional accuracy of the constituent elements so that the coupling member can engage with the main assembly side engaging portion even when a cartridge becomes oblique during the mounting and demounting.

This embodiment provides a further improvement of such a structure, and provides the electrophotographic image forming apparatus in which the coupling member provided on the electrophotographic photosensitive drum is engaged with the main assembly side engaging portion provided in the main assembly while inclining the coupling member, and in which the coupling member and the main assembly side engaging portion can be further stably engaged with each other.

To accomplish this, this embodiment provides,

An electrophotographic image forming apparatus for forming an image on a recording material, said apparatus comprising:

(i) an apparatus main assembly including a rotatable main assembly side engaging portion;

(ii) a cartridge mountable to said apparatus main assembly in a predetermined direction substantially perpendicular to a rotational axis of said main assembly side engaging portion, said cartridge including (ii-i) a rotatable member, and (ii-ii) a coupling member rotatable to receive a rotational force for rotating said rotatable member from said main assembly side engaging portion, said coupling member being pivotable relative to the rotational axis of said rotatable member;

(iii) first and second guides provided in said apparatus main assembly, at least one of said guides being movable to pivots said coupling member toward downstream with respect to the mounting direction of said cartridge by sandwiching said coupling member therebetween in a mounting operation of said cartridge.

According to this embodiment, an electrophotographic image forming apparatus in which the coupling member provided on the electrophotographic photosensitive drum is engaged with the main assembly side engaging portion provided in the main assembly while inclining the coupling member, and in which the coupling member and the main assembly side engaging portion can be further stably engaged with each other, can be provided.

This embodiment will be described in conjunction with the accompanying drawings.

Figure 23:
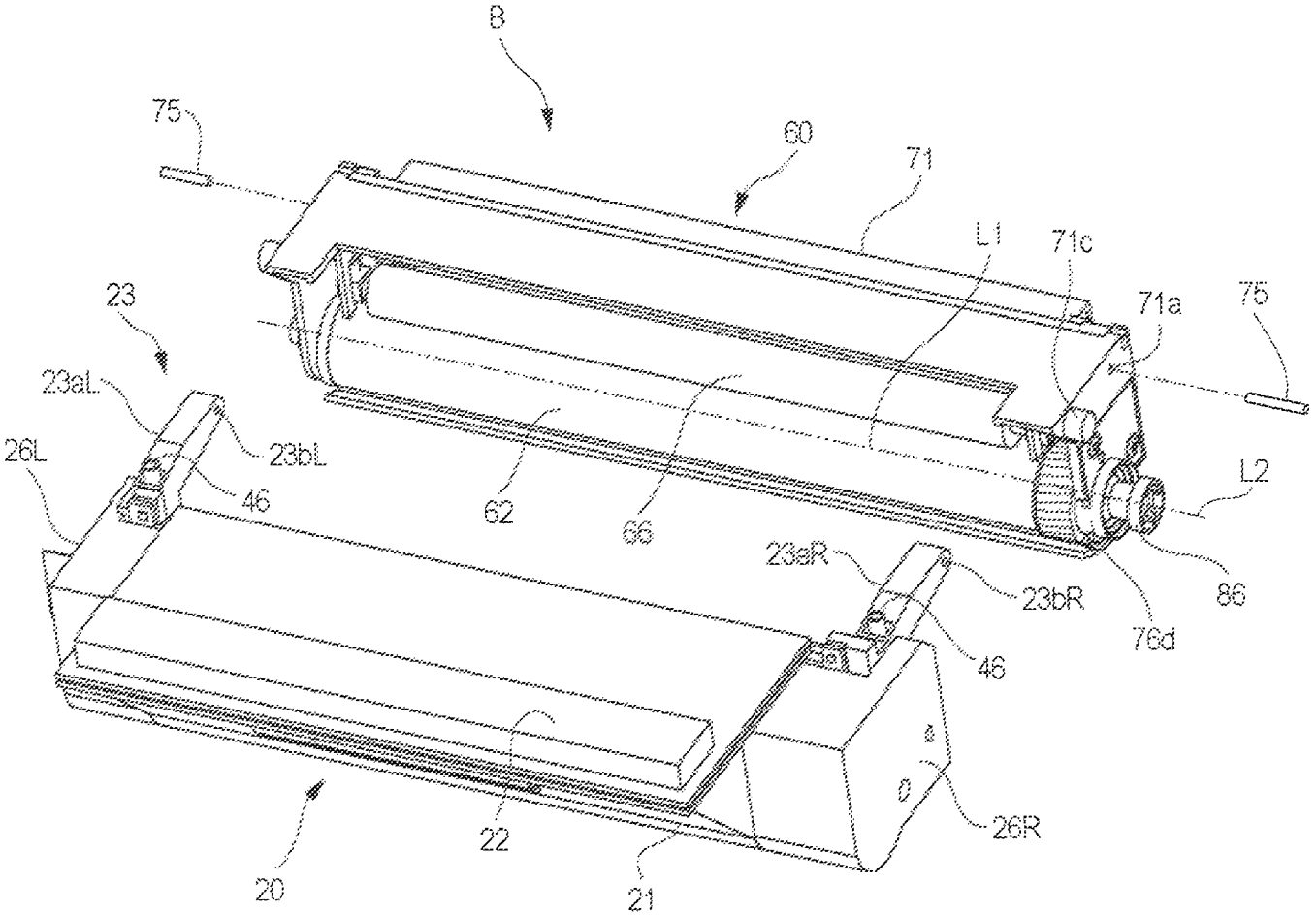
FIG. 23 is an exploded perspective view of a process cartridge according to the fifth embodiment of the present invention.

FIG. 23 is an exposed perspective view of the cartridge B according to this embodiment.

Figure 24:
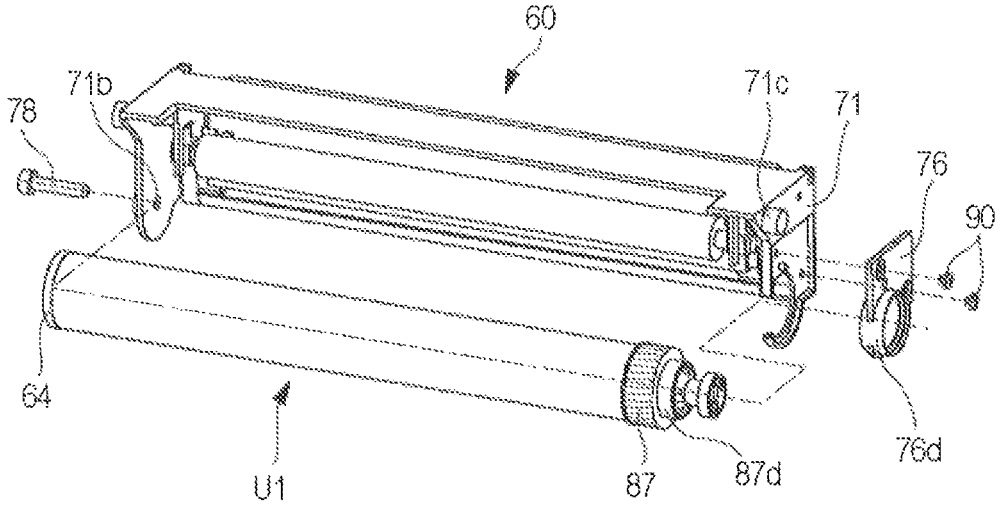
FIG. 24 is an illustration of assembling of an electrophotographic photosensitive drum unit into a cleaning unit, according to the fifth embodiment of the present invention.

FIG. 24 is an illustration of incorporation of the drum unit U1 into the cleaning unit 60 according to this embodiment.

Figure 25:
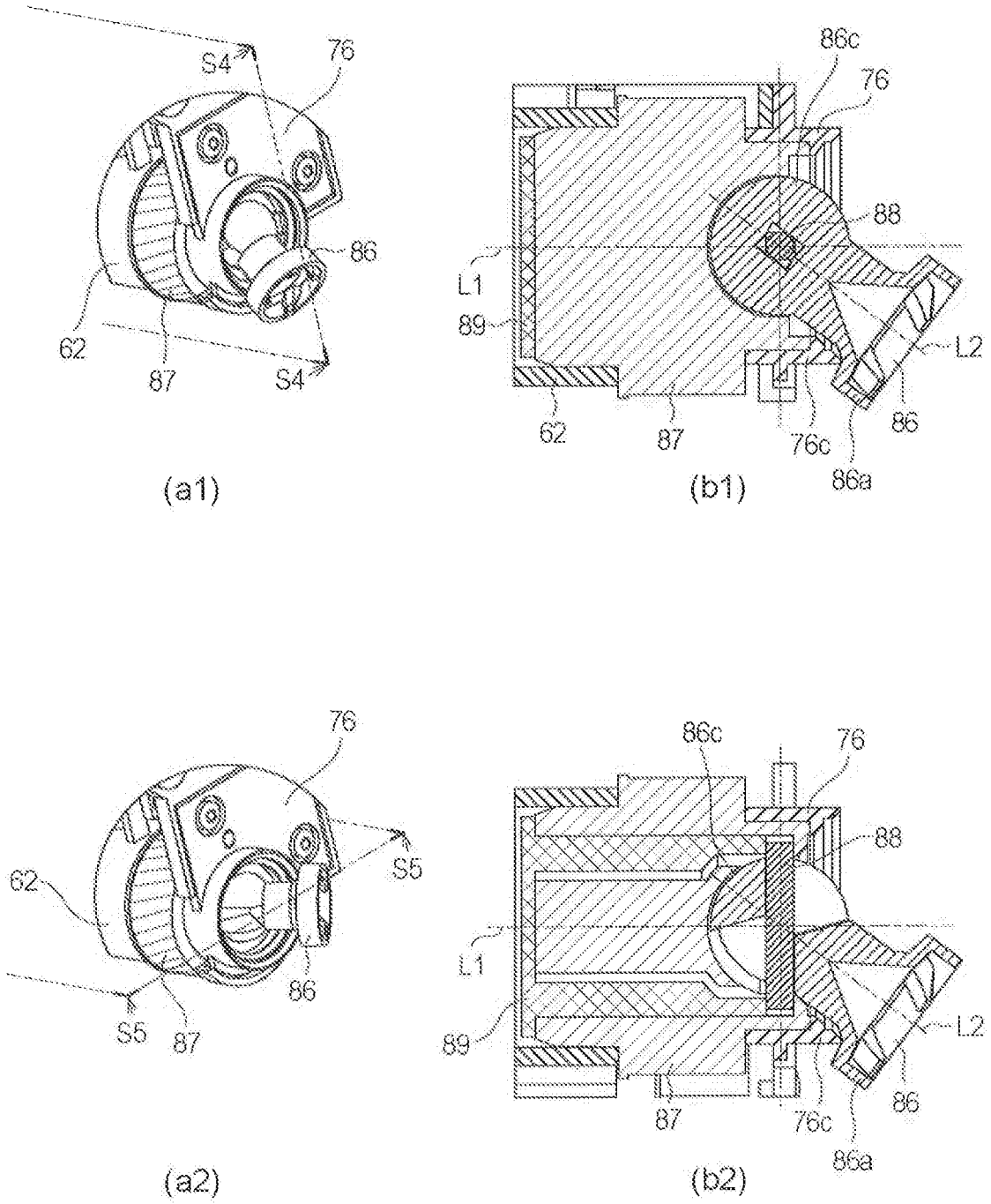
FIG. 25 is an illustration of an example of dimensions, in the fifth embodiment of the present invention.

FIG. 25 is an illustration of the inclination (pivoting) of the coupling member 86 relative to the axis L1.

This embodiment is different from Embodiment 1 in a part of the shape of the bearing member 76. More particularly, as contrasted to Embodiment 1, the guide portion 76*b* is not provided, and the coupling member 86 can be freely whirled (pivoted) upwardly. This embodiment is similar to Embodiment 1 in the other respects. The bearing member 76 is provided with a cylindrical portion 76*d* coaxial with the drum unit U1.

The mounting and demounting of the cartridge B relative to the main assembly A in this embodiment will be described.

Figure 26:
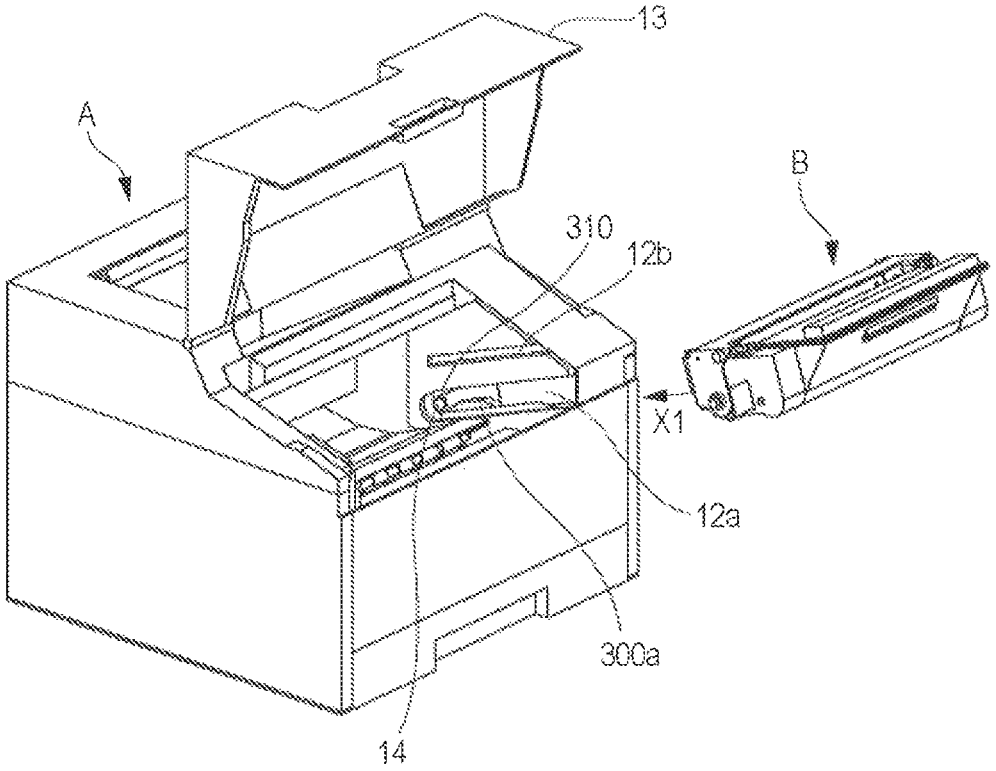
FIG. 26 is a perspective view of an electrophotographic image forming apparatus, according to the fifth embodiment of the present invention.

FIG. 26 is a perspective view illustrating the mounting and demounting of the cartridge B to the main assembly A.

As shown in FIG. 26, the main assembly A is provided with a rotatable opening and closing door 13. When the door 13 is opened, there are provided in the driving side, a main assembly side engaging portion 14, a first guiding rail 12*a*, a second guiding rail 12*b*, a lower guide 300*a* as a first guide (fixed guide), and an upper guide 310 as a second guide (movable guide) or the like.

And first guiding rail 12*a* and the second guiding rail 12*b* function to guide the cartridge B into the main assembly A. Particularly, the first guiding rail 12*a* constitutes the movement path for the coupling member 86 when the cartridge B is mounted to or dismounted from the apparatus main assembly.

In addition, the main assembly side engaging portion 14 is provided with a rotational force applying portion 14*b* (FIG. 22) to engage with the coupling member 86 to transmit the rotational force to the coupling member 86. The main assembly side engaging portion 14 rotatably supported by the main assembly A so that it is not movable in the rotational axis direction are in the direction perpendicular to the rotational axis.

After the door 13 of the main assembly A is opened, the cartridge B can be mounted in the direction of an arrow X1 in the Figure.

Referring to FIGS. 22 and 27-29, the structure of the cartridge driving portion of the main assembly A will be described.

Figure 22:
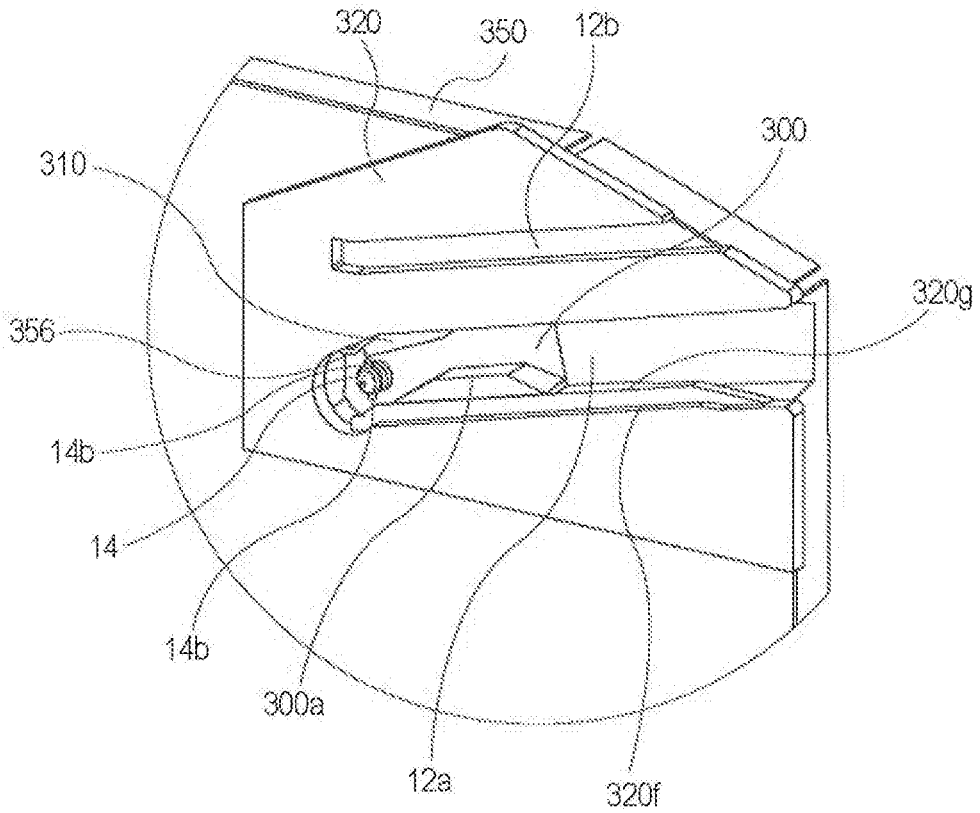
FIG. 22 is a perspective view of a driving portion of the electrophotographic image forming apparatus, according to a fifth embodiment of the present invention.
Figure 27:
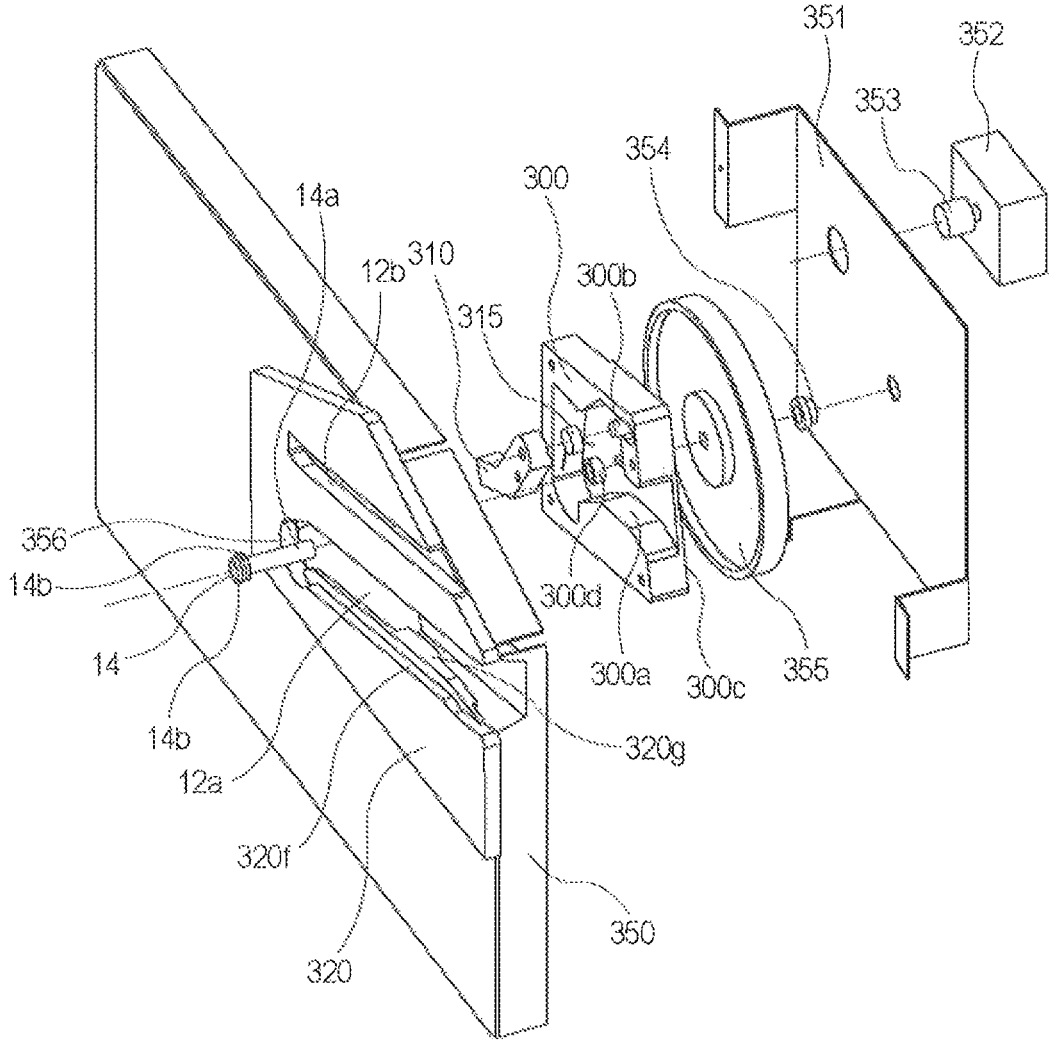
FIG. 27 is an exploded perspective view of a driving portion of the apparatus main assembly, according to the fifth embodiment of the present invention.
Figure 28:
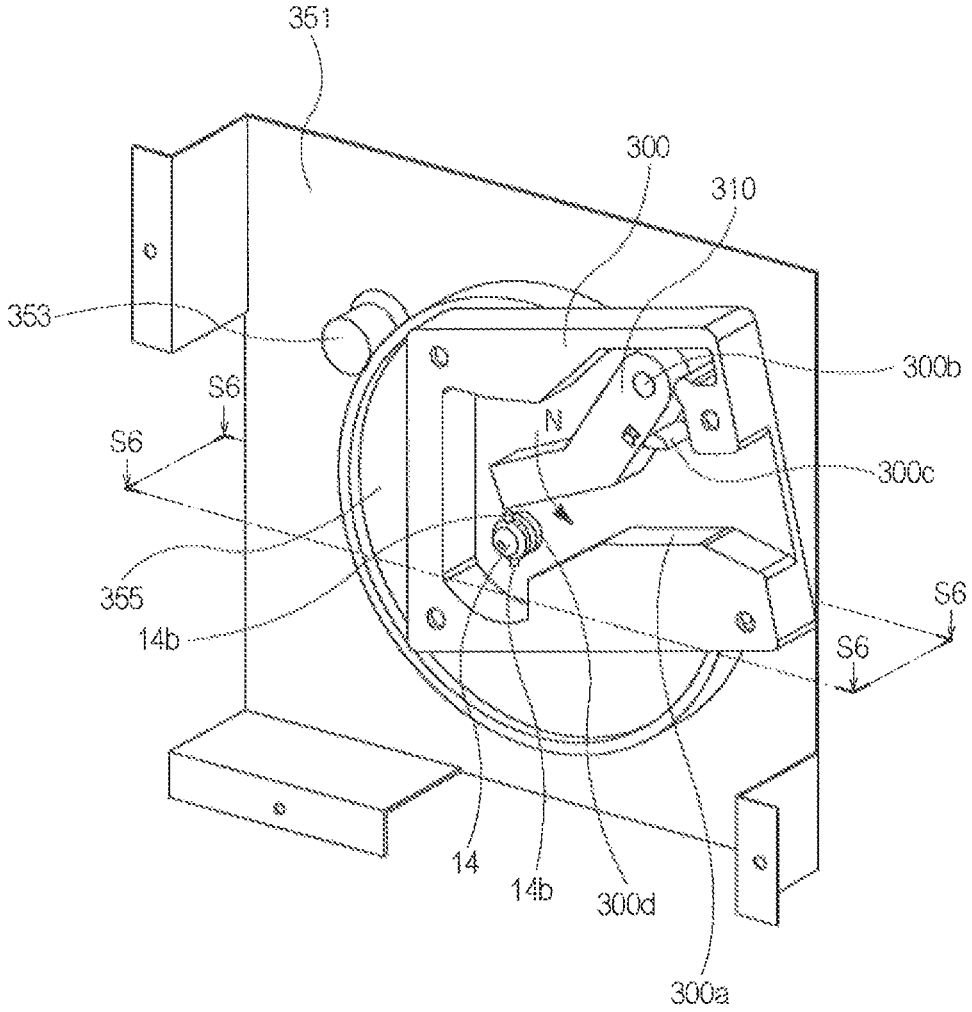
FIG. 28 is an enlarged view of the driving portion of the apparatus main assembly, according to the fifth embodiment of the present invention.
Figure 29:
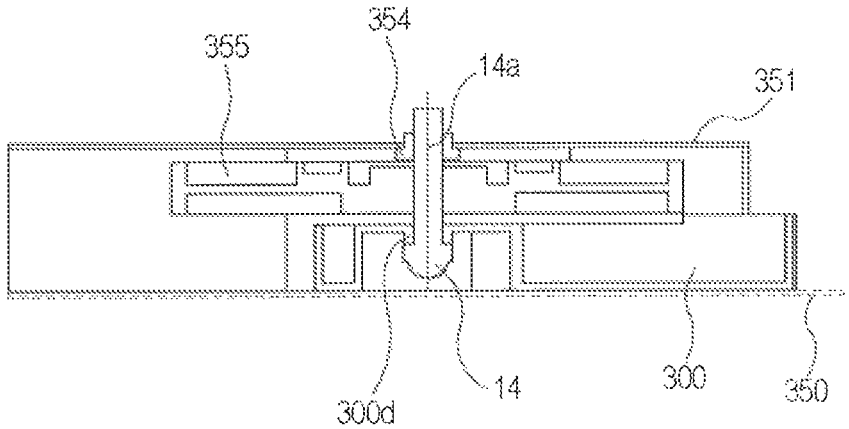
FIG. 29 is an enlarged sectional view of the driving portion of the apparatus main assembly, according to the fifth embodiment of the present invention.

FIG. 22 is a perspective view of the driving portion of the main assembly A, FIG. 27 is an exploded perspective view of the driving portion, FIG. 28 Is an enlarged view of a part of the driving portion, and FIG. 29 is a sectional view taken along a plane S6 of FIG. 28.

The cartridge driving portion comprises a main assembly side engaging portion 14, a side plate 350, a holder 300, a driving gear 355 and so on.

As shown in FIG. 29, the driving shaft 14*a* of the main assembly side engaging portion 14 is non-rotatably fixed to the driving gear 355 by a means (unshown). Therefore, when the driving gear 355 rotates, the main assembly side engaging portion 14 also rotates. In addition, opposite end portions of the driving shaft 14*a* are rotatably supported by the bearing portion 300*d* of the holder 300 and the bearing 354.

As shown in FIGS. 27, 28, the motor 352 is provided on the second side plate 351, and the rotation shaft thereof is provided with a pinion gear 353. The pinion gear 353 is in meshing engagement with the driving gear 355. Therefore, when the motor 352 rotates, the driving gear 355 rotates to rotate the main assembly side engaging portion 14.

The second side plate 351 and the holder 300 are fixed on the side plates 350, respectively.

As shown in FIGS. 22 and 27, the guiding member 320 is provided with a cartridge guide portion 320*f* and a coupling guiding portion 320 *g* to constitute the first guiding rail 12*a* and the second guiding rail 12*b*. The guiding member 320 is fixed also on the side plate 350.

As shown in FIG. 28, the holder 300 is provided with a lower guide 300*a* as a first guide (fixed guide), a rotational shaft 300*b*, and a stopper 300*c*. The rotational shaft 300*b* is provided with a rotatable upper guide 310 as a second guide (movable guide the, and is urgent by an urging spring 315 as an urging member (elastic member) in the direction of the arrow N in the Figure (FIG. 27). The upper guide 310 contacts the stopper 300*c* to determine the position thereof with respect to the direction of the arrow N in the Figure. Is position of the upper guide 310 at this time is called "operating position". The lower guide 300*a* is provided with a projection projecting toward the upper guide 310.

Figure 30:
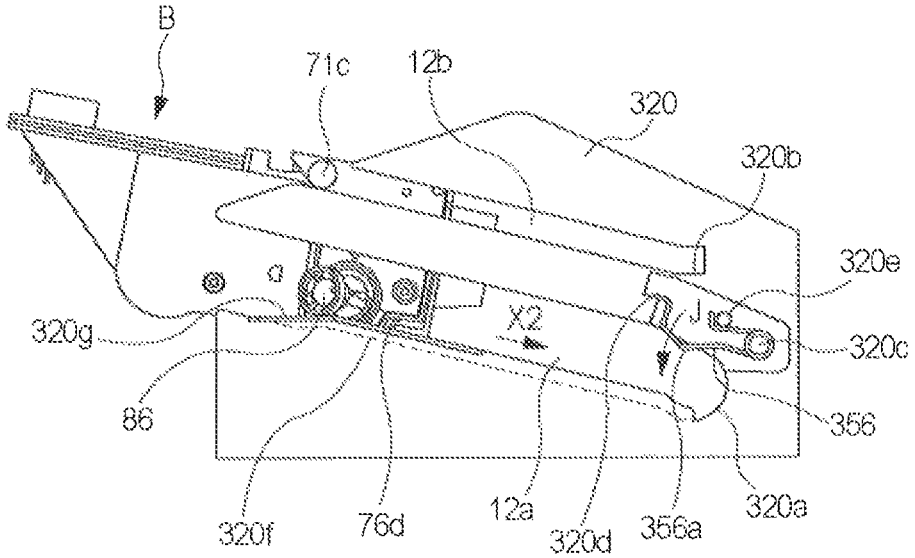
FIG. 30 is an illustration of cartridge mounting and positioning to the apparatus main assembly, according to the fifth embodiment of the present invention.
Figure 30:
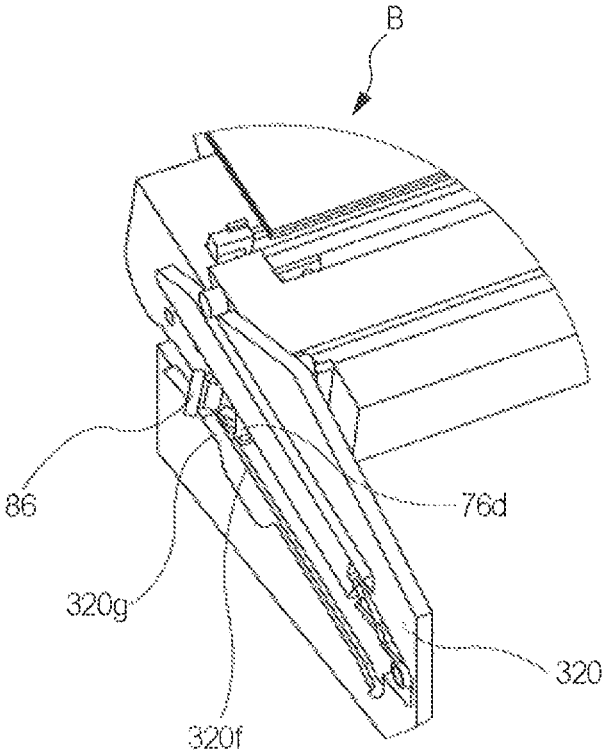
Figure 31:
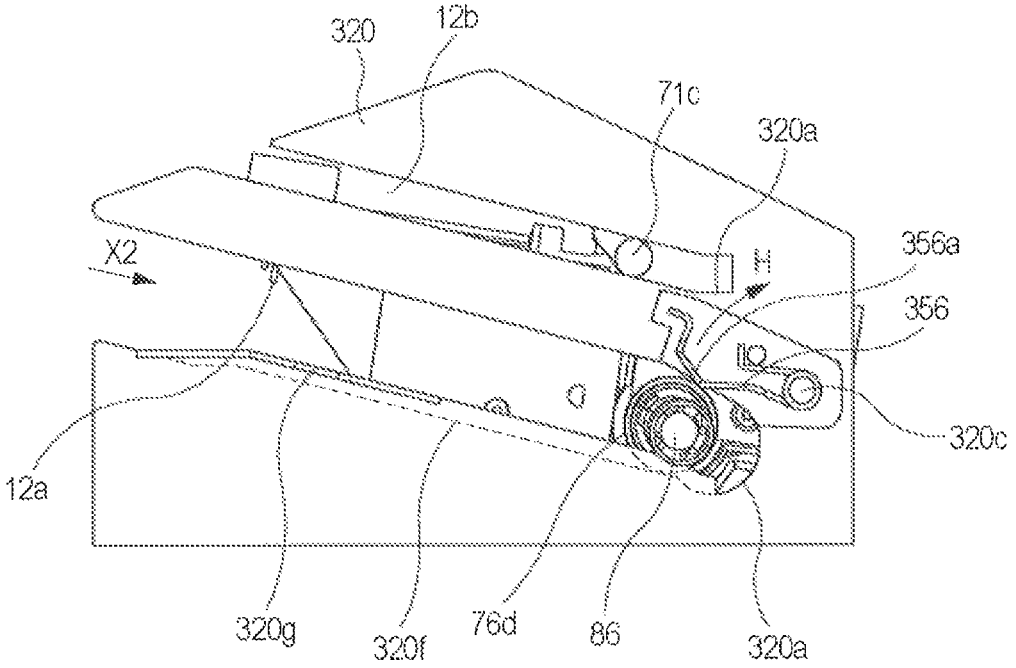
FIG. 31 is an illustration of cartridge mounting and positioning to the apparatus main assembly, according to the fifth embodiment of the present invention.
Figure 32:
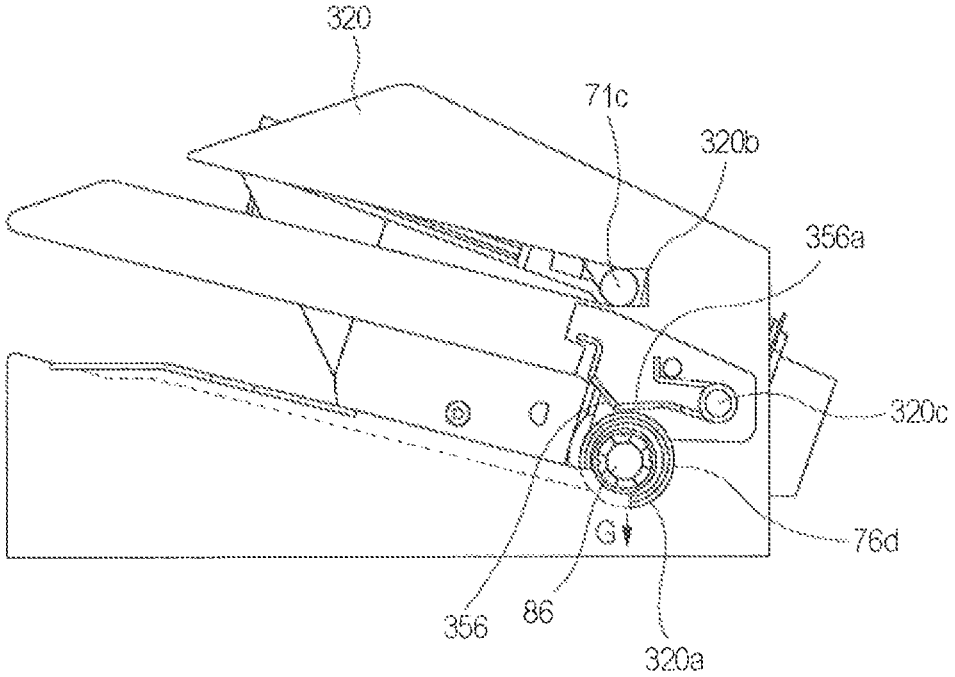
FIG. 32 is an illustration of cartridge mounting and positioning to the apparatus main assembly, according to the fifth embodiment of the present invention.

Referring to FIG. 30-FIG. 32, the description will be made as to the mounting and positioning of the cartridge B to the main assembly A. For the purpose of easy understanding, FIGS. 30 and 31 illustrate only the parts that are necessary for the positioning. The mounting of the cartridge B to the main assembly A while the coupling member 86 is inclining (pivoting). FIG. 30-FIG. 32 are views of the main assembly A as seen from the outside in which the cartridge B is being mounted to the main assembly A.

As shown in FIG. 30, the guiding member 320 is provided with a pulling spring 356. The pulling spring 356 is rotatably supported by the rotational shaft 320*c* of the guiding member 320, and the position thereof is fixed by the stoppers 320*d*, 320*e*. At this time, an operating portion 356*a* of the pulling spring 356 is urged in the direction of the arrow J in the Figure.

As shown in FIG. 30, when the cartridge B is mounted to the main assembly A, the cylindrical portion 76*d* (FIG. 24) of the cartridge B is along the first guiding rail 12*a*, and the rotation stopper boss 71*c* of the cartridge B is along the second guiding rail 12*b* (FIG. 24). At this time, the cartridge is mounted so that the cylindrical portion 76*d* of the cartridge B contacts the cartridge guide portion 320*f* of the guiding member 320 and such that the coupling 86 contacts the coupling guiding member 320*g*.

Furthermore, when the cartridge B is inserted in the direction of the arrow X2 in the Figure, the cylindrical portion 76*d* of the cartridge B it brought into contact to the operating portion 356*a* of the pulling spring 356, as shown in FIG. 31. By doing so, the operating portion 356*a* elastically deforms in the direction of an arrow H in the Figure.

Thereafter, the cartridge B is mounted to a predetermined position (mounting completed position) (FIG. 32). At this time, the cylindrical portion 76*d* of the cartridge B contacts the positioning portion 320*a* of the guiding member 320. Similarly, the rotation stopper boss 71*c* of cartridge B contacts the positioning surface 320*b* of the guiding member 320. In this manner, the position of the cartridge B is determined relative to the main assembly A.

At this time, the operating portion 356*a* of the pulling spring 356 urges the cylindrical portion 76*d* of the cartridge B in the direction of the arrow G in the Figure, and the contact between the cylindrical portion 76*d* of the cartridge B and the positioning portion 320*a* of the guiding member 320 is assured. By this, the cartridge B is correctly positioned relative to the main assembly A.

Referring to FIG. 33-FIG. 40, the description will be made as to the mounting of the cartridge B to the main assembly A while the coupling member 86 is inclining (pivoting). For the purpose of the easy understanding, only the parts necessary for the inclination (pivoting) of the coupling member 86 are illustrated.

FIG. 33-FIG. 40 illustrate the process of mounting of the cartridge B to the main assembly A. Parts (b) of FIG. 33-FIG. 40 are schematic Figures of the mounting process as seen from the outside (side surface) of the main assembly A, parts (a) of FIG. 33-FIG. 40 are schematic Figures in the direction along the arrow M of part (b) of FIG. 33. Some parts are omitted for better illustration.

Figure 33:
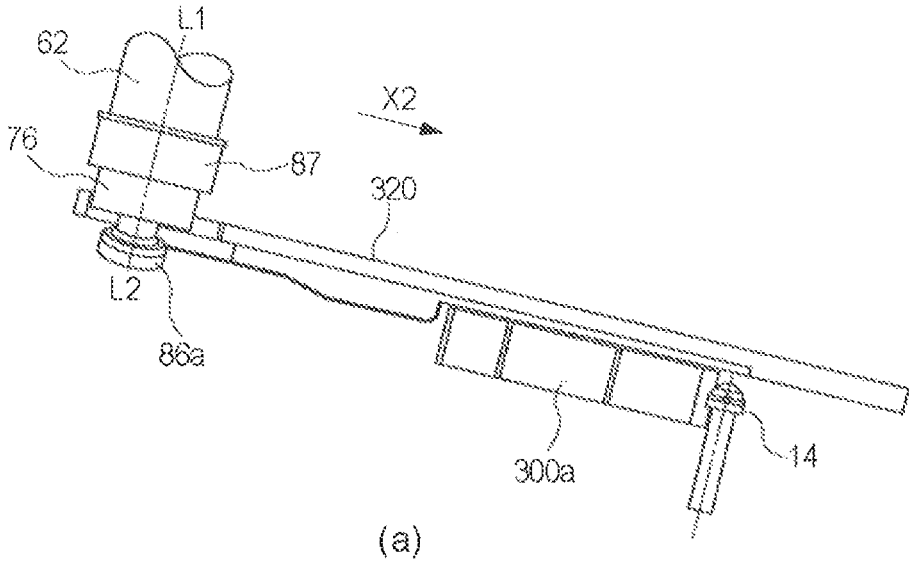
FIG. 33 is an illustration of cartridge mounting to the apparatus main assembly, according to the fifth embodiment of the present invention.
Figure 33:
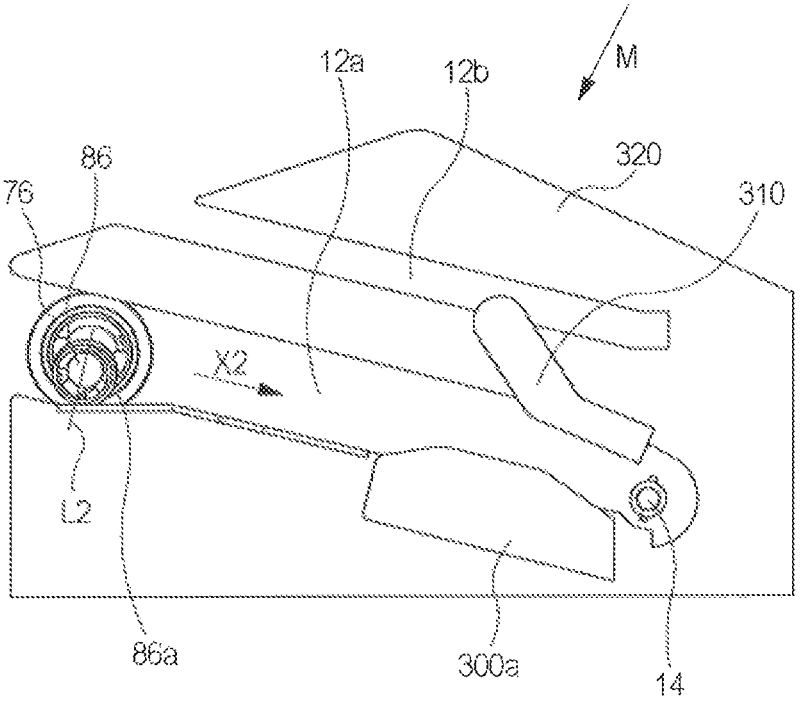

FIG. 33 shows the state of the beginning of the mounting of the cartridge B to the main assembly A. At this time, the coupling member 86 inclined downward by the gravity force. At least a part of the upper guide 310 at this time enters the movement path of the coupling member 86 (operating position).

Figure 34:
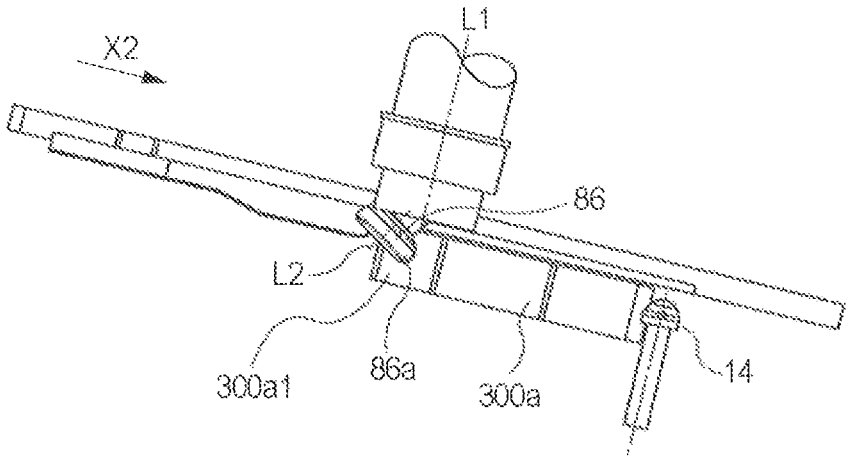
FIG. 34 is an illustration of cartridge mounting to the apparatus main assembly, according to the fifth embodiment of the present invention.
Figure 34:
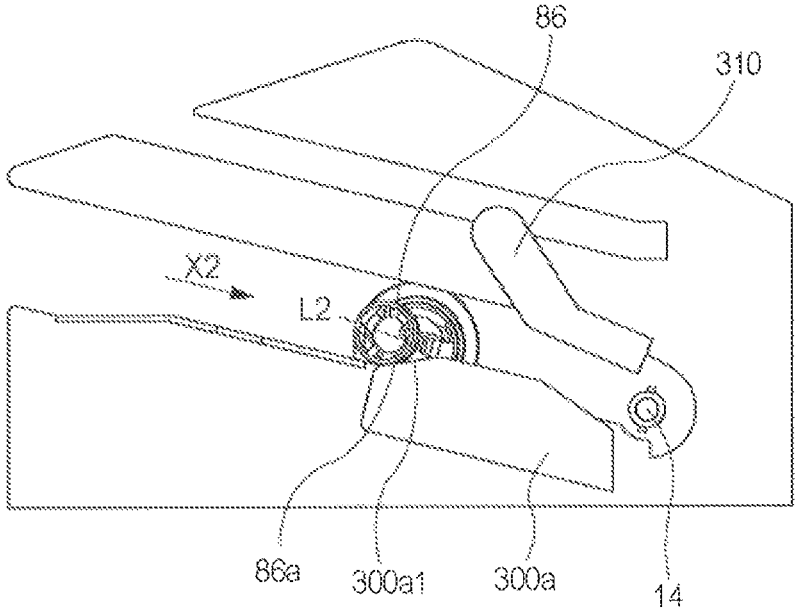

FIG. 34 shows the state thereafter, in which when the cartridge B is inserted in the direction of the arrow X2 in the Figure, the free end portion 86*a* of the coupling member 86 this is brought into contact to the first guide portion 300*a*1 of the lower guide 300*a* of the holder 300. By this, the coupling member 86 is inclined (pivoted) opposed to the mounting direction.

Figure 35:
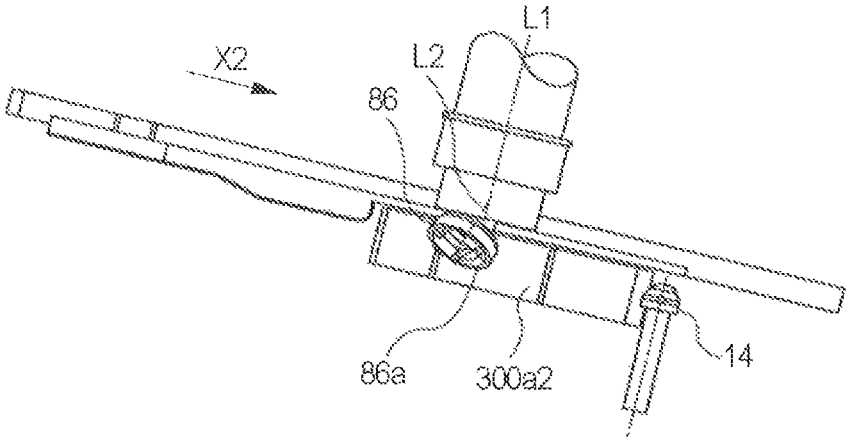
FIG. 35 is an illustration of cartridge mounting to the apparatus main assembly, according to the fifth embodiment of the present invention.
Figure 35:
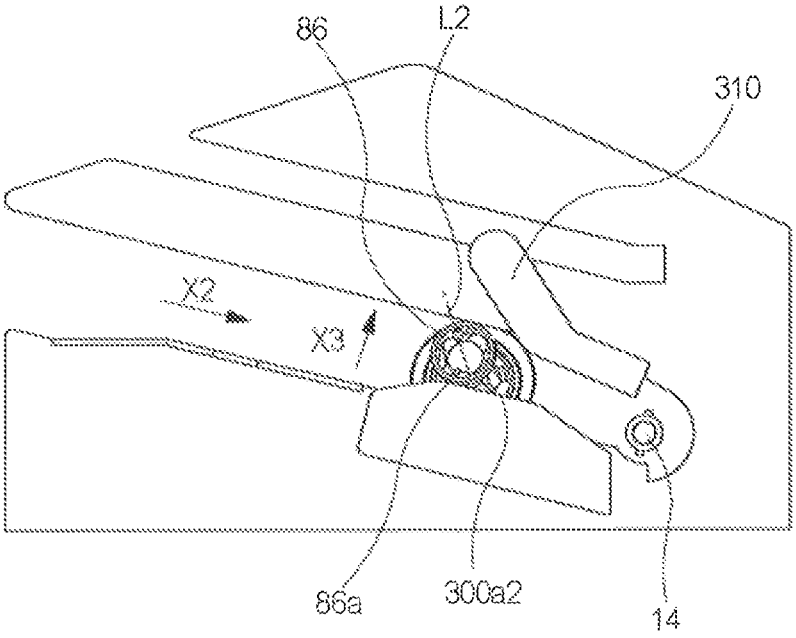

FIG. 35 shows a state thereafter, in which when the cartridge B is further inserted in the direction X2, the free end portion 86*a* of the coupling member 86 is contacted to the second guide portion 300*a*2 of the lower guide 300*a*, by which the coupling member 86 inclines (pivots) in the direction of the arrow X3 in the Figure. That is, coupling member 86 inclines (pivots) toward the upper guide 310.

At this time, the coupling member 86 makes a whirling motion, and as seen from the top (part (a) of FIG. 35), the axis L2 pivots so as to substantially align with the axis L1.

More particularly, in the movement from the state of FIG. 34 to the state of FIG. 35, the coupling member 86 effects the inclination (pivoting) motion in the direction of X3 and also the inclination (pivoting) motion toward the downstream with respect to the direction X2.

Therefore, even when the coupling member 86 is inclined (pivoted) toward the upstream (opposed to the direction X2) with respect to the mounting direction due to the friction with another member or the like (FIG. 34), the coupling member 86 is inclined toward the downstream with respect to the ejection X2 so as to align the axis L2 with the axis L1 by the contact to the second guide portion 300*a*2 of the lower guide 300*a*. In other words, as seen from the top, the coupling member 86 is moved by the contact to the second guide portion 300*a*2 so that the inclination amount of the axis L2 relative to the axis L1 decreases.

Figure 36:
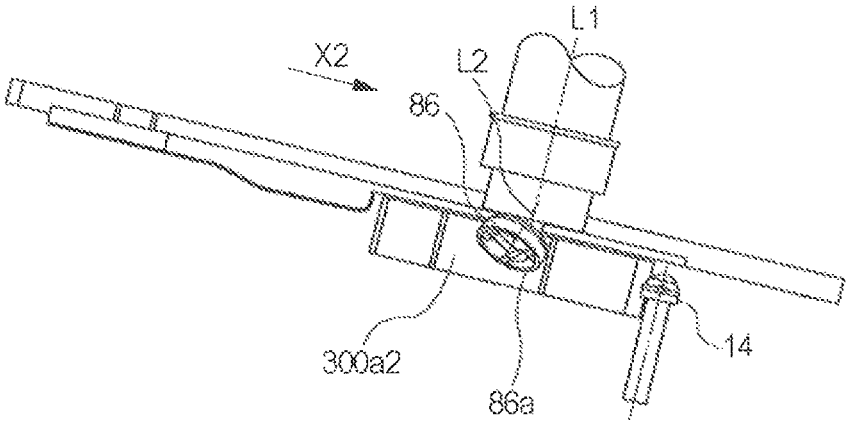
FIG. 36 is an illustration of cartridge mounting to the apparatus main assembly, according to the fifth embodiment of the present invention.
Figure 36:
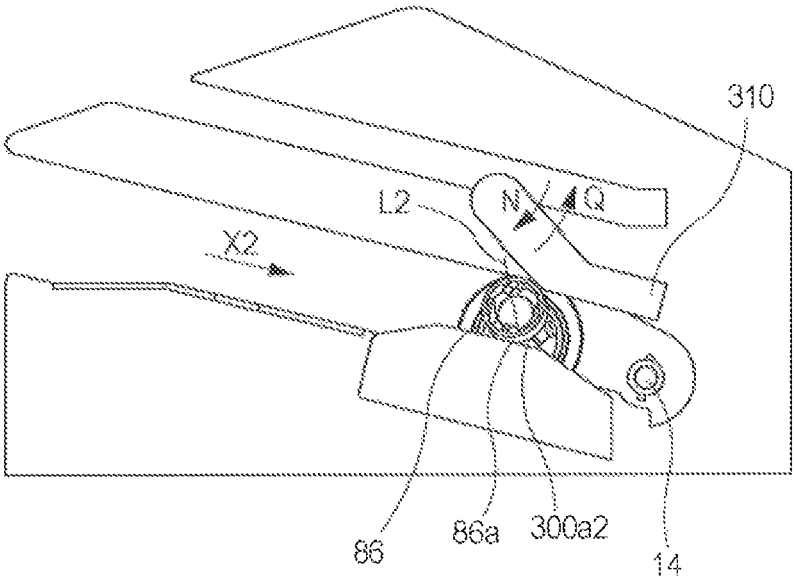

FIG. 36 shows a state in which the cartridge B has been further inserted in the direction X2. In this state, the free end portion 86*a* of the coupling member 86 is contacted to the upper guide 310. By this contact, the upper guide 310 rotates in the direction indicated by an arrow Q in the Figure, against the urging force of the spring in the direction of the arrow N in the Figure. As a result, the upper guide 310 takes a retracted position in which it is away from the movement path of the coupling member 86.

Figure 37:
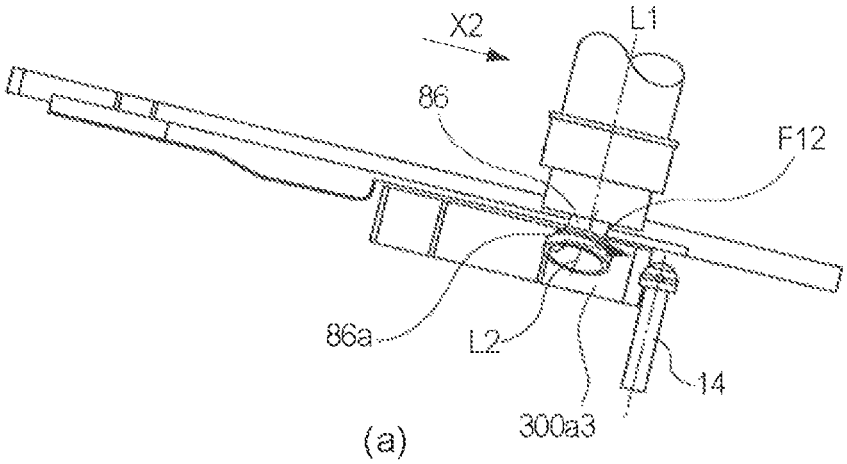
FIG. 37 is an illustration of cartridge mounting to the apparatus main assembly, according to the fifth embodiment of the present invention.
Figure 37:
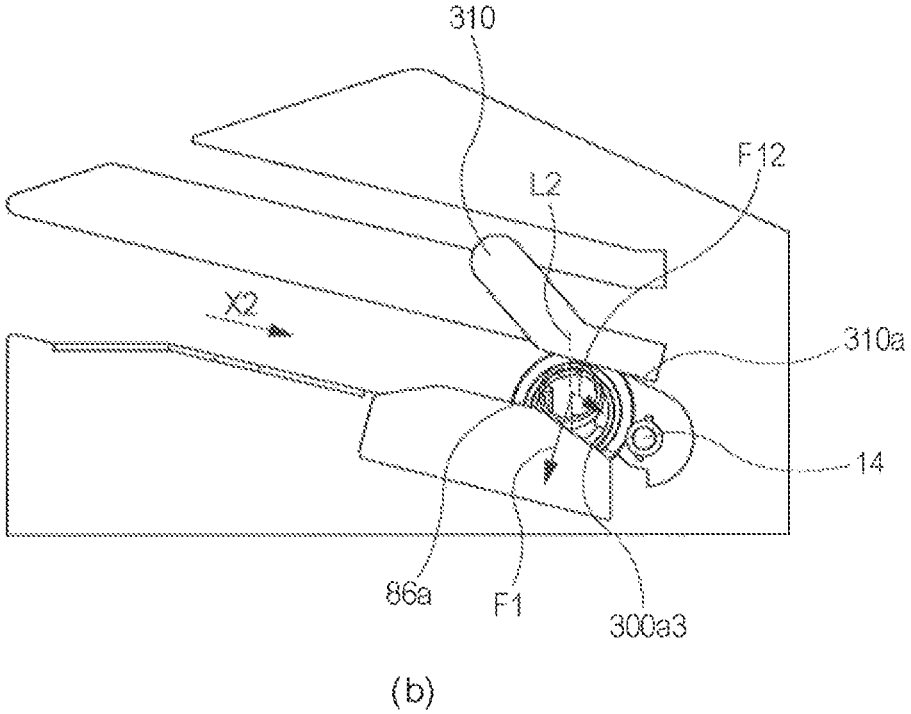

FIG. 37 shows a state in which the cartridge B has been further inserted in the direction X2. In this state, the free end portion 86*a* of the coupling member 86 is sandwiched between the third guide portion 300*a*3 of the lower guide 300*a* and the operating surface of the 310*a* upper guide 310. At this time, the free end portion 86*a* receives an urging force at operation surface 310*a* of the upper guide 310. Here, a component of the urging force F1 in the direction parallel with the third guide portion 300*a*3 is a component force F12. By the component force F12, the coupling member 86 is completely inclined (pivoted) toward the downstream with respect to the mounting direction (X2). In other words, by the restoration of the upper guide 310 from the retracted position to the operating position by the elastic force of the urging spring 315, the coupling member 86 is inclined (pivoted) toward the downstream with respect to the mounting direction (X2 direction).

Figure 39:
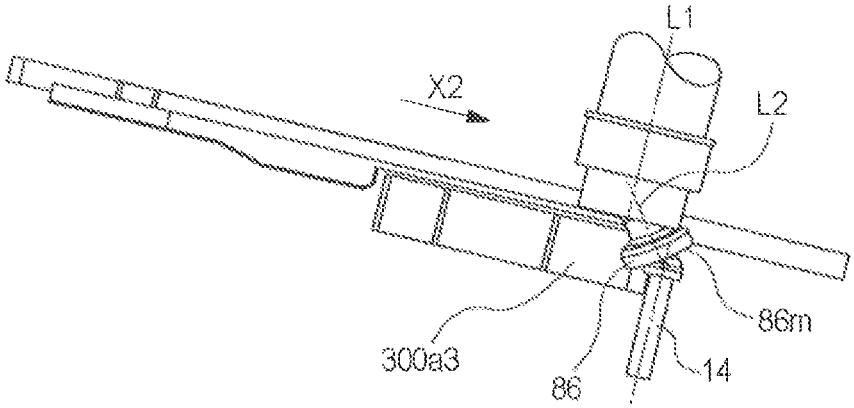
FIG. 39 is an illustration of cartridge mounting to the apparatus main assembly, according to the fifth embodiment of the present invention.
Figure 39:
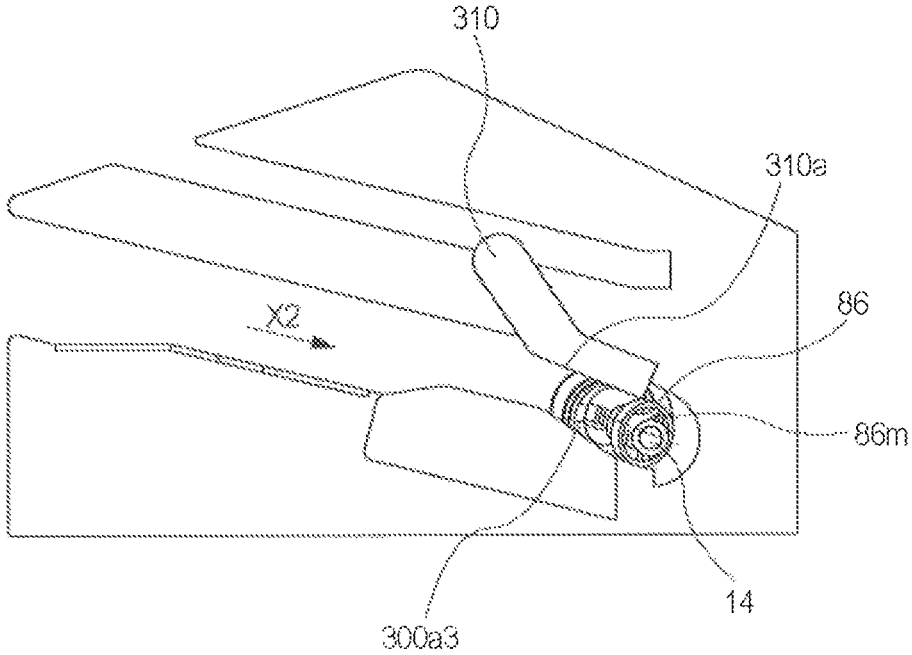

FIG. 39 shows a state in which the cartridge B has been further inserted in the direction X2. In this state, the opening 86*m* of the coupling member 86 is going to cover the main assembly side engaging portion 14.

Figure 40:
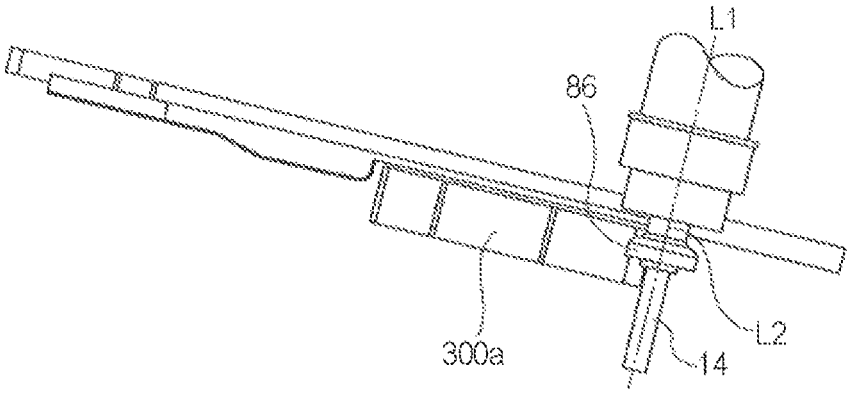
FIG. 40 is an illustration of cartridge mounting to the apparatus main assembly, according to the fifth embodiment of the present invention.
Figure 40:
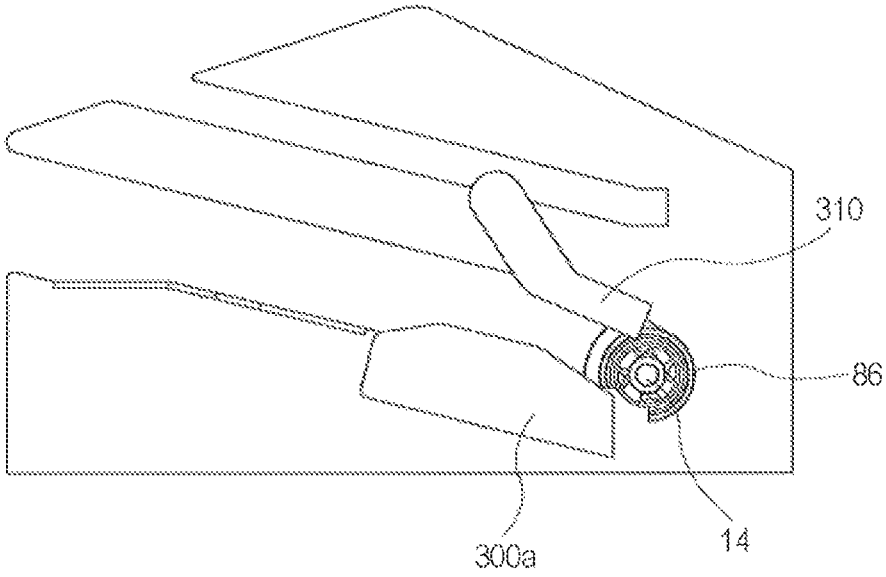

FIG. 40 shows a state in which as a result of the further insertion of the cartridge B, the cartridge B reaches the mounting completion position. At this time, the axis L1 of the drum 62, the axis L2 of the coupling member 86, the axis of the main assembly side engaging portion 14 are substantially coaxial with each other.

By the engagement between the coupling member 86 and the main assembly side engaging portion 14 in this manner, the transmission of the rotational force is possible.

As described in the foregoing, in this embodiment, when the coupling member 86 is inclined (pivoted) toward the downstream with respect to the mounting direction (direction X2), the force is applied to the coupling member 86 by the lower guide 300*a* provided in the main assembly A and the upper guide 310 provided in the main assembly A.

Therefore, even if the cartridge B shifts in the guiding rail in the direction perpendicular to the mounting direction, or it rotates about the rotational axis L1 of the drum 62, the coupling member 86 is inclined relative to the main assembly A substantially in the same direction. In other words, irrespective of the attitude of the cartridge B during the mounting process, the coupling member 86 tends to take and maintain substantially the same proper attitude relative to the main assembly A.

Thus, the stabilized engagement of the coupling member 86 with the main assembly side engaging portion 14 can be accomplished.

In addition, during the mounting operation of the cartridge B, the free end portion 86*a* of the coupling member 86 is pivoted upwardly (X3 direction) by the contact to the lower guide 300*a*, and in addition, it is pivoted toward the downstream with respect to the direction X2.

In this manner, the axis L2 of the coupling member 86 is pivoted so as to the approach to the axis L1 of drum 62 beforehand, and therefore, the pivoting amount of the coupling member 86 toward the downstream with respect to the direction X2 by the urging force F1 from the upper guide 310 can be reduced.

That is, the upper guide 310 which is a movable member can be downsized.

By doing so, the latitude in the design is improved, and the parts can be downsized, and the cost can be decreased.

When the cartridge B is dismounted from the main assembly A, the coupling member 86 is inclined (pivoted) relative to the axis L1 in the opposite direction, so that the coupling member 86 is disengaged from the main assembly side engaging portion 14.

In this embodiment, the upper guide 310 spaced from the coupling member 86 when the cartridge B is in the mounting completion position. By doing so, the increase of the rotational load for coupling member 86 by the contact with the upper guide 310 is prevented. In the foregoing description, the function, the material, the configuration, the relative positions of the constituent elements of this embodiment are not restrictive to the present invention. The apparatus main assembly of this embodiment is usable with the coupling member and the rotational force transmitted member of Embodiments 2-4.

Embodiment 6

Embodiment 6 of the present invention will be described in conjunction with the drawings.

The portions different from Embodiment 5 will be described in detail. The material, the configurations and so on are similar to those of Embodiment 5 unless otherwise described. $ with respect to the common structures, the same reference numerals and characters are assigned, and the detailed description thereof are omitted.

Figure 41:
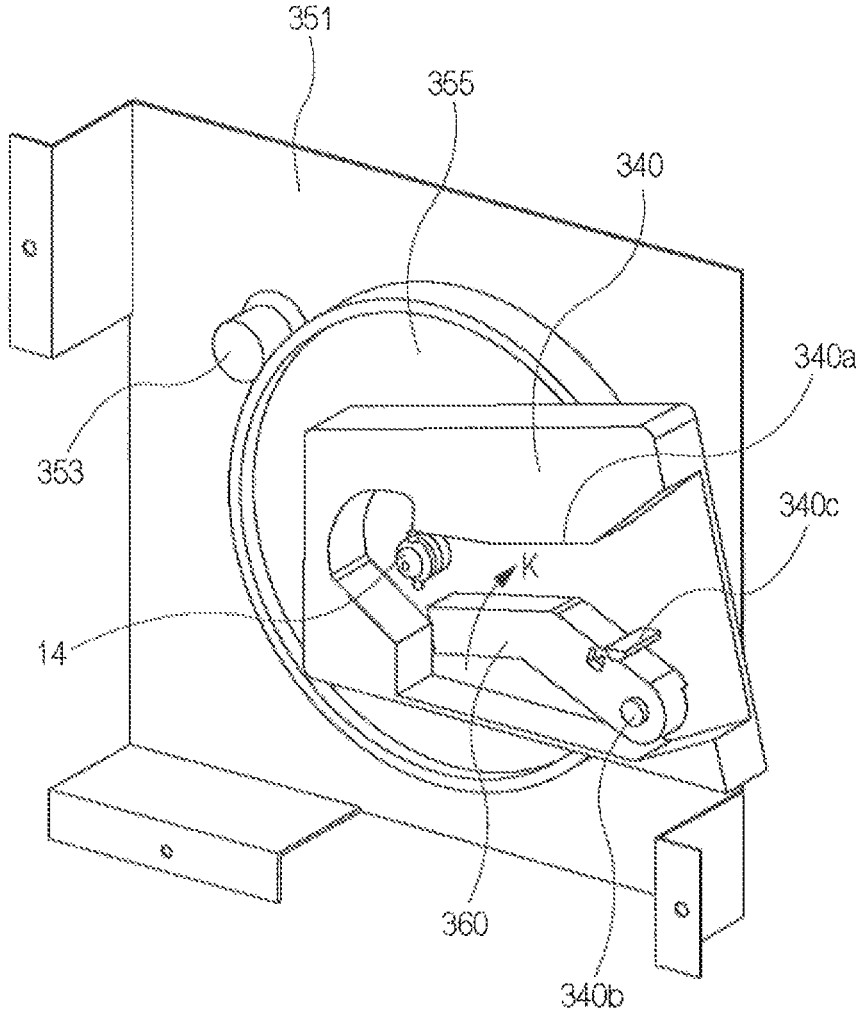
FIG. 41 is an enlarged view of a part of a driving portion of an apparatus main assembly, according to a sixth embodiment of the present invention.

Referring to FIG. 41, this embodiment will be described. FIG. 41 is an enlarged view of a part of the driving portion. Embodiment is different from Embodiment 1 in the structure of the main assembly A for inclining (pivoting) the coupling member 86.

As shown in FIG. 41, the holder 340 is provided with an upper guide 340*a*, a rotational shaft 340*b* and a stopper 340*c*. The rotational shaft 340*b* is provided with the rotatably lower guide 360 as a second guide (movable guide), which is urged by an urging spring (unshown) in the direction indicated by an arrow K in the Figure. At this time, the lower guide 360 contacts the stopper 340*c*, by which the position thereof is determined with respect to the direction of the arrow in the Figure. The upper guide 340*a* is provided with a projection projecting toward the lower guide 360.

Referring to FIG. 42-FIG. 48, the mounting of the cartridge B to the apparatus main assembly A while the coupling member 86 is inclining. FIG. 42-FIG. 48 illustrate the process of mounting of the cartridge B to the main assembly A. Parts (b) of FIG. 42-FIG. 48 are schematic Figures of the mounting process as seen from the outside (side surface) of the main assembly A, parts (a) of FIG. 42-FIG. 48 are schematic Figures in the direction along the arrow M of part (b) of FIG. 42. Some parts are omitted for better illustration.

Figure 42:
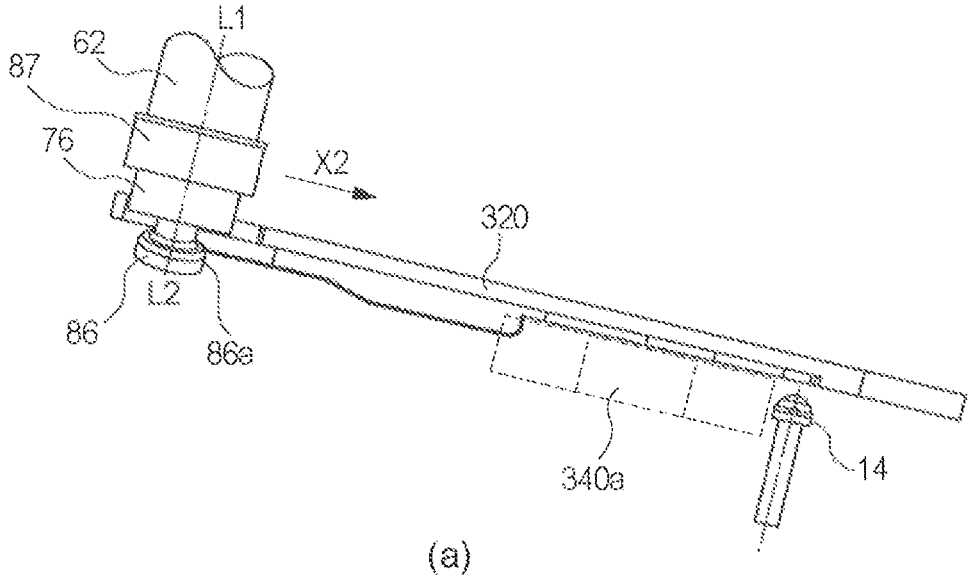
FIG. 42 is an illustration of cartridge mounting to an apparatus main assembly, according to the sixth embodiment of the present invention.
Figure 42:
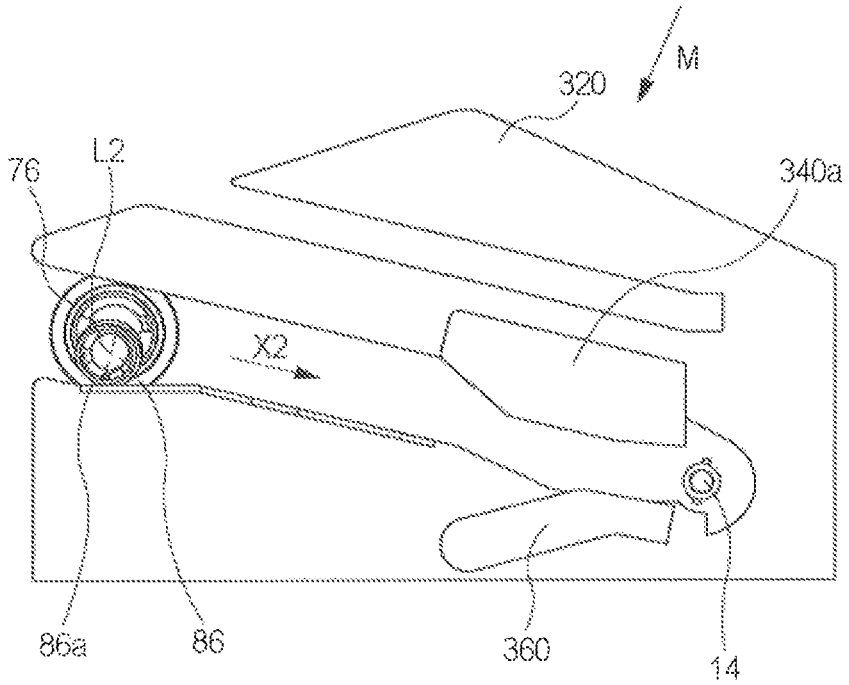

FIG. 42 shows the state of the beginning of the mounting of the cartridge B to the main assembly A. At this time, the coupling member 86 is inclined downwardly. At this time, a part of the lower guide 360 is in the movement path of the coupling member 86 (operating position).

Figure 43:
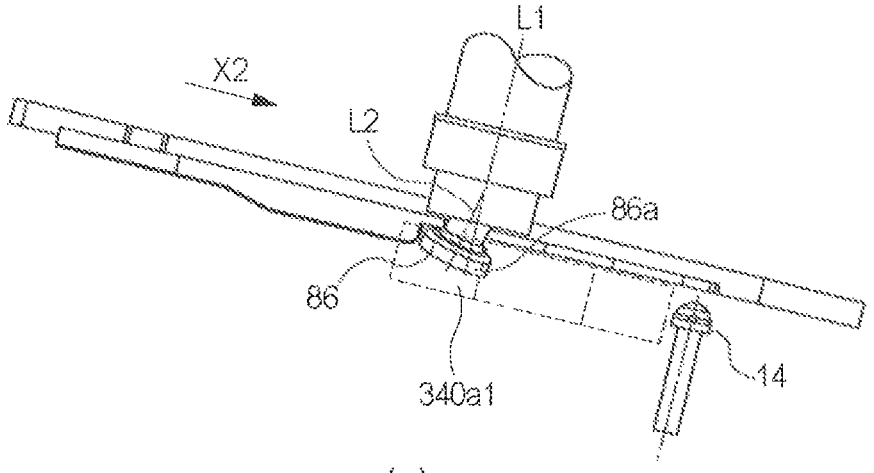
FIG. 43 is an illustration of cartridge mounting to an apparatus main assembly, according to the sixth embodiment of the present invention.
Figure 43:
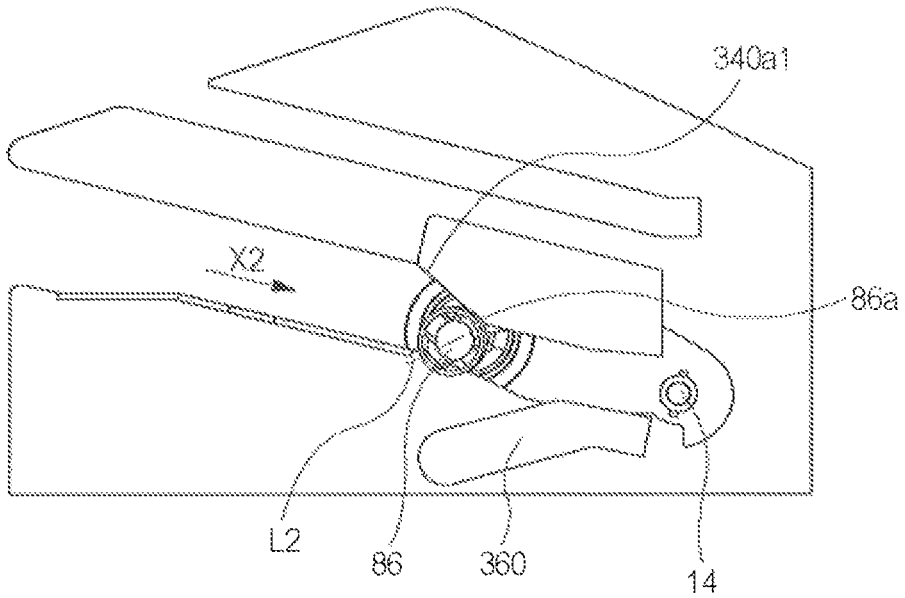

FIG. 43 shows the state thereafter, in which the cartridge B is inserted in the direction of an arrow X2 in the Figure. That is, the free end portion 86*a* of the coupling member 86 contacts the first guide portion 340*a*1 of the upper guide 340*a* of the holder 340. By this, the coupling member 86 inclines in the direction opposite to the mounting direction.

Figure 44:
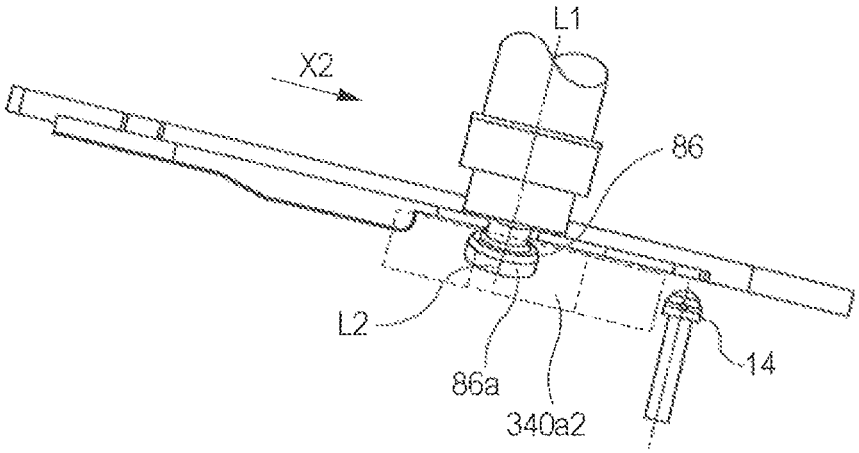
FIG. 44 is an illustration of cartridge mounting to an apparatus main assembly, according to the sixth embodiment of the present invention.
Figure 44:
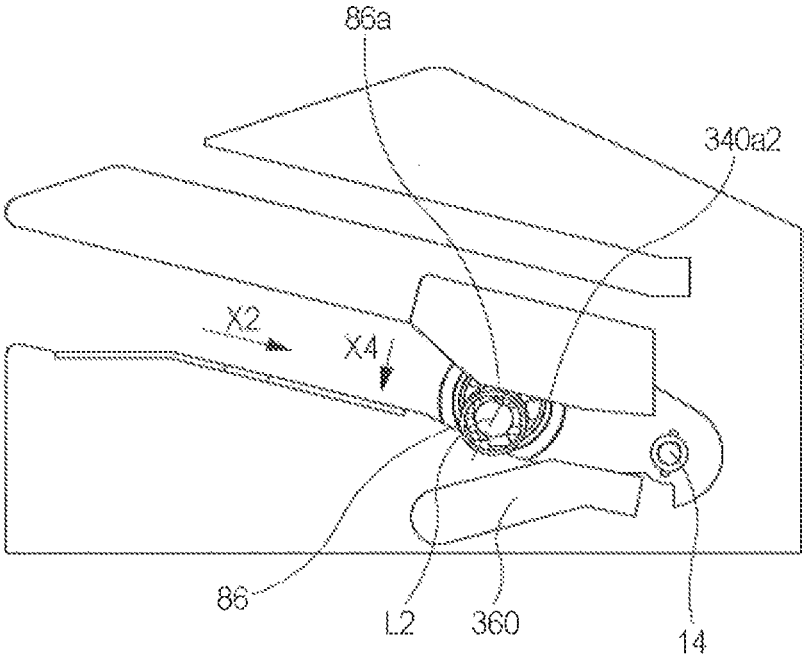

FIG. 44 shows the state thereafter, in which when the cartridge B this is further inserted in the direction X2, the free end portion 86*a* of the coupling member 86 contacts the second guide portion 340*a*2 of the upper guide 340*a*, so that the coupling member 86 inclines in the direction indicated (pivoted) by the arrow X4 in the Figure. That is, the coupling member 86 inclines (pivots) toward the lower guide 360 (downward).

At this time, the coupling member 86 makes a whirling motion, and as seen from the top (part (a) of FIG. 44), the axis L2 pivots so as to substantially align with the axis L1.

More particularly, in the movement from the state of FIG. 43 to the state of FIG. 44, the coupling member 86 effects the inclination (pivoting) motion in the direction of X3 and also the inclination (pivoting) motion toward the downstream with respect to the direction X2.

Therefore, even when the coupling member 86 is inclined (pivoted) toward the upstream (opposed to the direction X2) with respect to the mounting direction due to the friction with another member or the like, the coupling member 86 is inclined toward the downstream with respect to the ejection X2 so as to align the axis L2 with the axis L1 by the contact to the second guide portion 340*a*2 of the upper guide 340*a*. In other words, as seen from the top, the coupling member 86 is moved by the contact to the second guide portion 340*a*2 so that the inclination amount of the axis L2 relative to the axis L1 decreases.

Figure 45:
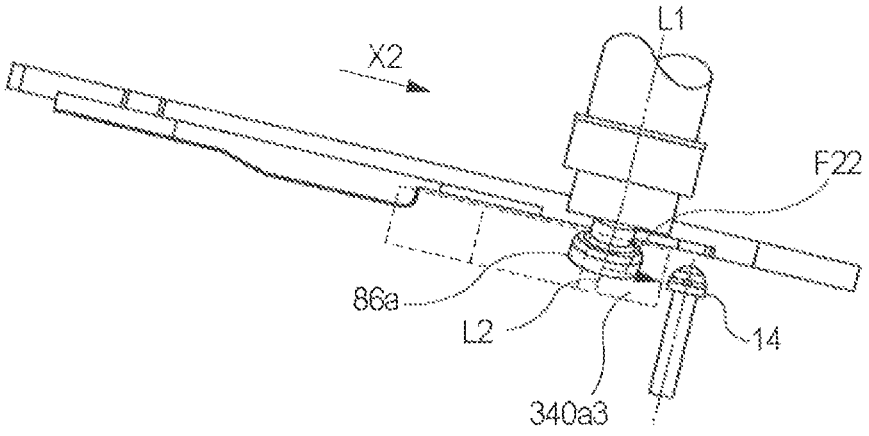
FIG. 45 is an illustration of cartridge mounting to an apparatus main assembly, according to the sixth embodiment of the present invention.
Figure 45:
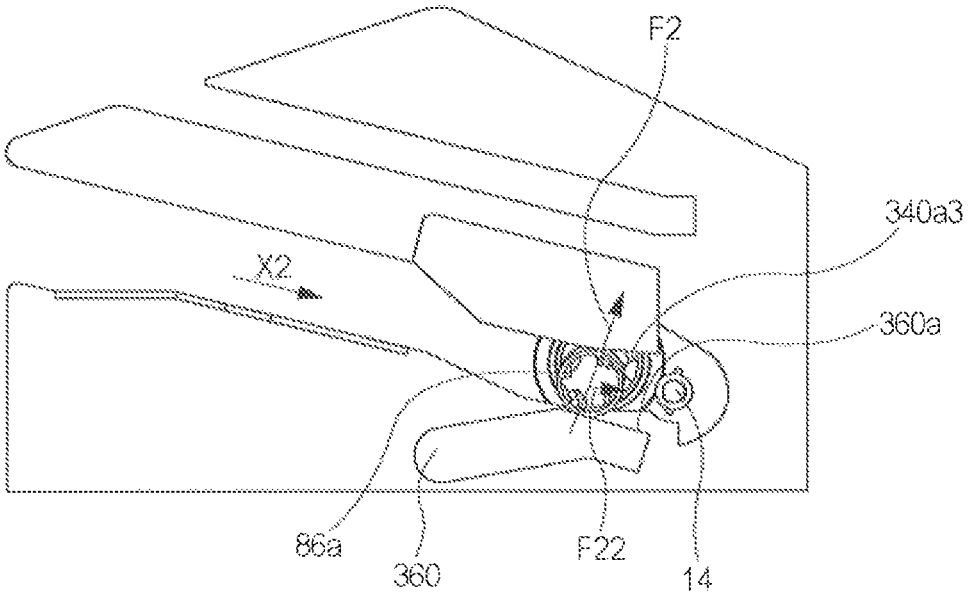
Figure 46:
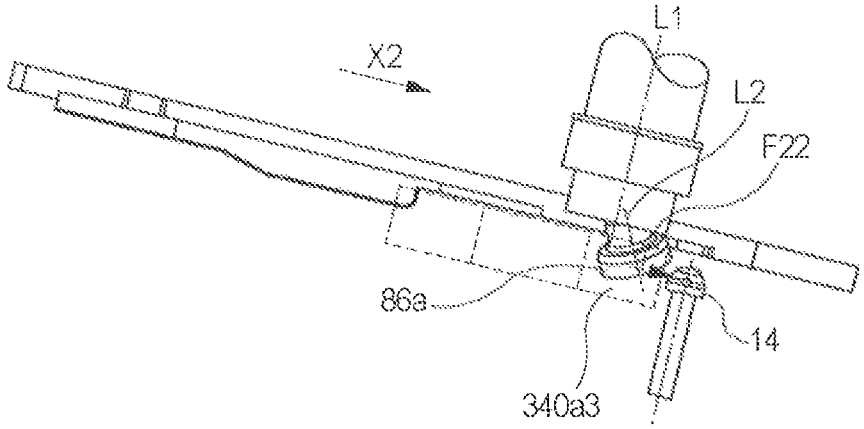
FIG. 46 is an illustration of cartridge mounting to an apparatus main assembly, according to the sixth embodiment of the present invention.
Figure 46:
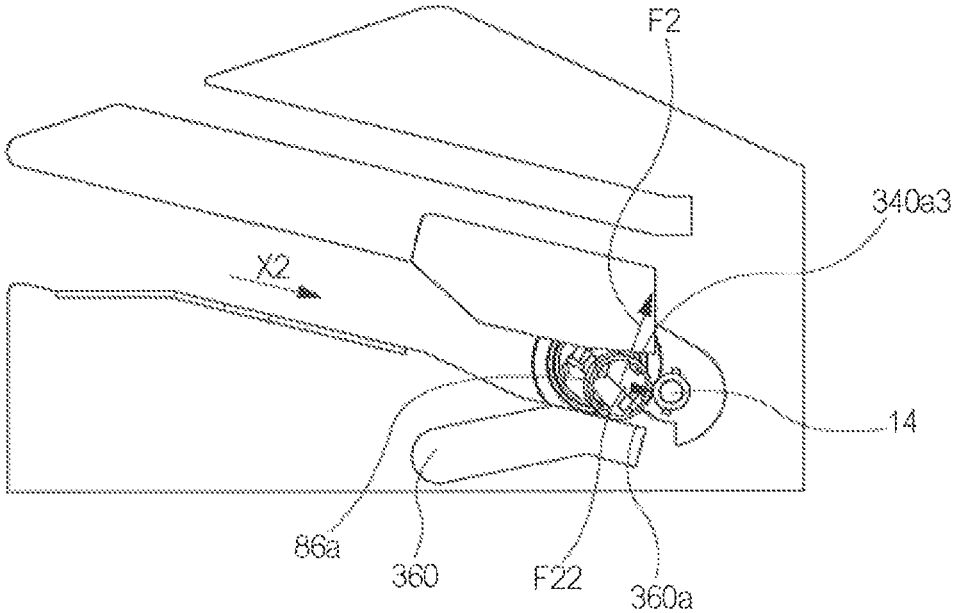

FIG. 45 shows a state in which the cartridge B has been further inserted in the direction X2. That is, the free end portion 86*a* of the coupling member 86 it sandwiched between the third guide portion 340*a*3 of the upper guide 340*a* and the operating surface 360*a* of the lower guide 360. At this time, the free end portion 86*a* receives the urging force F2 from the operating surface 360*a* of the lower guide 360. At this time, the component of the urging force F2 in the direction parallel with the third guide portion 340*a*3 is a component force F22. By the component force F22, the coupling member 86 is completely inclined (pivoted) toward the downstream with respect to the mounting direction (X2). In other words, by the restoration of the lower guide 360 by the elastic force from the retracted position to the operating position, the coupling member 86 is inclined (pivoted) toward the downstream with respect to the mounting direction (direction X2).

Figure 47:
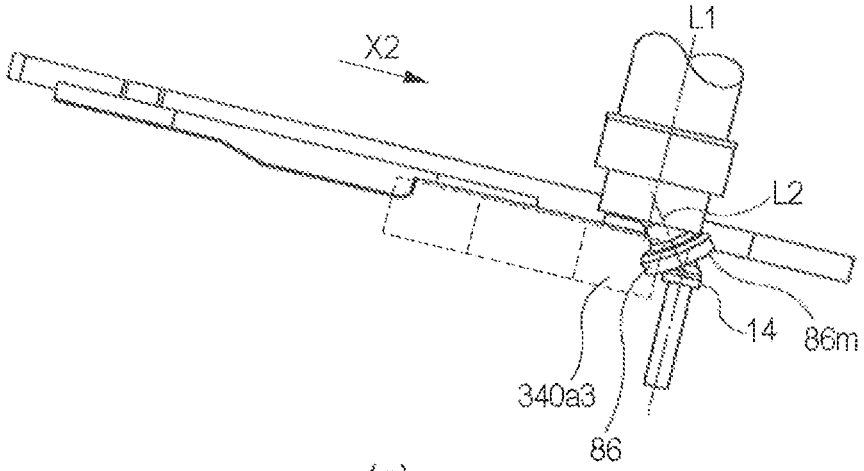
FIG. 47 is an illustration of cartridge mounting to an apparatus main assembly, according to the sixth embodiment of the present invention.
Figure 47:
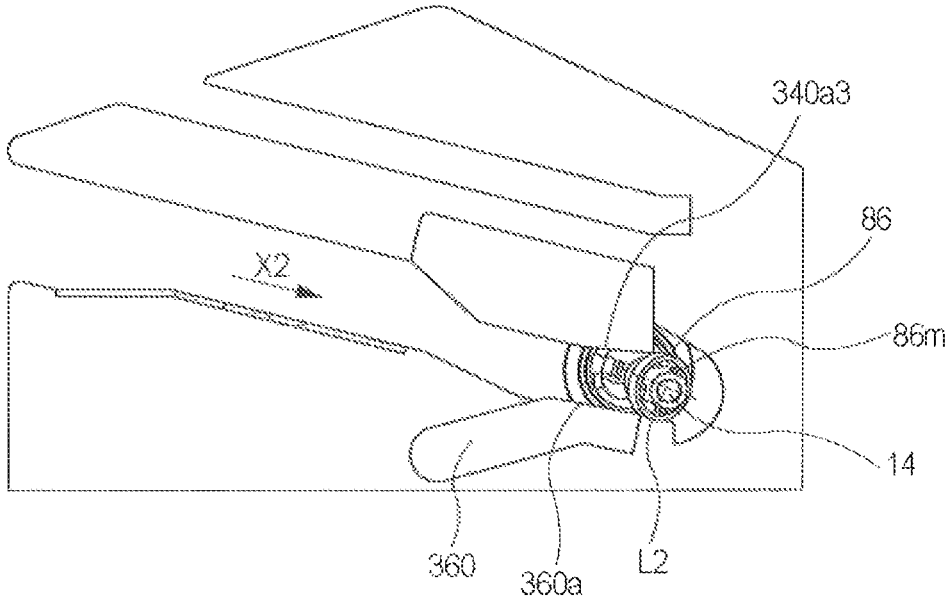

FIG. 47 shows a state in which the cartridge B has been further inserted in the direction X2. In this state, the opening 86*m* of the coupling member 86 is going to cover the main assembly side engaging portion 14.

Figure 48:
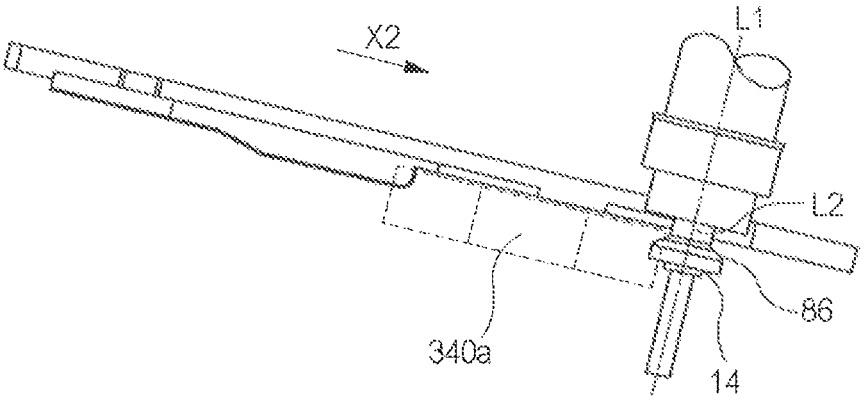
FIG. 48 is an illustration of cartridge mounting to an apparatus main assembly, according to the sixth embodiment of the present invention.
Figure 48:
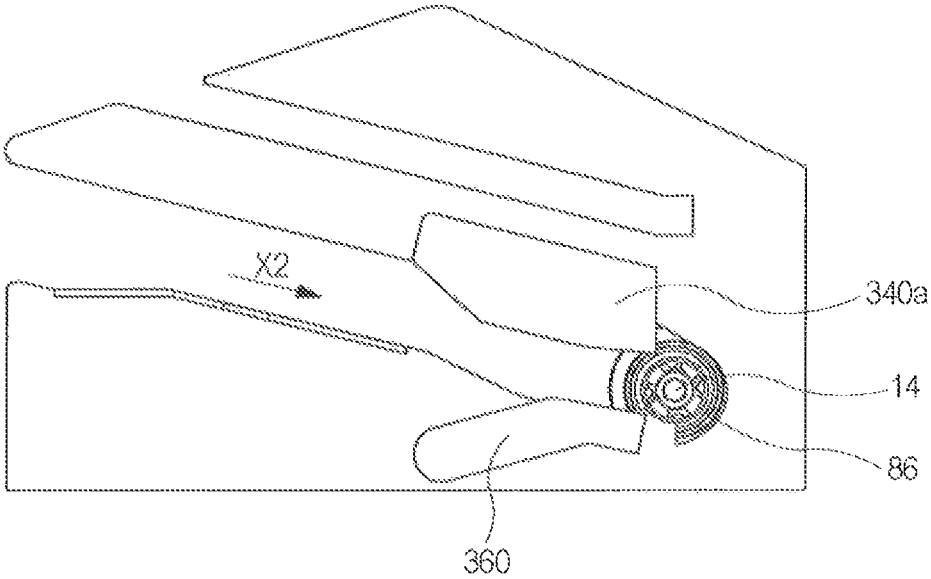

FIG. 48 shows a state in which as a result of the further insertion of the cartridge B, the cartridge B reaches the mounting completion position. At this time, the axis L1 of the drum 62, the axis L2 of the coupling member 86, the axis of the main assembly side engaging portion 14 are substantially coaxial with each other.

By the engagement between the coupling member 86 and the main assembly side engaging portion 14 in this manner, the transmission of the rotational force is possible.

As described in the foregoing, with this structure, when the coupling member 86 is inclined (pivoted) toward the downstream with respect to the mounting direction (direction X2), the force is applied to the coupling member 86 by the upper guide 340*a* provided in the main assembly A and the lower guide 360 provided in the main assembly A.

Therefore, even if the cartridge B shifts in the guiding rail in the direction perpendicular to the mounting direction, or it rotates about the rotational axis L1 of the drum 62, the coupling member 86 is inclined relative to the main assembly A substantially in the same direction. In other words, irrespective of the attitude of the cartridge B during the mounting process, the coupling member 86 tends to take and maintain substantially the same proper attitude relative to the main assembly A.

Thus, the stabilized engagement of the coupling member 86 with the main assembly side engaging portion 14 can be accomplished.

In addition, during the mounting operation of the cartridge B, the free end portion 86*a* of the coupling member 86 is pivoted downwardly (X3 direction) by the contact to the upper guide 340*a*, and in addition, it is pivoted toward the downstream with respect to the direction X2.

In this manner, the coupling member is inclined (pivoted) beforehand toward the downstream with respect to the direction so as to align the axis L2 with the axis L1. Therefore, the inclination (pivoting) angle of the coupling member 86 toward the downstream with respect to the direction X2 by the urging force F2 from the lower guide 360 can be reduced.

That is, the lower guide 360 which is a movable member can be downsized.

By doing so, the latitude in the design is improved, and the parts can be downsized, and the cost can be decreased.

When the cartridge B is dismounted from the main assembly A, the coupling member 86 is inclined (pivoted) relative to the axis L1 in the opposite direction, so that the coupling member 86 is disengaged from the main assembly side engaging portion 14.

In this embodiment, the lower guide 360 spaced from the coupling member 86 when the cartridge B is in the mounting completion position. By doing so, the increase of the rotational load for coupling member 86 by the contact with the lower guide 360 is prevented.

In the foregoing description, the function, the material, the configuration, the relative positions of the constituent elements of this embodiment are not restrictive to the present invention. The apparatus main assembly of this embodiment is usable with the coupling member and the rotational force transmitted member of Embodiments 2-4.

Embodiment 7

Embodiment 7 of the present invention will be described in conjunction with the drawings.

The portions different from Embodiment 5 will be described in detail. The material, the configurations and so on are similar to those of Embodiment 5 unless otherwise described. With respect to the common structures, the same reference numerals and characters are assigned, and the detailed description thereof are omitted.

Embodiment is different from Embodiment 5 in that the coupling member 86 of the main assembly A is inclined (pivoted).

Figure 49:
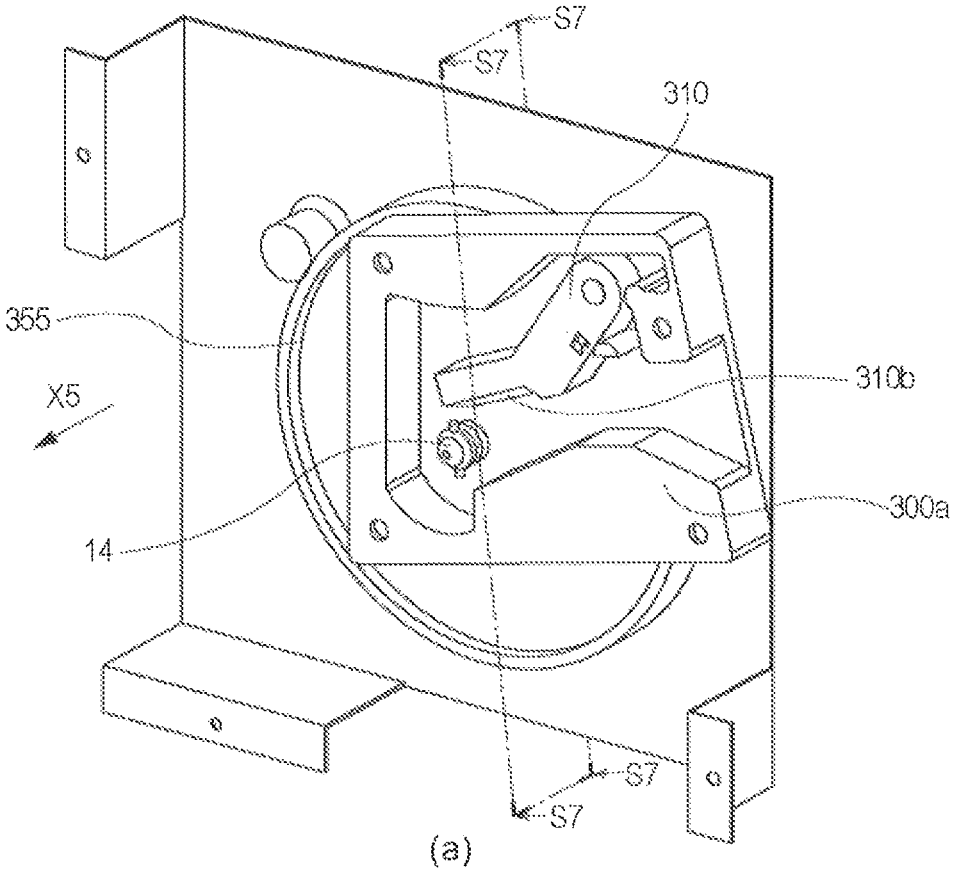
FIG. 49 is an enlarged view of a part of a driving portion of an apparatus main assembly, according to a seventh embodiment of the present invention.
Figure 49:
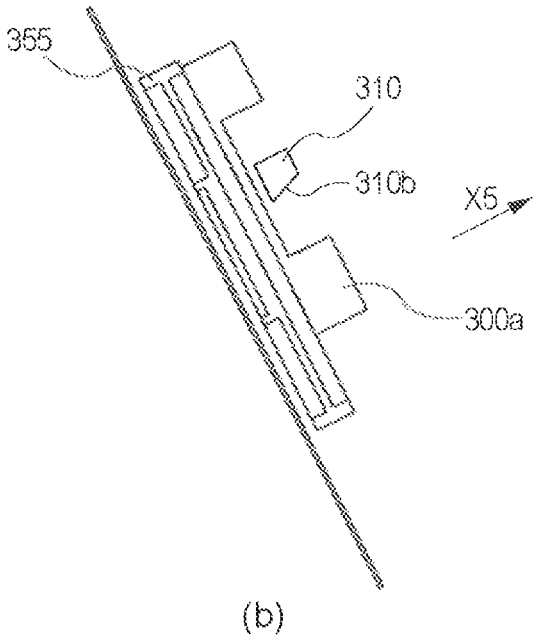

Part (a) of FIG. 49 is a perspective view of a driving portion, part (b) of FIG. 49 is a sectional view taken along a plane S7 of part (a) of FIG. 49.

As shown in parts (a) and (b) of FIG. 49, an upper guide 310 as a second guide (movable guide) is provided with an inclined surface 310*b* such that a distance from the lower guide 300*a* increases toward the inside of the main assembly A (direction of an arrow X5 in the Figure).

Figure 51:
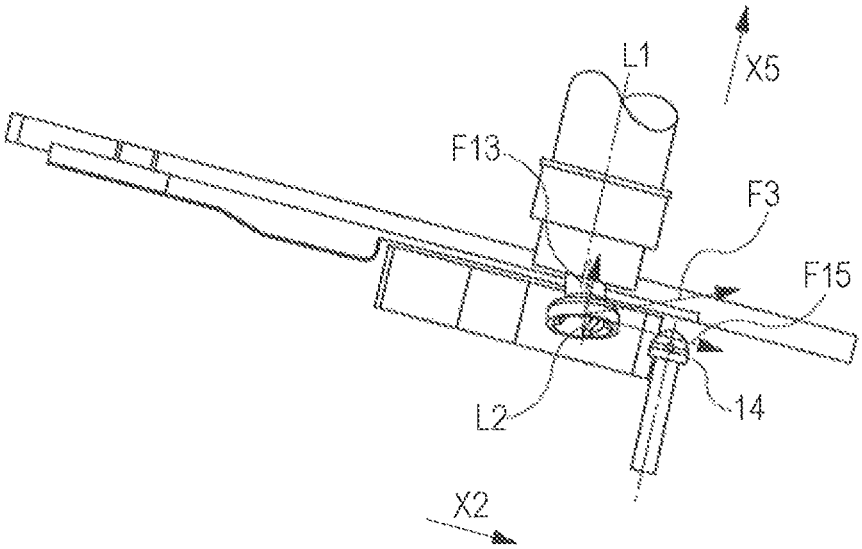
FIG. 51 is an illustration of cartridge mounting to the apparatus main assembly, according to the seventh embodiment of the present invention.

The description will be made as to the operation when and after the free end portion 86*a* of the coupling member 86 is sandwiched between the lower guide 300*a* and the upper guide 310, and it inclines (pivots) toward the downstream (direction X2) with respect to the mounting direction beyond the axis L1 of the drum 62 (FIG. 51).

Figure 50:
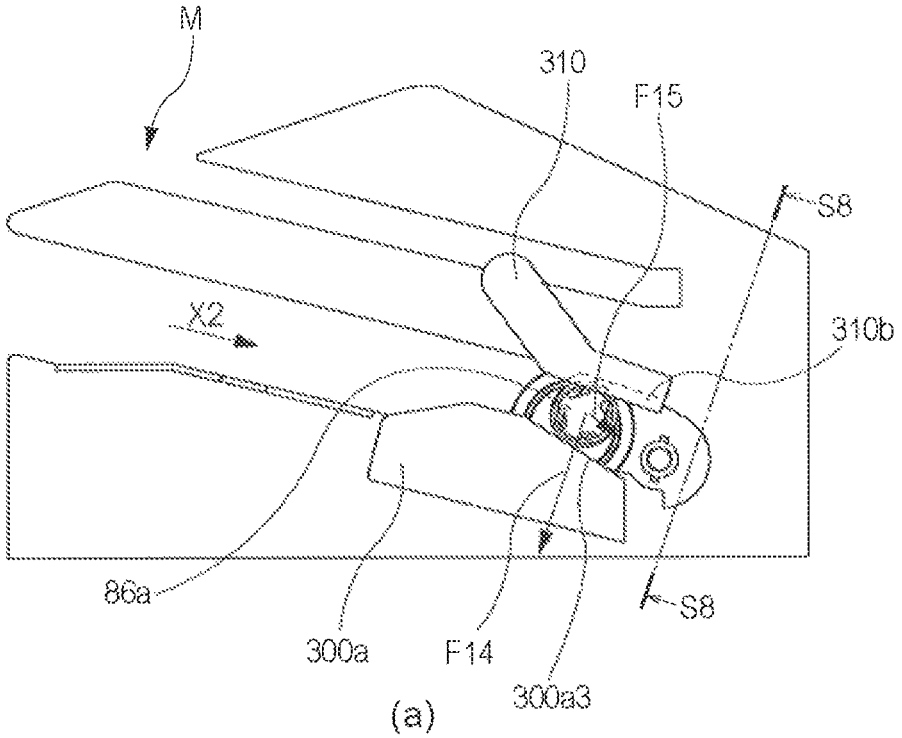
FIG. 50 is an illustration of cartridge mounting to the apparatus main assembly, according to the seventh embodiment of the present invention.
Figure 50:
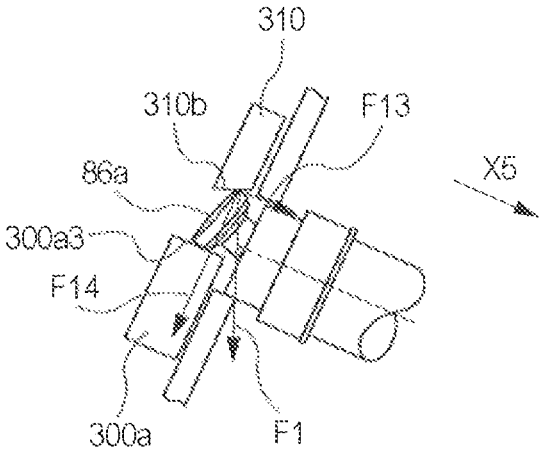

Part (a) of FIG. 50 is a schematic illustration of the mounting of the cartridge B as seen from the outside of the main assembly A, part (b) of FIG. 50 is a schematic sectional view taken along a plane S8 of part (a) of FIG. 50, FIG. 51 is a schematic view as seen along a direction indicated by an arrow M of part (a) of FIG. 50. Some parts are omitted for better illustration.

As shown in FIG. 50, the free end portion 86*a* of the coupling member 86 is contacted by and is sandwiched between the third guide portion 300*a*3 of the lower guide 300*a* and the inclined surface 310*b* of the upper guide 310.

At this time, as shown in part (b) of FIG. 50, the free end portion 86*a* receives an urging force F1 in the direction perpendicular to the surface from the inclined surface 310*b* of the upper guide 310. This figure shows a component force F13 of the urging force F1 in the inward direction (direction X5) and a component force F14 in the direction perpendicular thereto.

Part (a) of FIG. 50 shows a component force F15 of the component force F14 (applied to the free end portion 86*a*) in the direction parallel with the third guide portion 300*a*3.

As shown in FIG. 51, to the free end portion 86*a* a resultant force F3 of the component force F15 and the component force F13 is applied, and the resultant force F3 inclines (pivots) the coupling member 86 toward the downstream with respect to the mounting direction (direction X2).

With respect to the inclination (pivoting) of the coupling member 86, when the force applied to the free end portion 86*a* is directed perpendicularly to the axis L2 of the coupling member 86, the moment of inclining (pivoting) the coupling member 86 about the rotation axis (FIG. 11) is large so that the inclination (pivoting) is properly accomplished.

As shown in FIG. 51, as compared with the resultant force (F12 *a* FIGS. 37 and 38) wherein the component force F13 does not apply, the resultant force F3 in this embodiment is closer to the direction perpendicular to the axis L2 of the coupling member 86. In this manner, the coupling member 86 receives a large moment for inclining (pivoting) about the rotation axis, and therefore, the coupling member 86 can be stably inclined (pivoted) toward the downstream with respect to the mounting direction (direction X2).

When the cartridge B is further inserted in the direction X2, the coupling member 86 is engaged with the main assembly side engaging portion 14.

As described herein before, with this structure, the engagement between the coupling member 86 and the main assembly side engaging portion 14 is stabilized.

Figure 52:
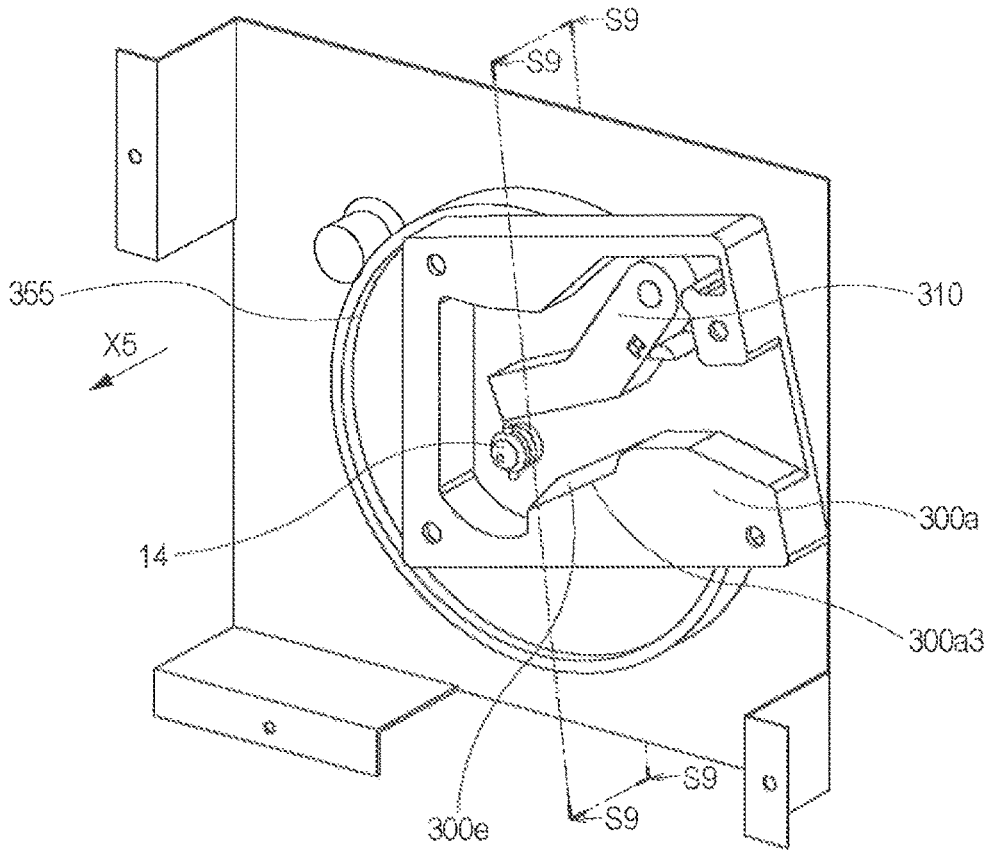
FIG. 52 is an enlarged view of a part of a driving portion of an apparatus main assembly, according to the seventh embodiment of the present invention.
Figure 52:
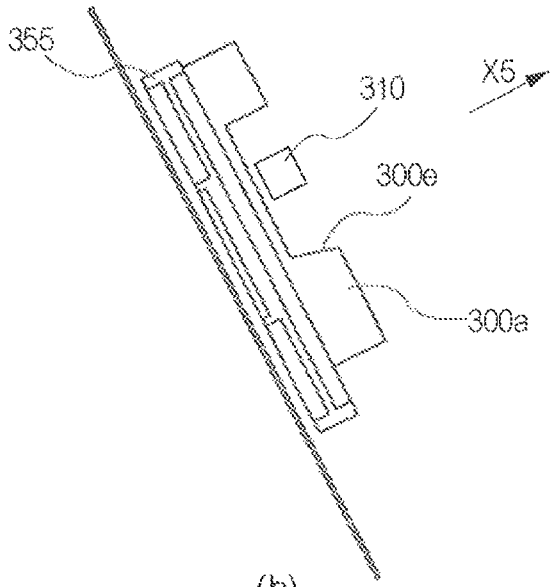

As shown in FIG. 52, the third guide portion 300*a*3 of the lower guide 300*a* may be provided with an inclined surface 300*e* such that the distance from the upper guide 310 increases toward the inside of the main assembly A (direction indicated by the arrow X5 in the Figure).

Part (a) of FIG. 52 is a perspective view of a driving portion, part (b) of FIG. 52 is a sectional view taken along a plane S7 of part (a) of FIG. 52.

Figure 54:
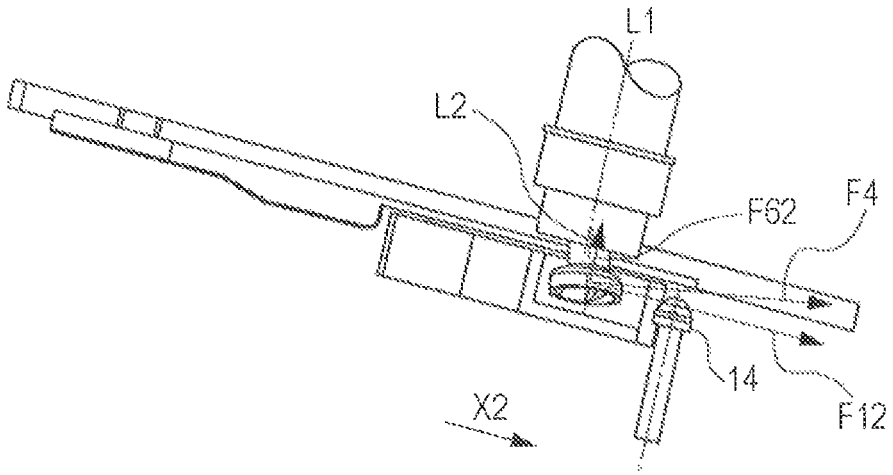
FIG. 54 is an illustration of cartridge mounting to the apparatus main assembly, according to the seventh embodiment of the present invention.

The description will be made as to the operation when and after the free end portion 86*a* of the coupling member 86 is sandwiched between the lower guide 300*a* and the upper guide 310, and it inclines (pivots) toward the downstream (direction X2) with respect to the mounting direction beyond the axis L1 of the drum 62 (FIG. 54).

Figure 53:
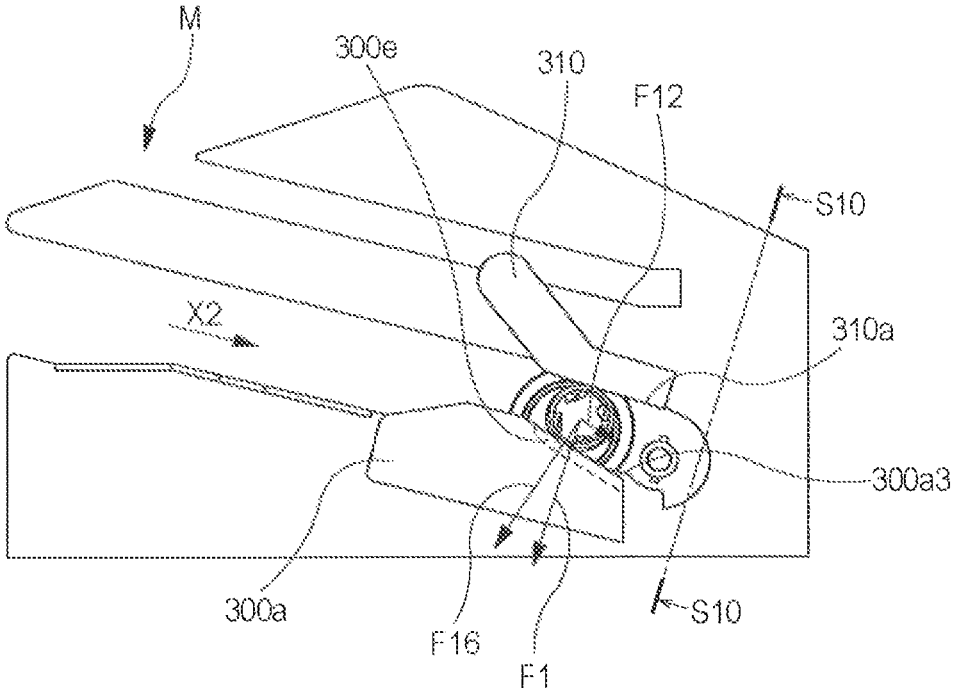
FIG. 53 is an illustration of cartridge mounting to the apparatus main assembly, according to the seventh embodiment of the present invention.
Figure 53:
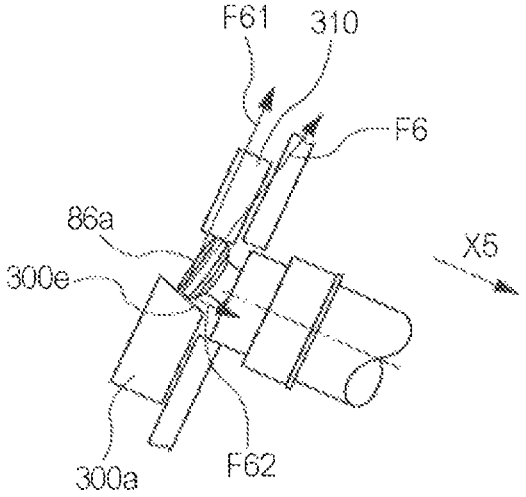

Part (a) of FIG. 53 is a schematic illustration of the mounting as seen from the outside of the main assembly A, part (b) of FIG. 53 is a schematic sectional view taken along a plane S10 of part (a) of FIG. 53, and FIG. 54 is a schematic view as seen along the arrow M of part (a) of FIG. 53. Some parts are omitted for better illustration.

As shown in FIG. 53, the free end portion 86*a* of the coupling member 86 is sandwiched by the inclined surface 300*e* of the third guide portion 300*a*3 of the lower guide 300*a* and the operating surface 310*a* of the upper guide 310.

As shown in part (a) of FIG. 53, the free end portion 86*a* receives an urging force F1 from the operating surface 310*a* of the upper guide 310. In this Figure, the component, in the direction parallel with the third guide portion 300*a*3, of the urging force F1 is a component force F12. A component, in the direction perpendicular to the third guide portion 300*a*3, of the urging force F1 is a component force F16.

As shown in part (b) of FIG. 53, from the inclined surface 300*e* of the lower guide 300*a*, a force F6 applies perpendicularly to the surface. This figure shows a component force F62 of the force F6 toward the inside of the main assembly Ad a component force F61 perpendicular thereto.

Here, F61 is a reaction force corresponding to F16.

As shown in FIG. 54, the free end portion 86*a* receives a resultant force F4 of the component force F12 and the component force F62, and the resultant force F4 inclines (pivots) the coupling member 86 toward the downstream with respect to the mounting direction (direction X2).

Figure 38:
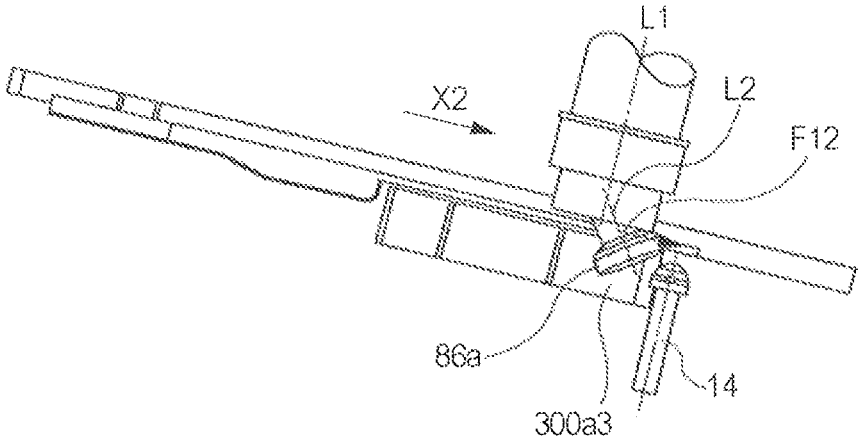
FIG. 38 is an illustration of cartridge mounting to the apparatus main assembly, according to the fifth embodiment of the present invention.
Figure 38:
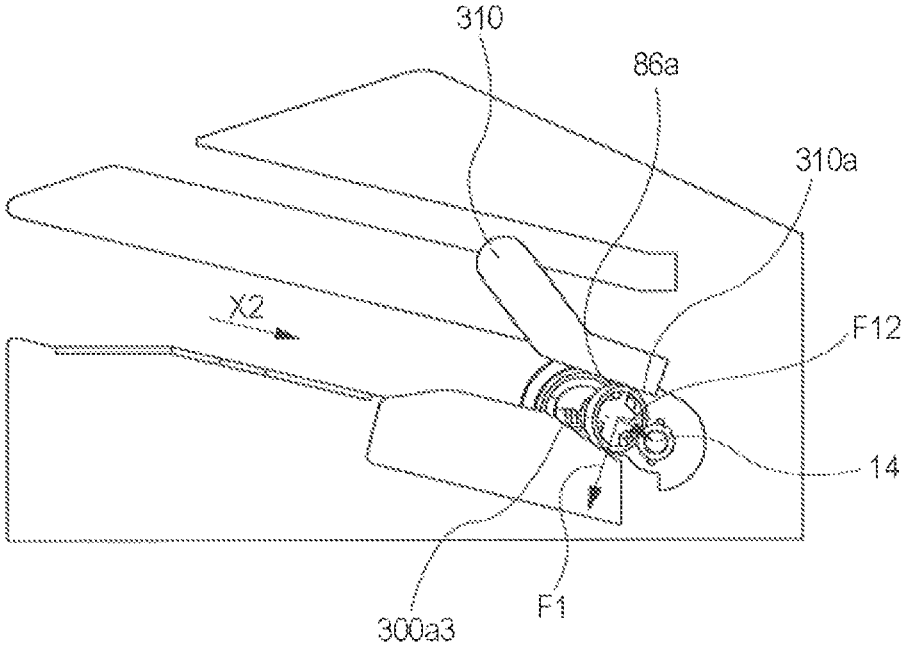

As shown in FIG. 54, the resultant force F4 in this embodiment is closer to the axis L2 of the coupling member 86 as compared with the case in which the component force F62 does not apply (F12 in FIGS. 37 and 38). Therefore, a large moment of inclining (pivoting) about the rotation axis is applied to the coupling member 86. Therefore, the coupling member 86 can be stably inclined (pivoted) toward the downstream with respect to the mounting direction (direction X2).

When the cartridge B is further inserted in the direction X2, the coupling member 86 is engaged with the main assembly side engaging portion 14.

As described above, with this structure, a further stabilized engagement is established between the coupling member 86 and the main assembly side engaging portion 14.

Figure 55:
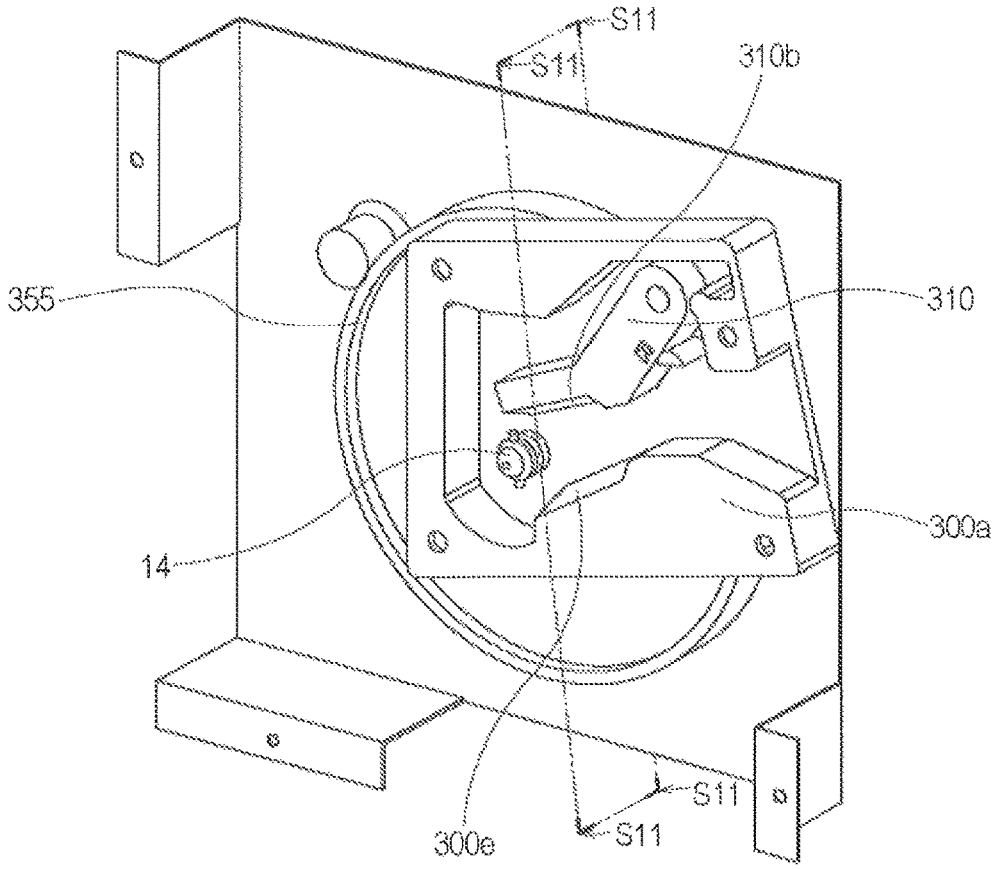
FIG. 55 is an enlarged view of a part of a driving portion of an apparatus main assembly, according to the seventh embodiment of the present invention.
Figure 55:
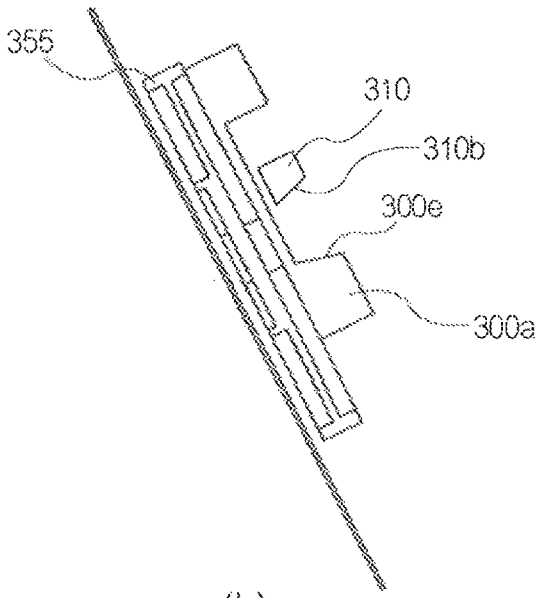

Furthermore, as shown in FIG. 55, both of the inclined surface 310*b* and the inclined surface 300*e* may be provided.

Part (a) of FIG. 55 is a perspective view of a driving portion, part (b) of FIG. 55 is a sectional view taken along a plane S11 of part (a) of FIG. 55.

With such a structure, the component force F13 from the inclined surface 310*b* and the component force F62 from the inclined surface 300*e* are simultaneously applied, so that the coupling member 86 can be stably inclined (pivoted) toward the downstream with respect to the mounting direction (direction X2). Therefore, a stabilized engagement between the coupling member 86 and the main assembly side engaging portion 14 can be accomplished.

The applied forces are the same as those described herein before, and the descriptions thereof is omitted.

In the foregoing description, the function, the material, the configuration, the relative positions of the constituent elements of this embodiment are not restrictive to the present invention. The apparatus main assembly of this embodiment is usable with the coupling member and the rotational force transmitted member of Embodiments 2-4.

Embodiment 8

Embodiment 8 of the present invention will be described in conjunction with the drawings.

With respect to this embodiment, the portions different from the foregoing embodiment will be described in detail. The material, the configuration and so on in this embodiment are the same as in the foregoing embodiment, unless otherwise described. With respect to the common structures, the same reference numerals and characters are assigned, and the detailed description thereof are omitted.

This embodiment is different from Embodiment 7 in the structure of the inclined surface.

Figure 56:
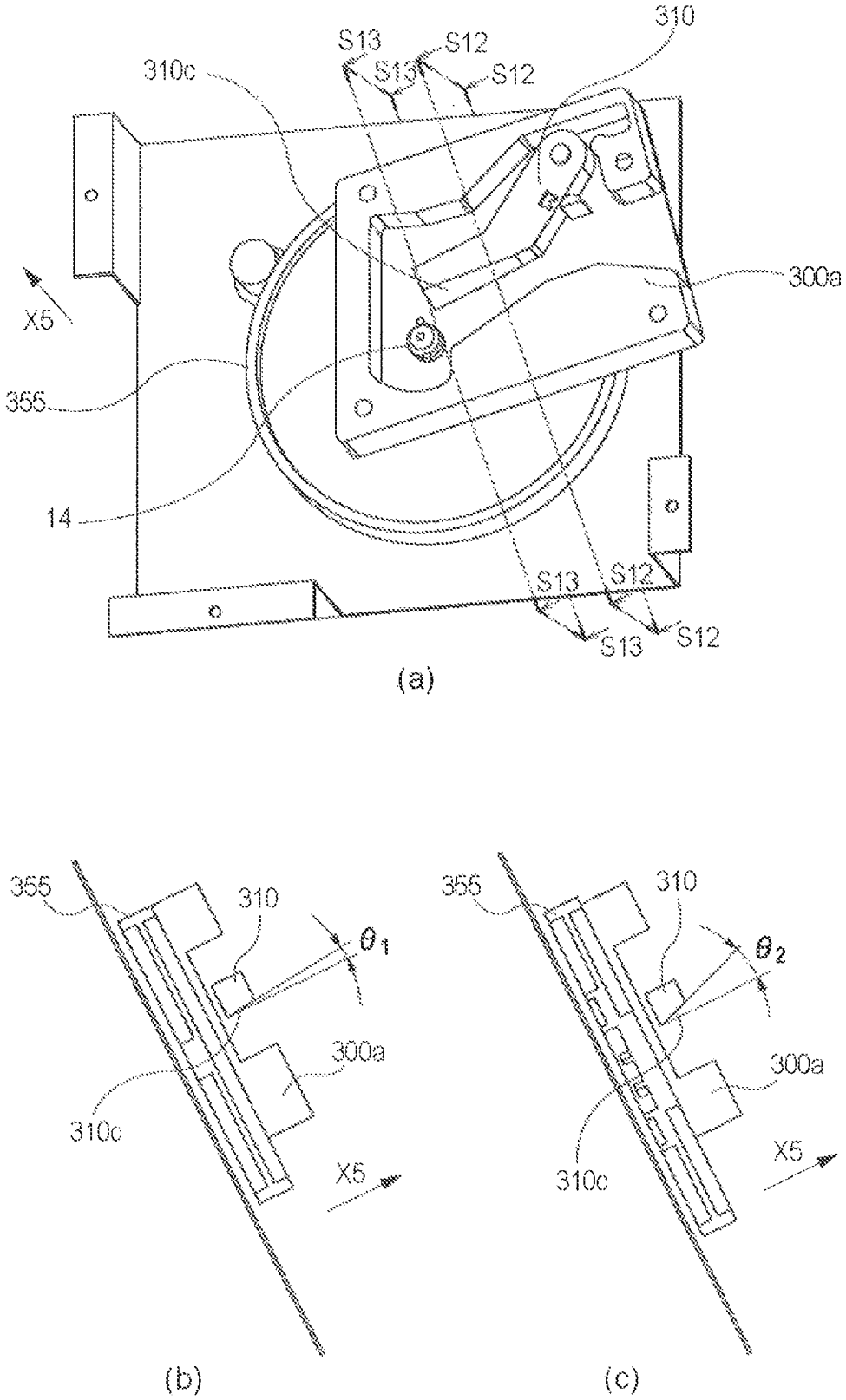
FIG. 56 is an enlarged view of a part of a driving portion of an apparatus main assembly, according to an eighth embodiment of the present invention.

Part (a) of FIG. 56 is a perspective view of a driving portion, part (b) of FIG. 56 is a schematic sectional view taken along a plane S12 of part (a) of FIG. 56, part (c) of FIG. 56 is a schematic sectional view taken along a plane S13 of part (a) of FIG. 56.

As shown in parts (b) and (c) of FIG. 56, an inclination angle θ1 of the inclined surface 310*c* of part (b) of FIG. 56 and an inclination angle θ2 of the inclined surface 310*c* of part (c) of FIG. 56 satisfy $\theta 1<\theta 2$.

In other words, the inclination angle of the inclined surface 310*c* of the upper guide 310 expanding toward the inside of the main assembly A (direction X5) along the cartridge mounting direction toward the downstream side.

Figure 57:
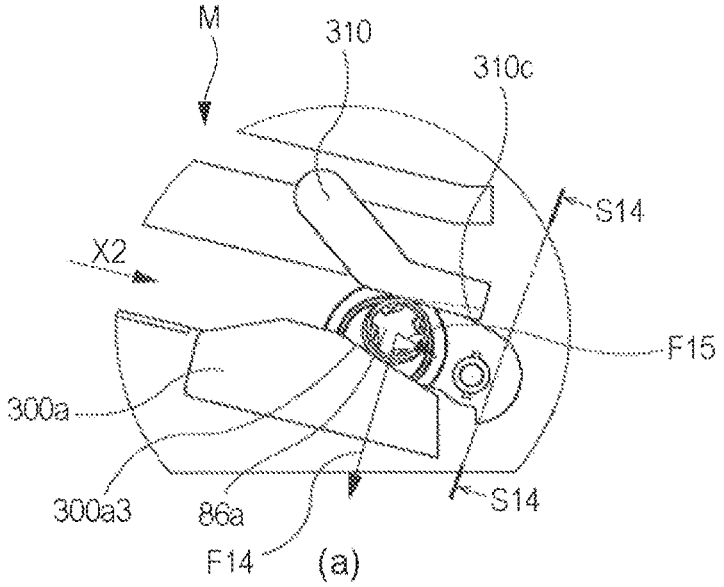
FIG. 57 is an illustration of cartridge mounting to the apparatus main assembly, according to the eighth embodiment of the present invention.
Figure 57:
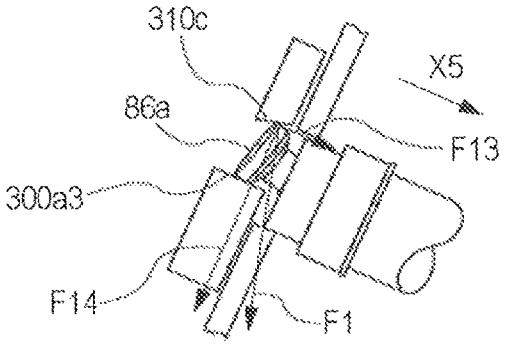
Figure 57:
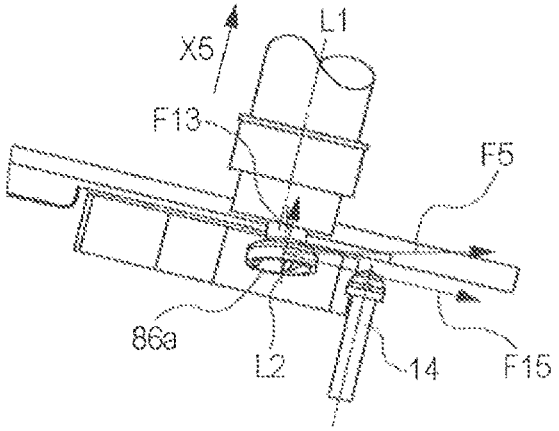

FIG. 57 shows a state in which the free end portion 86*a* of the coupling member 86 is sandwiched between the lower guide 300*a* and the upper guide 310, and is inclined (pivoted) toward the downstream with respect to the mounting direction (direction X2) beyond the axis L1 of the drum 62.

Figure 58:
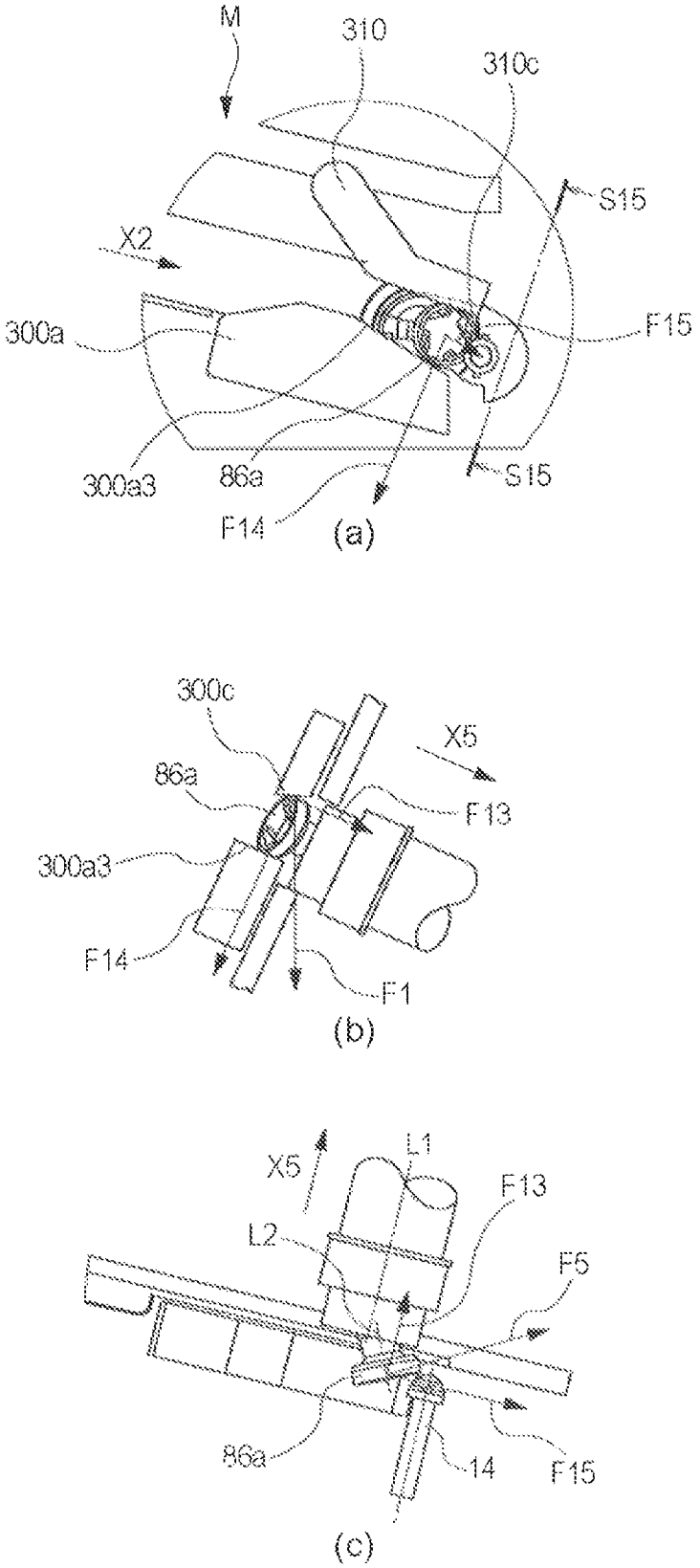
FIG. 58 is an illustration of cartridge mounting to the apparatus main assembly, according to the eighth embodiment of the present invention.

FIG. 58 shows a state in which the cartridge B is further moved toward the downstream into the apparatus main assembly.

With this structure, as shown in FIGS. 57 and 58, with the downward movement of the cartridge B, the coupling 86 is inclining (pivoting) toward the X2.

Similarly, with the downward movement of the cartridge B, the component force F13 applied to the free end portion 86*a* of the coupling member 86 in the direction toward the inside of the apparatus main assembly (direction X5) gradually increases.

In other words, with this structure, the component force F13 toward the inside of the main assembly A increases with the inclination (pivoting) of the coupling 86 Toward the X2 as the cartridge B is moved toward the downstream with respect to the mounting direction.

FIG. 57 shows the resultant force F5 of the component force F13 and the component force the applied to the free end portion 86*a* with respect to the inclination (pivoting) amount of the coupling 86 toward the X2 side at this point of time.

In FIG. 58 showing a state in which the cartridge B is further moved toward the mounting position, the inclination (pivoting) amount of the coupling 86 in the direction of X2 is larger than that in FIG. 57. Also, the component force F13 toward the inside of the apparatus main assembly is larger than that in FIG. 57. The resultant force F5 of the component force F13 and the component force F15 at this time is shown.

As described in the foregoing, in the motion of the coupling member 86 inclining (pivoting), the inclining (pivoting) moment is large and therefore the proper inclination (pivoting) is accomplished, when the force applied to the free end portion 86*a* is in the direction perpendicular to the axis L2 of the coupling member 86.

With this structure, as shown in FIGS. 57 and 58, the direction of the resultant force F5 changes so as to be closer to perpendicular to the axis L2 of the coupling member 86 in accordance with the change of the inclination (pivoting) amount of the coupling 86 toward the X2.

Thus, in accordance with the inclination (pivoting the amount of the coupling 86 changing with the mounting movement of the cartridge B, the direction of the resultant force F5 changes toward further preferable state for the inclination (pivoting). Therefore, the coupling 86 can be stably inclined (pivoted) in the direction of X2.

When the cartridge B is further inserted in the direction X2, the coupling member 86 is engaged with the main assembly side engaging portion 14.

As described above, with this structure, a further stabilized engagement is established between the coupling member 86 and the main assembly side engaging portion 14.

In the foregoing description, the function, the material, the configuration, the relative positions of the constituent elements of this embodiment are not restrictive to the present invention. The apparatus main assembly of this embodiment is usable with the coupling member and the rotational force transmitted member of Embodiments 2-4.

Other Embodiments

In the foregoing embodiments, the present invention is used for a process cartridge.

However, the present invention can be suitably used with a drum unit not provided with a process means.

In addition, the present invention is suitably applicable to a developing cartridge not provided with an electrophotographic photosensitive drum, in which the rotational force is transmitted to a developing roller (which rotates carrying toner) from the main assembly side engaging portion. In such a case, the coupling member 86 transmits the rotational force to the developing roller 32 as the rotatable member in place of the photosensitive drum.

In the foregoing embodiments, the driving side flange 87, 287 as the rotational force transmitted member is fixed to the longitudinal end of the rotatable drum 62, but may be an independent member not fixed to the drum. For example, it may be a gear member through which the rotational force is transmitted to the drum 62 or the developing roller 32 by gear engagement.

In addition, the cartridge in the foregoing embodiments is for formation of a monochromatic image. However, the present invention is not limited to such a case. The present invention is suitably applicable to a cartridge or cartridges including developing means for forming different color images (two colors, three colors or full color).

The mounting-and-demounting path of the cartridge B relative to the main assembly A may be rectilinear, a combination of linear lines, or may include a curve line, with which the present invention is suitably implemented.

The present invention is applicable to a cartridge and a drive transmission device, for an electrophotographic image forming apparatus.

INDUSTRIAL APPLICABILITY

According to the present invention, a drive transmission structure for a cartridge which is demountable to an outside from an apparatus main assembly not provided with a mechanism for moving a main assembly side engaging portion in the rotational axis direction thereof, after movement in a predetermined direction substantially perpendicular to a rotational axis of a rotatable member such as an electrophotographic photosensitive drum, in which the coupling member is prevented from disengaging without limiting the inclinability (pivotability) amount of the coupling member by the inner edge of the opening provided in the flange.

In addition, a cartridge employing the drive transmission device is provided.

DESCRIPTION OF REFERENCE NUMERALS

3: exposure device (laser scanner unit)
4: sheet tray
5*a*: pick-up roller
5*b*: a pair of feeding rollers
5*c*: pair of feeding rollers
6: transfer guide
7: transfer roller
8: feeding guide
9: fixing device
9*a*: heating roller
9*b*: pressing roller
10: discharging roller
11: discharging tray
12: guiding rail
12*a*: first guiding rail
12*b*: second guiding rail
13: opening and closing door
14: main assembly side engaging portion
14*a*: driving shaft
14*b*: rotational force applying portion
15: slider
15*a*: inclined surface
15*b*: apex
16: urging member
20: developing unit
21: toner accommodating container
22: closing member
23: developing container
23*a*L: arm portion
23*a*R: arm portion
23*b*L: rotation hole
23*b*R: rotation hole
26: side member
26L: first side member
26R: second side member
28: toner supply chamber
29: toner chamber
32: developing roller
34: magnet roller
38: spacer member
42: developing blade
43: feeding member

60: cleaning unit
62: electrophotographic photosensitive drum (drum)
64: non-driving side flange
64*a*: hole
66: charging roller
71: cleaning frame
71*a*: fitting hole
71*b*: residual toner chamber
71*c*: rotation stopper boss
74: exposure window
75: coupling member
76: bearing member
76*b*: guide portion
76*d*: cylindrical portion
77: cleaning blade
78: drum shaft
86, 386, 486: coupling member
86*a*: free end portion
86*b*: through-hole (hole portion)
86*b*1: rotational force transmitting portion
86*p*1: first disengagement preventing portion
86*c*: connecting portion
86*d*1-*d*4: projection
86*e*1-*e*4: rotational force receiving portion
86*f*: receiving surface
86 *g*: connecting portion
86*h*: longitudinal direction regulating portion
86*k*1-*k*4: standing-by portion
86*m*: opening
86*z*: recess
87, 287, 487: rotational force transmitted member (driving side flange)
87*b*: fixed portion
87*d*: portion-to-be-supported
87*e*: hole portion
87*f*: retaining portion
87 *g*: rotational force transmitted portion
87*h*: longitudinal direction regulating portion
87*i*: accommodating portion
88: shaft portion (pin)
89, 489: regulating member
89*a*: base portion
89*b*: projected portion
89*b*1: longitudinal direction regulating portion
89*b*2: rotation regulating portion
90: screw
287: recess
287*m*: retaining portion
300*a*: lower guide
300*a*1: first guide portion
300*a*2: second guide portion
300*a*3: third guide portion
300*b*: rotational shaft
300*c*: stopper
300*d*: bearing portion
300*e*: inclined surface
310: upper guide
310*a*: operating surface
310*b*: inclined surface
310*c*: inclined surface
315: urging spring
320: guiding member
320*a*: positioning portion
320*b*: positioning surface
320*c*: rotational shaft
320*c*: stopper
320*d*: stopper
320*e*: stopper
320*f*: cartridge guide portion
320 *g*: coupling guiding portion
340: holder
340*a*: upper guide
340*a*1: first guide portion
340*a*2: second guide portion
340*a*3: third guide portion
340*b*: rotational shaft
340*c*: stopper
350: side plate
351: second side plate
352: motor
353: pinion gear
354: bearing
355: driving gear
356: pulling spring
356*a*: operating portion
360: lower guide
360*a*: operating surface
A: main assembly of electrophotographic image forming apparatus (apparatus main assembly)
B: process cartridge (cartridge)
D: feeding direction
L: laser beam
T: toner (developer)
P: sheet material (recording material)
R: rotational moving direction
U1: electrophotographic photosensitive drum unit (drum unit)
U2, U42: driving side flange unit
L1: rotational axis of electrophotographic photosensitive drum
L2, L32, L42: rotational axis of coupling member
θ1: inclination angle
θ2: inclination angle

The invention claimed is:

1. A gear unit comprising:
(i) a gear including an accommodating portion at an inside of the gear;
(ii) a coupling member including:
(ii-i) a free end portion having at least one projection,
(ii-ii) a connecting portion that is connected with the gear and at least a part of which is accommodated in the accommodating portion so that a rotational axis of the coupling member is inclinable relative to a rotational axis of the gear, and
(ii-iii) a through-hole penetrating the connecting portion; and
(iii) a shaft capable of receiving a rotational force from the coupling member, penetrating the through-hole, and supported by the gear at opposite end portions of the shaft so as to permit the coupling member to incline with respect to the shaft.

2. A gear unit according to claim 1, wherein the shaft is provided in the accommodating portion.

3. A gear unit according to claim 1, wherein the coupling member is prevented from disengaging from the gear.

4. A gear unit according to claim 1, wherein a rotational force is transmitted from the coupling member to the shaft by the shaft contacting an inside of the through-hole.

5. A gear unit according to claim 1, wherein the shaft extends in a direction substantially perpendicular to the rotational axis of the gear.

6. A gear unit according to claim 1, wherein the through-hole opens in a direction substantially perpendicular to the rotational axis of the coupling member.

7. A gear unit according to claim 1, wherein a cross-sectional area of the through-hole is minimum adjacent to the rotational axis of the coupling member.

8. A gear unit according to claim 7, wherein the cross-sectional area of the through-hole increases as a distance from the rotational axis of the coupling member increases.

9. A gear unit according to claim 1, wherein, in a state that the rotational axis of the coupling member and the rotational axis of the gear are aligned with each other, the coupling member is prevented from disengagement from the gear by the shaft contacting a portion of the through-hole adjacent the rotational axis of the coupling member.

10. A gear unit according to claim 1, wherein the through-hole is provided with play relative to the shaft so that the coupling member is movable in a direction of the rotational axis of the gear.

11. A gear unit according to claim 10, wherein a maximum outside circumference of the connecting portion is movable from an inside of the accommodating portion to an outside of the accommodating portion.

12. A gear unit according to claim 11, wherein, in a state that the maximum outside circumference of the connecting portion is outside of the accommodating portion, the coupling member is movable in a direction perpendicular to the rotational axis of the gear, and wherein, in a state that the maximum outside circumference of the connecting portion is inside the accommodating portion, the coupling member is not movable in the direction perpendicular to the rotational axis of the gear.

13. A gear unit according to claim 1, wherein the gear includes:

i) a pair of holes penetrating in parallel with the rotational axis of the gear at positions opposite from each other with respect to the rotational axis of the gear, ii) a pair of retaining portions projecting in directions crossing with the rotational axis of the gear, the pair of retaining portions covering parts of respective holes, of the pair of holes, as seen from the accommodating portion along the rotational axis of the gear, and iii) a pair of rotational force transmitted portions configured to receive the rotational force from the shaft and positioned behind the pair of retaining portions, respectively.

14. A gear unit according to claim 13, further comprising:

a regulating member having a pair of projected portions, wherein the projected portions are inserted into respective ones of the pair of holes from a side opposite from the accommodating portion along the rotational axis of the gear to connect the regulating member and the gear with each other.

15. A gear unit according to claim 14, wherein opposite end portions of the shaft are supported by free ends of the pair of projected portions, the pair of retaining portions, and the gear.

16. A gear unit according to claim 14, wherein opposite end portions of the shaft are inserted into the pair of holes, and then the shaft is rotated about the rotational axis of the gear, by which the opposite end portions of the shaft are moved to behind the pair of retaining portions, respectively, and in such a state, the pair of projected portions are inserted into the pair of the holes, by which the shaft is supported by the gear.

17. A gear unit according to claim 16, wherein after the opposite end portions of the shaft are inserted into the accommodating portion along the rotational axis of the gear, the shaft is rotated about the rotational axis of the gear.

18. A gear unit according to claim 1, wherein the gear is provided with a pair of recesses recessed in a direction from an accommodating portion side toward a rotatable member side at opposite positions with respect to the rotational axis of the gear, and wherein, in a state that opposite end portions of the shaft are inserted in the pair of recesses, respectively, entrances of the pair of recesses are closed by clamping or resin material injection, by which the shaft is supported by the gear.

19. A gear unit according to claim 1, wherein the connecting portion has a substantially spherical shape.

20. A gear unit according to claim 1, wherein the connecting portion includes a pivoting regulated portion that is recessed beyond portions other than the pivoting regulated portion.

21. A gear unit according to claim 20, wherein the pivoting regulated portion has a flat surface configuration.

22. A gear unit according to claim 20, wherein the pivoting regulated portion has a concaved conical surface.

23. A gear unit according to claim 20, wherein the pivoting regulated portion has a conical surface.

24. A gear unit according to claim 1, wherein the coupling member is provided with a first hole portion penetration from a free end portion to the through-hole along the direction of rotational axis of the coupling member.

25. A gear unit according to claim 24, wherein the coupling member is provided inside of the first hole portion with a rib extending in a direction crossing with the rotational axis of the coupling member.

26. A gear unit according to claim 24, wherein the gear is provided with a second hole portion penetrating along the rotational axis of the gear.

* * * * *